US006266644B1

(12) United States Patent
Levine

(10) Patent No.: US 6,266,644 B1
(45) Date of Patent: Jul. 24, 2001

(54) AUDIO ENCODING APPARATUS AND METHODS

(75) Inventor: Scott Nathan Levine, Palo Alto, CA (US)

(73) Assignee: Liquid Audio, Inc., Redwood City, CA (US)

( * ) Notice: Subject to any disclaimer, the term of this patent is extended or adjusted under 35 U.S.C. 154(b) by 0 days.

(21) Appl. No.: 09/161,198

(22) Filed: Sep. 26, 1998

(51) Int. Cl.[7] ..... G10L 21/04
(52) U.S. Cl. ..... 704/503; 704/200.1; 704/500
(58) Field of Search ..... 704/500, 501, 704/502, 503, 504, 226, 227, 228, 203, 209, 200.1

(56) References Cited

U.S. PATENT DOCUMENTS

| | | | | |
|---|---|---|---|---|
| 4,530,088 | | 7/1985 | Hamstra et al. | 370/110.1 |
| 4,901,244 | * | 2/1990 | Szeto et al. | 702/77 |
| 5,054,072 | | 10/1991 | McAulay et al. | 381/31 |
| 5,418,713 | | 5/1995 | Allen | 364/403 |
| 5,636,276 | | 6/1997 | Brugger | 380/4 |
| 5,699,484 | * | 12/1997 | Davis | 704/219 |
| 5,734,823 | | 3/1998 | Saigh et al. | 395/200.06 |
| 5,734,891 | | 3/1998 | Saigh | 395/610 |
| 5,774,837 | | 6/1998 | Yeldener et al. | 704/208 |
| 5,787,387 | | 7/1998 | Aguilar | 704/208 |
| 5,794,217 | | 8/1998 | Allen | 705/27 |
| 5,886,276 | * | 3/1999 | Levine et al. | 84/603 |

OTHER PUBLICATIONS

Bosi, et al., "ISO/IEC MPEG–2 Advanced Audio Coding," An Audio Engineering Society Reprint, Presented at the 101st Convention, Nov. 8–11, 1996, Los Angeles, CA.

Serra, et al., "Spectral Modeling Synthesis: A Sound Analysis/Synthesis System Based on a Deterministic plus Stochastic Decomposition," Computer Music Journal, 14(4):12–14.

McAulay, et al., "Speech Analysis/Synthesis Based on a Sinusoidal Representation," IEEE Transactions on Acoustics, Speech and Signal Processing, vol. ASSP–34 No. 4, Aug., 1986.

ICASSP–93. 1993 IEEE International Conference on Acoustics, Speech and Signal Processing. Schoenle et al., "Parametric approximation of room Impulse responses by multirate systems". pp. 153–156 vol. 1 4/1993.*

* cited by examiner

*Primary Examiner*—Richemond Dorvil
(74) *Attorney, Agent, or Firm*—James D. Ivey

(57) ABSTRACT

An audio encoding system includes quantization, phase matching, compressed domain processing and other improvements enabling high fidelity, low bit rate encoding systems to be formed. In a preferred embodiment a novel transient detector is used to divide an audio source into transient, low frequency non-transient and high frequency non-transient regions. Low frequency non-transients are sinusoid modeled and the residual is low frequency noise modeled. Transients are transform coded and high frequency non-transients and transform coded residual is high frequency noise modeled. The preferred embodiment also includes novel sinusoid, transform coded and noise quantization, among other methods for providing high fidelity data reduction and for interfacing sinusoid modeling and transform coding. Compressed domain time compression and expansion are further achieved with no detrimental effect on transients.

13 Claims, 40 Drawing Sheets

100

CLIENT-N
105
152
DEMUX
USER
153
154
155
SINUSOIDAL PROCESSOR
NOISE PROCESSOR
TRANSIENT PROCESSOR
150
SYNTHESIZER
156
AUDIO

| FIGURE 5A | FIGURE 5B |
|---|---|

| FIGURE 13A | FIGURE 13B |
|---|---|

SINUSOIDAL DECODER

AUDIO ENCODING APPARATUS AND METHODS

FIELD OF THE INVENTION

The present invention relates generally to audio encoding and decoding and more particularly, to apparatus and methods for encoding, storing, transferring, receiving, modifying and decoding audio data.

BACKGROUND OF THE INVENTION

Audio encoding is a process by which a typically digitized audible sound or "audio source" is converted ("encoded") into an "encoded audio" form for storage, transfer and/or manipulation. In a complimentary fashion, audio decoding converts encoded audio (typically received from storage and/or via data transfer) into decoded audio, which can then be rendered and played back as audible sound. An audio encoding system typically includes at least one encoder and one decoder as integrated elements within one or more host processing systems.

Particularly problematic in encoding system design have been conflicting requirements of providing high fidelity audio, in a desired form, and using a minimally complex system. More specifically, an audio encoder will ideally deliver perceptually "lossless" encoded audio. That is, the encoded audio, when decoded and rendered, should sound identical to the source audio (i.e. with no audible artifacts or other perceivable loss of fidelity). On the other hand, it is also desirable to minimize the amount of encoded data in order to preserve available storage, throughput and bandwidth for other uses. To pursue these requirements, encoding system designers have relied largely on established data reduction methods which should theoretically preserve audio fidelity. However, to achieve high fidelity, such methods have failed to provide sufficiently low bit rates. Conversely, these methods, particularly when merely approximated to reduce bit rates and/or complexity, have not assured high fidelity.

Adding to these problems is the manner in which "processed" encoded audio is typically provided using conventional low bit-rate encoding methods. Processing, such as time and frequency modification, is conducted on non-encoded audio. Audio is typically stored and/or transferred in encoded form (thereby conserving storage or bandwidth), then decoded, then time or frequency modified, then re-encoded, and then once again transferred and/or stored (again conserving system resources). However, given the complexity of conventional encoding methods, decoding and re-encoding has become computationally expensive.

For example, in transform coding, a digital audio source is broken down into frames (typically about 5 to 50 milliseconds long). Each frame is then converted into spectral coefficients using a time-domain aliasing cancellation filter bank. Finally, the spectral coefficients are quantized according to a psychoacoustic model. During decoding, the quantized spectral coefficients are used to re-synthesize the encoded audio.

Advantageously, transform coding is relatively computationally efficient and is capable of producing perceptually lossless encoding. It is therefore preferred where high fidelity encoding of an audio source is critical. Unfortunately, such high fidelity comes at the cost of a large amount of encoded data or "high bit rate". For example, a one minute audio would produce 480 kilobytes of transform-coded audio data, resulting in a compression ratio of only 11 to 1. Thus, transform coding is considered inappropriate for high compression applications. In addition, conventional methods used to quantize transform coded audio data can result in a substantial loss of its high fidelity benefits. Broadly stated, quantization is a form of data reduction in which approximations, which are considered substantially representative of actual data, are substituted for the actual data. Conventionally, transform coded data is quantized by encoding less than the complete frequency range of the audio source. Yet another disadvantage is that transform coding is that it is not considered amenable to time or frequency modification. With time modification, audio data is modified to playback faster or slower at the same pitch. Conversely, frequency modification alters the playback pitch without affecting playback speed.

Another example, conventional sinusoidal modeling, is used as an alternative to transform coding. In sinusoidal modeling, an entire audio data stream is analyzed in time increments or "windows". For each window, a fast Fourier transform ("FFT") is used to determine the primary audio frequency components or "spectral peaks" of the source audio. The spectral peaks are then modeled as a number of sine waves, each sine wave having specific amplitude, frequency and phase characteristics. Next, these characteristics or "sinusoidal parameter triads" are quantized. The resultant encoded audio is then typically stored and/or transferred. During decoding, each of the representative sine waves is synthesized from a corresponding set of sinusoidal parameters.

An advantage of sinusoidal modeling is that it tends to represent an audio source using a relatively small amount of data. For example, the above 1 minute audio source can be represented using only 120 kilobytes of encoded audio. Comparing the encoded audio to the audio source, this represents a data reduction or "compression ratio" of 44 to 1. (In practice, encoder designs are generally targeted at achieving compression ratio of 10 to 1 or more.)

Sinusoidal modeling is also generally well-suited to such audio data modifications as time and frequency scaling. In sinusoidal modeling, time scaling is conventionally achieved by altering the decoder's window length relative to the window length in the encoder. Frequency modification is further conventionally achieved by scaling the frequency information in the "parameter triads". Both are well established methods.

Unfortunately, conventional sinusoidal modeling also has certain disadvantages. First, sinusoidal modeling poorly models certain audio components. Sound can be viewed as comprising a combination of short tonal or atonal attacks or "transients" (e.g. striking a drum), as well as relatively stable tonal components ("steady-state") and noise components. While sinusoidal modeling represents steady-state portions relatively well, it does a relatively poor job of representing transients and noise. Transients, many of which are crisp combinations of tone and noise, tend to become muddled. Further, an attempt to represent transients or noise using sinusoids requires an large number of short sine waves, thereby increasing bit rate. In addition, while sinusoidal encoding is generally well suited to data modification or "audio processing", it tends to exaggerate the above deficiencies with regard to transients. For example, time compression and expansion tend to unnaturally sharpen or muddle transients, and frequency modification tends to unnaturally color the tone quality of transients.

Another sinusoidal modeling disadvantage is that conventional methods used to quantize sinusoidal models tend to cause a readily perceived degradation of audio fidelity. One approach to sinusoidal model quantization is based on established human hearing limitations. It is well-known that, where a listener is presented with two sound components that are close in frequency, a lower energy component can be masked by a higher energy component. More simply, louder audio components can mask softer ones. Thus, an analysis of an audio source can be conducted according to a "psychoacoustic model" of human hearing. Then, those frequency components which the model suggests would be masked (i.e. would not be heard by a listener) are discarded.

This first approach is typically implemented according to one of the following methods. In a first method, masking is presumed. That is, all sinusoids measured as being below a predetermined threshold energy level are summarily presumed to be masked and are therefore discarded. In a second method, a psychoacoustic analysis is performed on each frame of sinusoids and those sinusoids which are deemed inaudible due to determined masking effects are discarded. A third method adds an iterative aspect to the frame-by-frame psychoacoustic modeling of the second method. In this case, sinusoids are discarded in an order of decreasing likelihood of being masked (e.g. the sinusoid that is most likely to be masked is discarded first, then the next most likely, and so on). This process of discarding is repeated until the remaining amount of audio data bits within the frame (i.e. frame "bit rate") is within a predetermined maximum. Unfortunately, while psychoacoustic modeling might be expected to provide predictable results, this inventor's listening tests have revealed variably degraded audio fidelity when using each of these methods.

A second approach to sinusoidal model quantization is based on an alternative presumption regarding human hearing limitations. As discussed, sinusoidal modeling selects tonal peaks as representative of a window of audio data. It has been observed, however, that a series of consecutive tonal peaks will tend to vary linearly, such that the entire series can be represented by a single peak-to-peak line segment or "trajectory". Thus, the amount of data required to represent the series of tonal peaks can be reduced by replacing a series of sinusoid parameters with its corresponding trajectory. The presumption here is that a sufficiently short trajectory, depending upon the nature of the audio source (e.g. speech, mono or polyphonic, specific musical work, etc.), will not be heard. In practice, a user of the encoding system sets a threshold trajectory length according to the nature of the audio source. Thereafter, all trajectories that are shorter than the threshold are summarily discarded. Once again, this inventor's listening tests have revealed various degrees of degraded audio fidelity using this method.

A different approach to signal modification is the use of the phase vocoder. The phase vocoder splits a signal into frame, from length 6 to 50 msec long, and performs an FFT on each frame. This complex FFT data is converted into separate magnitude and phase information. In order to time-stretch the audio, the magnitude and phase data are temporally interpolated. Then the inverse FFT synthesis window is shorter or longer than the original analysis window length, depending on the desired time-stretching factor. While the phase vocoder sounds quite good for large time-scale stretching factors, it is not designed as a data compression tool. To date, no one has shown a phase vocoder that can both perform data compression and time-scale modification. In addition, the phase vocoder has difficulties handling transients; attack transients will sound smeared when time-scaled using the phase vocoder.

This inventor's prior U.S. patent application Ser. No. 09/007,995, filed Jan. 16, 1998, teaches a number of improvements to conventional encoding methods. Among these improvements are multi resolution sinusoidal encoding, sinusoidal transient encoding, and a composite encoding system employing these encoding methods in combination with noise modeling. U.S. patent application Ser. No. 09/007,995 is hereby incorporated by reference as if repeated verbatim immediately hereinafter.

Multiresolution sinusoidal encoding and sinusoidal transient modeling can be viewed in a rather simplified, summary fashion for present purposes as follows. Multiresolution sinusoidal encoding, among other aspects, broadly includes the use of variable window sizes for analyzing and encoding source audio. Preferably, selected source audio frequency bands are matched to corresponding window sizes. Thus, fidelity is improved by using an optimal window size for each frequency band. Sinusoidal transient modeling ("STM"), among other aspects, broadly includes performing a long audio frame discrete cosine transform, dividing the result into smaller frames and then performing an FFT on the smaller frames to produce frequency domain encoded audio.

The advent of multiresolution sinusoidal encoding and STM provides certain advantages. Most relevant to the present discussion is that the two methods can be readily combined to form a composite encoder that facilitates low complexity quantization and compression-mode processing. More specifically, the two methods are well matched. Both are full-frequency methods (i.e. encode the entire frequency range of an audio source) and both form encoded audio that is comprised of sinusoids. Thus, the two methods are necessarily compatible with one another. In addition, similar sinusoid-based quantization and processing methods can be utilized not only for both methods, but for both methods over the entire frequency range of the encoded audio. Further, methods for quantizing and processing sinusoids, alone or with the residual captured by noise, are well known.

Unfortunately, the above combination also presents certain disadvantages. For example, while multiresolution sinusoidal modeling enables higher fidelity encoding, it does so at the cost of a higher bit-rate. Also, while STM provides generally high fidelity, listening tests have revealed degraded fidelity where polyphonic sources are encoded. (Note that polyphonic music encoding using sinusoidal modeling is a relatively new concept.) Listening tests and experimentation have also revealed that certain characteristics of the combination can be vastly improved, particularly where conventional quantization and processing have been relied upon. For example, time and frequency compression ratios must be limited if fidelity is to be retained.

Finally, given the successful implementation of newly discovered techniques of the invention, certain conventional assumptions and methods are clearly problematic. In addition, conventional data reduction versus fidelity and complexity tradeoffs can be improved with regard to both singular and composite encoding systems.

Accordingly, there is a need for audio encoding/decoding apparatus and methods capable of providing improved data reduction versus fidelity and complexity tradeoffs with regard to both singular and composite encoding systems. There is further a need for an encoding/decoding apparatus and methods that facilitates high fidelity compression domain processing.

SUMMARY OF THE INVENTION

The present invention provides a data processing system-based encoding system for encoding, storing transferring, receiving, decoding and modifying audio data. More specifically, the invention provides several improvements to the audio encoding arts conceived in connection with the formation of a composite encoding system. These improvements not only allow seemingly incompatible composite encoders to be formed, but also exploit the advantages of each component encoding method. For example, in one aspect, improved quantization has been discovered for a number of conventionally separately utilized encoding methods. Thus, using these and other methods, encoded data can be more densely packed for more efficient storage and/or transfer to other systems. In another aspect, the invention provides for interfacing parametric encoding with non-parametric encoding. Yet another aspect teaches intermittent sinusoidal phase locking, thereby enabling seamless transitions between sinusoidal modeling and transform coding among other advantages. A further aspect teaches high quality and low complexity compression domain processing. A still further aspect teaches improved transient detection. Together, these and other aspects also provide a composite data representation that enables high quality, low bit-rate data compression and compressed domain processing.

In a preferred embodiment, an audio source is divided among encoding methods according to both time and frequency criteria. The audio source is first divided into transient regions and non-transient regions. The transient regions are encoded using transform coding. The non-transient regions are encoded below a threshold frequency using sinusoidal encoding and residual noise modeling. The non-transient regions above such threshold frequency are encoded using only noise modeling.

Advantageously, by separating the transients and non-transients, high quality time scale modification is now enabled. In addition, the combinations of sinusoidally and noise modeled non-transients with transform coded transients assures high fidelity encoding according to perceptual importance.

Novel quantization techniques for each of the component encoding methods provide for substantial bit rate reductions without losing fidelity. For example, in sinusoidal modeling, a joint SMR/trajectory length selection criteria provides for an approximately thirty percent data reduction without loss of fidelity. By downsampling the less perceptually important trajectories, the bit rates can also be significantly reduced, again without fidelity loss. A trimming method for transform coding and a temporal energy gain smoothing method for noise modeling further significantly reduce the total bit rate.

Dividing the audio source among specific encoding methods further provides for high quality, compressed domain audio modifications. For example, time scale modification is preferably performed by stretching the non-transient sinusoids and noise, while merely "shifting" the transform coded transients without alteration. Advantageously, this means that the transients, which have been found to provide the most perceptually important listening cues, are faithfully reproduced while the remainder of the signal is stretched and altered.

These and other objects, advantages and benefits of the present invention will become apparent from the drawings and specification that follow.

DETAILED DESCRIPTION OF THE PREFERRED EMBODIMENTS

For clarity sake, the embodiments discussed herein will be directed primarily toward a particular composite audio encoding system that has been found to produce especially high fidelity and low bit rate encoding. More specifically, a preferred audio encoder and decoder, as integrated within respective host processing systems, utilize a combination of sinusoidal, transform coding and noise modeling techniques to provide audio, for example, at 32 kilo-bits-per-second (kbps). (Other bit rates are also enabled by this preferred system.)

It will, however, become apparent to those skilled in the art that the present invention teaches a number of audio encoding system improvements having broad application. The invention, for example, teaches data reduction or "quantization" applicable to specific audio encoding techniques. Thus, a specific encoding technique can be separately utilized in conjunction with respective quantization improvements to provide high fidelity audio encoding at variably reduced bit-rates, depending on the specific improvements utilized. The invention also teaches improvements that enable various composite encoding systems to be formed from separate encoding techniques. Thus, benefits can be achieved through the enabled use of a particular encoding technique combination, through the use of applicable quantization, and/or other teachings. Such benefits can also be exploited in systems utilizing one or more encoders and/or decoders according to the invention. Examples of such systems include but are not limited to single user and multiple-user configurations of audio-only and multimedia delivery systems. Among other aspects, the invention also teaches how audio processing can be conducted using audio data in an encoded form ("compressed domain" processing), such as time and frequency modification. Again, it should be kept in mind that these and other aspects are applicable, among other uses, to separate audio encoding techniques, composite audio encoding, encoded data, and systems incorporating one or more encoders and/or decoders according to the teachings herein.

Figure 1A:
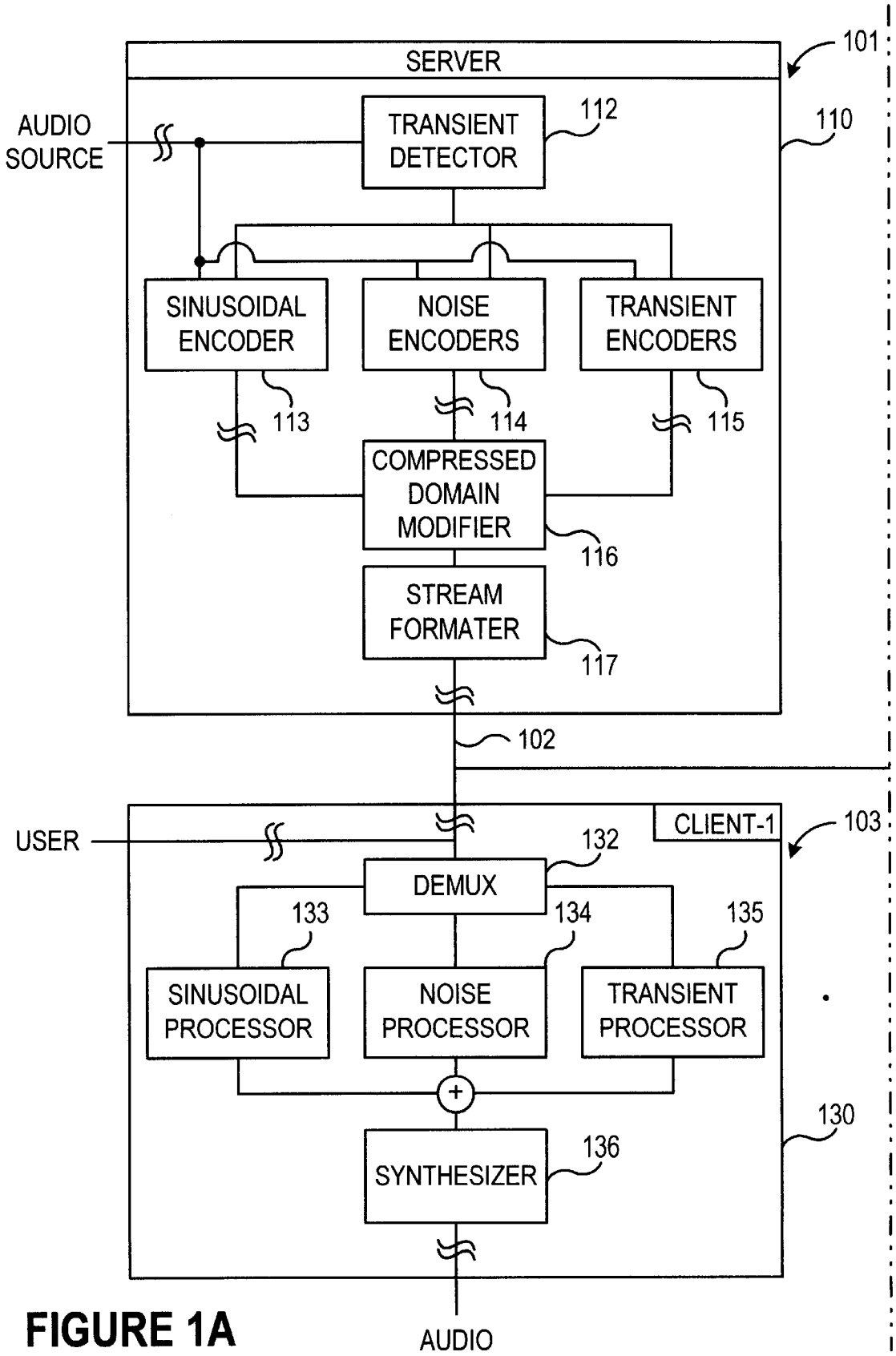
FIG. 1 is functional block diagram generally illustrates an encoding system, as used for audio data streaming in a client server network, according to a preferred embodiment of the invention.
Figures 1, 1A, 1B:
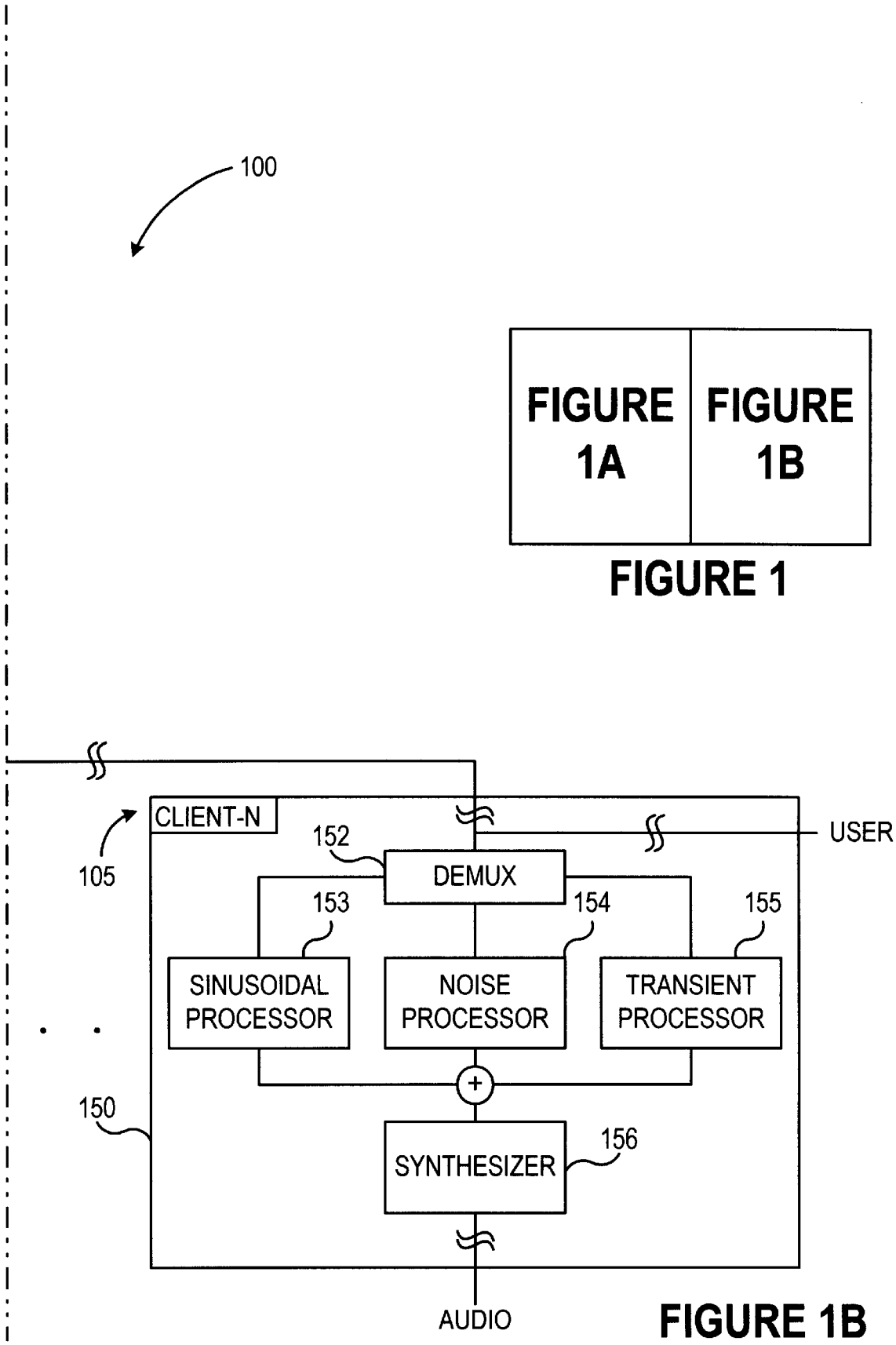

The FIG. 1 simplified functional diagram illustrates, by way of example, how a preferred composite encoder and preferred decoder can be utilized together for audio streaming applications. For clarity sake, such well known functions as communications interfaces, protocol handlers, buffering, delivery systems for other multimedia data, and multimedia data synchronization, among others, have been omitted. It will be understood that many variants of such functions, some of which are widely adopted, can be utilized. It is believed that an unobstructed illustration of only selected audio encoding system elements in a system context, along with lower-level discussions that follows, will provide a better understanding of the invention.

As shown, the encoding system preferably operates within a client-server configuration to provide streaming audio. Client-server system 100 comprises communicatingly coupled processing systems including preferred server 101 and preferred clients 103 and 105, as well as conventional communications media or "bus" 102. While system 100 provides for bidirectional communication between server 101 and clients, delivery of audio data (and other multimedia data types) is preferably conducted solely by server 101 via bus 102 to clients 103 and 105. Therefore, clients 103 and 105 require decoding capability but no source (other than server 101) of encoded audio. Obviously, other applications might impose different requirements, a subset of which will be noted in the discussion that follows.

Server 101 preferably comprises communicatingly coupled composite encoding system ("encoder") 110 elements including transient detector 112, sinusoidal encoder 113, noise encoders 114, transient encoder 115, compressed domain modifier 116 and stream formatter 117. During encoding, an audio source is received (from storage, memory and/or an external source) by transient detector 112, which determines which regions of the audio source are to be encoded as transients and which portions are to be encoded as non-transients. From this determination, the audio source will be encoded (typically continuously) by one or more of sinusoidal encoder 113, noise encoders 115, or transient encoder 115. During encoding, respective portions of the audio source are modeled and quantized, producing sinusoid, transient and noise encoded audio data. Following encoding, the encoded audio data will typically be stored in audio data storage, memory and/or some external location (not shown). Note that, where an encoder is sufficiently robust to operate in real-time, the encoded audio data would also be deliverable to a client contemporaneously with encoding. Compressed domain modifier 116 and stream formatter 117 preferably operate in response to request by a client for audio data, as will be discussed further.

Client-1 103 and client-N 105 are representative of a variable number of clients that can be coupled to system 100 for receiving and utilizing multimedia data delivered by server 101, among other conventionally provided client-server operations. Client-1 preferably comprises communicatingly coupled composite decoding system ("decoder") 130 elements including demultiplexer 132, sinusoidal processor 133, noise processor 134, transient processor 134 and synthesizer 136. Other clients (as exemplified by client-N 105) preferably include similar functional elements configured in a similar manner as client-1 103.

Client-server system 100 preferably conducts data delivery as follows (using client-1 103 as an example). Delivery is initiated by client-1 103 and request handling, handshaking, contention handling, user interface handling and other such well-known controls, protocols and operations are thereafter conducted in a conventional manner. However, during initiation and/or at other times during data transfer a user of client-1 103 can selectively invoke audio data modifications, such as time and/or frequency stretching and/or compression.

Server 101, upon receipt of a request, will begin transferring encoded audio data. Presuming that the requested data has been encoded and stored, server 101 responds to a request for audio data by transferring data from storage (not shown) to compressed-domain modifier 116. If the request does not include a request for data modification, then "default" modification-parameters, typically such that no modification is to be performed, will be sent to compressed-domain modifier 116. (Default modifications are similarly enabled.) If the request includes a request for data modification (or if such data modification request is later received from client-1 103), then corresponding modification parameters will be sent to compressed-domain modifier 116 and compressed-domain modifier 116 will perform the requested audio data modification. Encoded data is then transferred from compressed domain modifier 116 to stream formatter 117, which preferably forms a multiplexed audio data stream typically including sinusoidal, transient and noise encoded audio data. The multiplexed data stream is then transferred substantially continuously from stream formatter 117 via bus 102 to client-1 103 in a conventional manner and for a duration consistent with the request.

Client-1 103, upon receipt from server 101, stores, transfers and/or decodes the multiplexed data. During decoding, client-1 103 transfers the received multiplexed data to demultiplexer 132, which un-formats and sends the included sinusoidal, transient and noise encoded data respectively to decoding processors including sinusoidal processor 133, noise processor 134 and transient processor 135. Following decoding by decoding processors 133–135, the resultant decoded data is preferably summed together and then stored and/or transferred to synthesizer 136. The synthesized data can then be converted to analog form (if needed) and output in a conventional manner.

In view of the discussion herein, those skilled in the art will appreciate that the above system is subject to considerable variation. For example, the use of compressed-domain processing, and within the encoder, is preferred for reducing network and client overhead and a need for replicating such processing capability for each client. However, audio processing (where applicable) can be conducted in a variety of contexts. For example, processing can be conducted on combined audio data and/or separated audio data, on encoded data and/or not-encoded data, within an encoder, decoder and/or other systems, among other possibilities. Decoder-based, compressed-mode processing might, for example, be preferable where a single processing system such as a PC is used for listening to and/or editing audio data in memory, on a CD, or otherwise locally available. A single system might also include one or more encoders and/or decoders. Yet another example is that various other wired and/or wireless network configurations might be utilized, including but not limited to local area networks, wide area networks and the internet. Considerations such as client and/or server multimedia handling capability, network throughput (or "bandwidth") and/or other considerations might also suggest alternatives, as is often the case. Distributed processing and/or collaboration techniques might be utilized. An encoder and/or decoder might not be integrated within a host system, but rather separately configured, among other variations.

Figure 2:
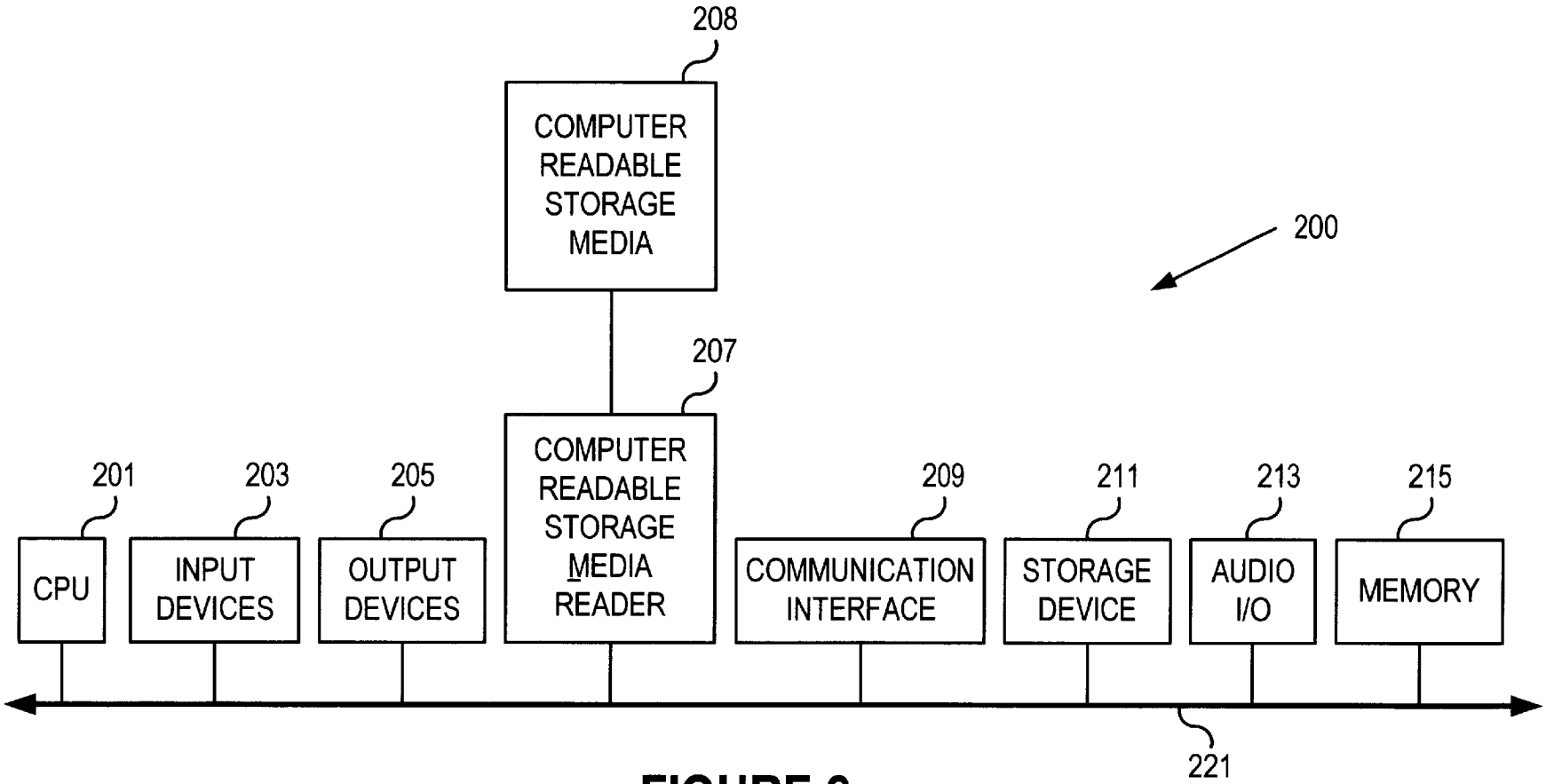
FIG. 2 is a functional block diagram illustrating the hardware and software elements of a preferred encoder and decoder according to the invention.
Figure 3:
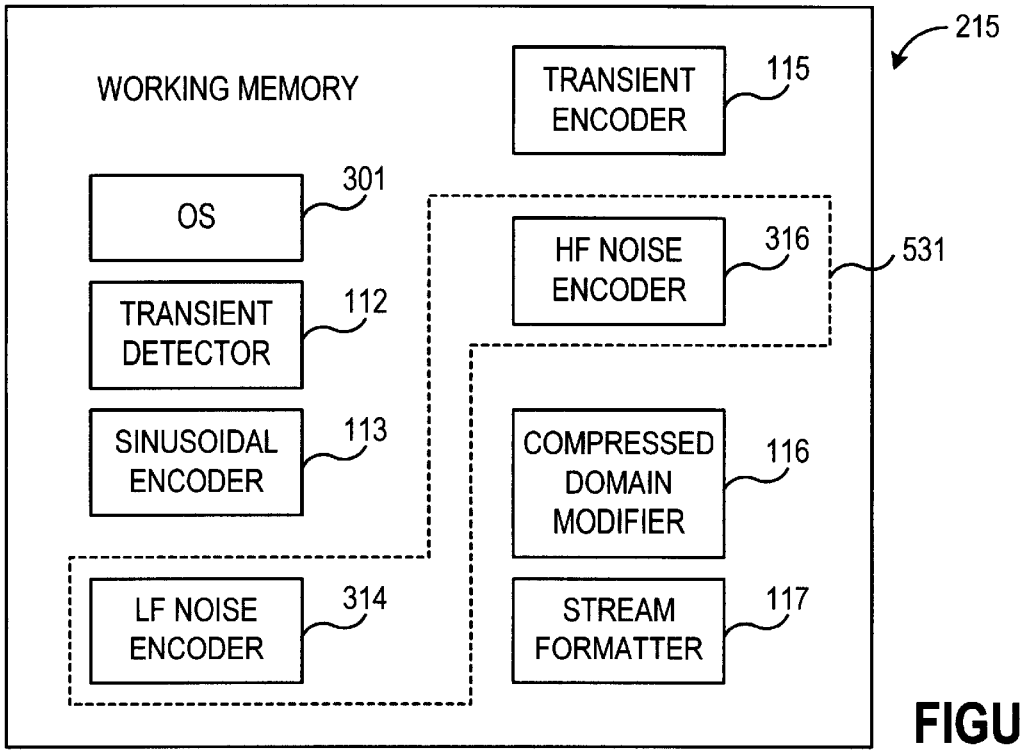
FIG. 3 and FIG. 27 are functional block diagram illustrating, in more detail the software elements of the preferred encoder of FIG. 2.
Figure 4:
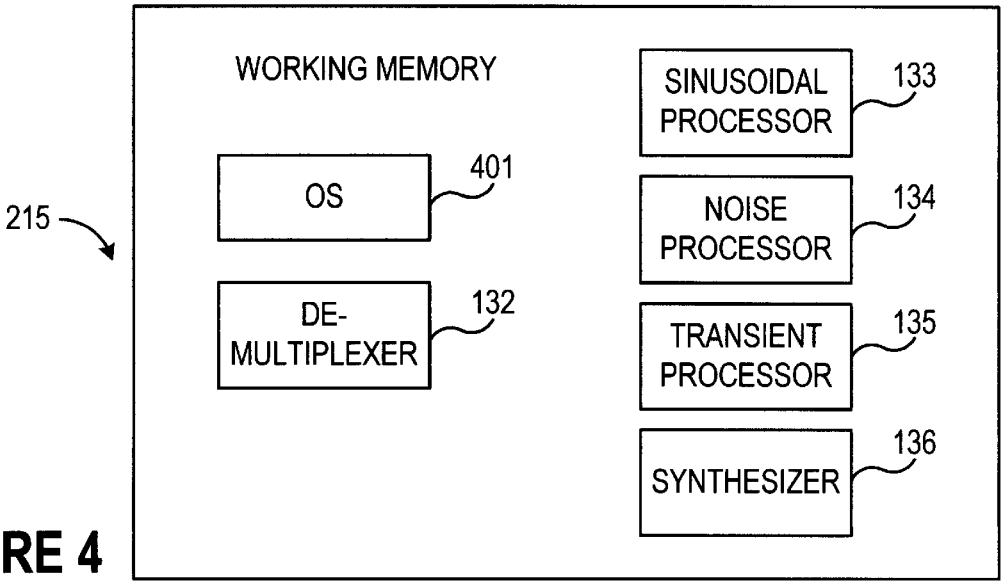
FIG. 4 is a functional block diagram illustrating, in more detail the software elements of the preferred decoder of FIG. 2.

FIGS. 2 through 4 illustrate how the encoder and decoder of FIG. 1 are preferably integrated within a generally conventionally configured host processing system, such as a PC.

Turning to FIG. 2, both the encoder and decoder preferably comprise hardware elements including CPU 201, input devices 203, output devices 205 computer readable storage media reader 207, communications interface 209, storage device 211, audio I/O 213, and memory 215. Computer readable storage media reader 207 is further coupled to computer readable storage media 208, which combination preferably includes local and/or remote storage devices and/or memory and memory control functionality operable in combination with or alternatively with storage device 211 and/or memory 215. While audio I/O 213 preferably includes an audio digitizer or an audio synthesizer respectively for an encoder or decoder, both are typically provided on conventional audio expansion cards. Other hardware elements operate in a substantially conventional manner. FIG. 3 further illustrates how encoder 110 is preferably comprised wholly of software elements, among such host processing system elements as operating system 301. More specifically, encoder 110 preferably comprises transient detector 112 (FIG. 1), sinusoidal encoder 113, low frequency noise encoder 314, transient encoder 115, high frequency noise encoder 316, compressed domain modifier 116 and stream formatter 117. Finally, FIG. 4 illustrates how decoder 150 preferably comprises software elements including demultiplexer 132, sine processor 133, noise processor 134 and transient processor 135.

It will be apparent to those skilled in the art that several variations of system 200 are contemplated and within the intended scope of the present invention. For example, any number of software elements, such as compressed domain modifier 307 might be implemented in hardware or a combination of hardware and software according to the performance and/or operational needs of a particular application. Such hardware or hardware and software can further be independently operable or integrated within system 200. Similarly, given processor and computer performance improvements and ongoing technological advancements, hardware elements such as such as portions of communications interface 209 might also be replaced by software and/or a combination of hardware and software. Another example is that multiple CPUs and/or digital signal processors ("DSPs") might be utilized for more robust performance. A still further example is that various operating systems and data processing systems can be utilized. However, at least a conventional multitasking operating system such as Windows NT running on an IBM compatible computer, are preferred and will be presumed for the discussion herein. Software elements are preferably implemented using C++, however, numerous other implementations can also be used.

FIGS. 5 through 30 illustrate, in increasing detail, the preferred encoder 110 of FIG. 1, first as a system and then with regard to individual elements. The preferred decoder 130 of FIG. 1 will then be separately discussed in a similar fashion.

Figure 5A:
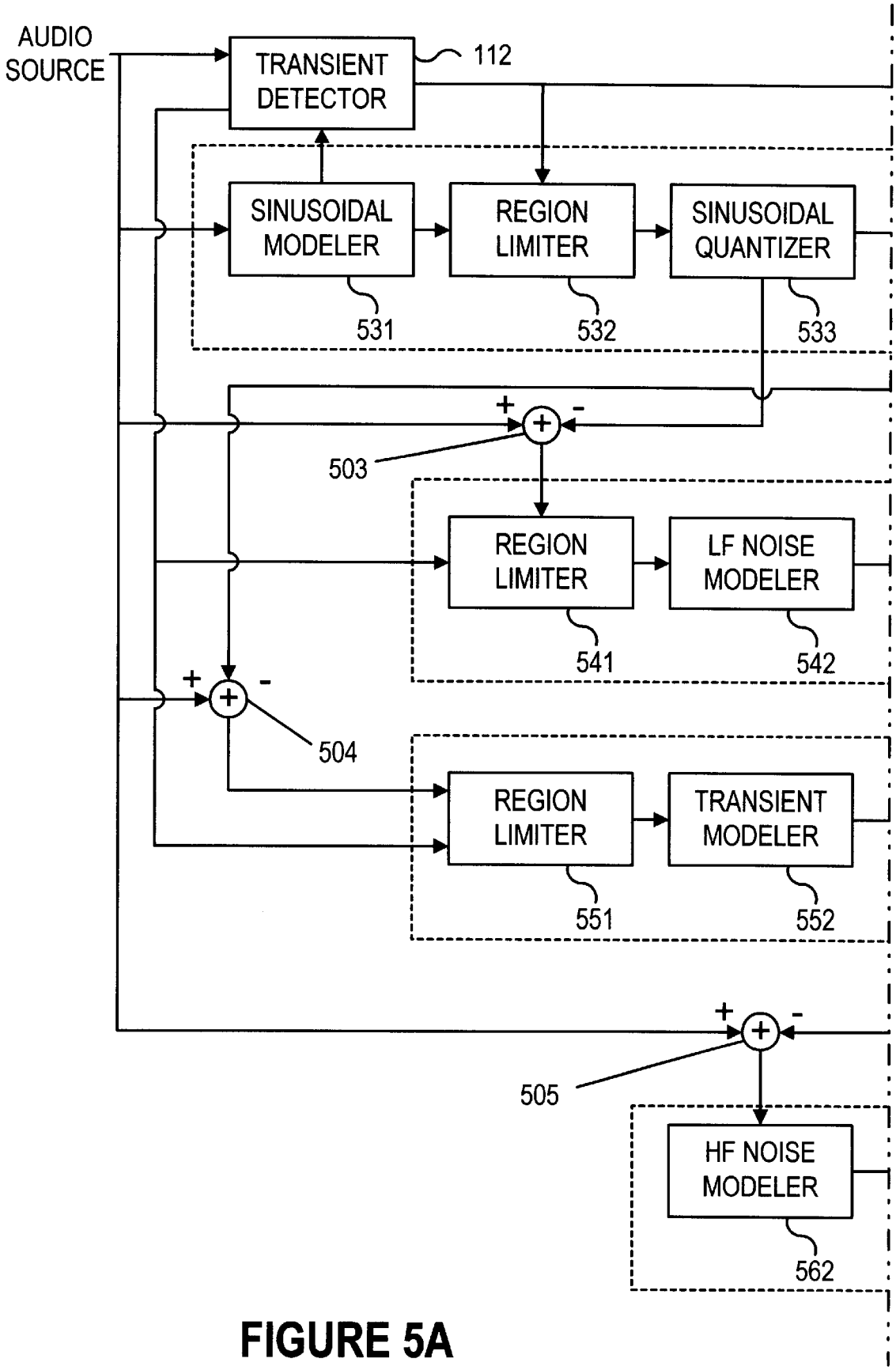
FIG. 5 is a flow diagram illustrating in greater detail the elements and operation of the preferred encoder of FIG. 2.
Figures 5, 5B:
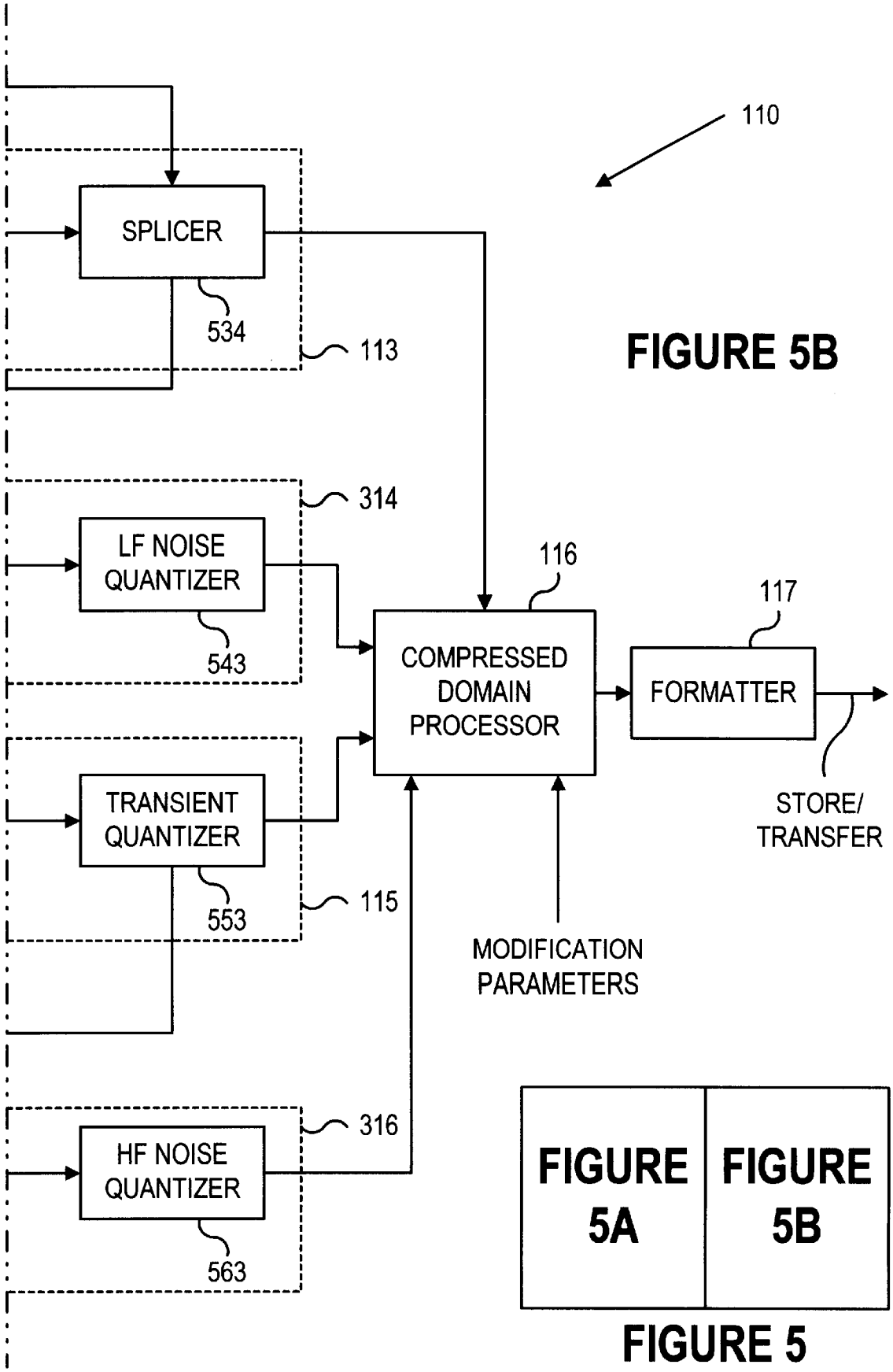

Turning to FIG. 5, encoder 110 preferably provides for composite encoding of source audio through the use of transient detection, limiting, summation operations, quantization and splicing, among other aspects. Encoder 110 comprises transient detector 112, encoders 113–116, compressed domain modifier 116 and formatter 117, as discussed above. Encoders 113–116 preferably further comprise the following communicatingly coupled elements. Sinusoidal encoder 113 comprises sinusoidal modeler 531, region limiter 532, sinusoidal quantizer 533 and splicer 534, low frequency noise encoder 314 comprises region limiter 541 low frequency noise modeler 542 and low frequency noise quantizer 543, transient encoder 115 comprises region limiter 551, transient modeler 551 and transient quantizer 552, and high frequency noise encoder 316 comprises high frequency noise modeler 561 and high frequency quantizer 562.

Broadly stated, encoder 110 preferably automatically assigns specific techniques to encode portions of source audio according to audio events and frequency ranges within such audio events. Encoding techniques are also assigned for selected audio remaining after quantization. More specifically, non-transients up to and including a low-frequency cutoff are sinusoid-modeled, non-transients between the low frequency cutoff and a maximum frequency are noise modeled, transients are transform coded and the residual (after quantization) is further noise modeled. A low frequency cutoff of 5 kHz and a maximum frequency of 16 kHz are further preferred as providing an optimal audio-fidelity-to-bit-rate compromise with all encoding methods.

While the parameters utilized are based on extensive listening tests conducted over a broad sampling of monophonic and polyphonic audio sources, further optimization might yet be considered necessary. It should be kept in mind that audio characteristics are somewhat subjectively perceived. In addition, some variation might be required according to a particular audio source or audio source type, among other considerations. In such cases, further control will likely be required. For ease-of-use reasons, it is preferred that any modification to the parameters set forth above or in the discussion that follows be conducted automatically. For example, condition sensing can be used to identify an audio type and/or characteristics. However, user alterable and/or selectable parameters might be preferable in certain applications and/or among selected users. Both methods are implementable using conventional programming methods and/or hardware implementations.

Operationally, a typically continuous audio source (i.e. digitized audio data stream) is preferably received by transient detector 112, sinusoidal modeler 531 and each of summers 503 through 505. Transient detector 112, in conjunction with sinusoidal modeler 531, identifies occurrences of higher energy audio peak or transients within the audio source and stores transient parameters corresponding to a "transient region" surrounding each such occurrence. The transient parameters are then used by each of encoders 113–116 to determine which regions of the audio source, if any, to encode. While the full length of the audio source is sinusoidally modeled for transient detection purposes, all but the first and last frames of sinusoidally modeled transient regions are discarded by region limiter 532. Region limiter 532 further discards all non-transient regions of the sinusoidally encoded audio data between 5 kHz and 16 kHz. The sinusoidally encoded audio data remaining after limiting is then quantized by sinusoidal quantizer 533 and then spliced by splicer 534. As will be further discussed, splicing is necessitated primarily by the integration of transform coding with sinusoidal encoding, and according to preferred quantization techniques. Sinusoidal quantizer 533 output is also transferred to summer 505, and splicer output is transferred to summer 504 and compressed domain modifier 116.

Summer 503, as with remaining summers 504 and 505, preferably subtracts previously encoded audio data from the audio source and transfers the remaining source audio data to the next encoder. In the case of sinusoidal encoder 113, summer 503 subtracts data from sinusoidal quantizer 533 from the audio source and transfers the remainder to low frequency noise modeler 542 of low frequency noise encoder 314.

Low frequency ("LF") noise encoder 314 preferably encodes only residual low frequency non-transient data resulting from sinusoidal quantization. This is most easily seen by following the signal paths to LF-noise encoder 314. As shown, region limiter 541 receives, from summer 503, the remainder from subtracting the sinusoidally encoded (and quantized) low frequency portion of the audio source from the audio source. Such remainder includes low frequency audio source data that was sinusoidally modeled and then removed through quantization, as well as high frequency non-transients and transients generally. Region limiter 541 further uses transient parameters (received from transient detector 112) to disregard portions of the remainder occurring in transient regions, thus leaving low frequency residual and high frequency non-transients. Finally, LF-noise modeler 542 selects and models only the low frequency data range, or low frequency residual, as will be discussed. The noise-modeled data is then quantized by low noise quantizer 543, and then transferred to compressed domain modifier 116.

Transient encoder 115 preferably encodes only transient data. Data comprising the difference between an audio source and the output of splicer 534 is received by region limiter 551. Region limiter 551 uses transient parameters to isolate and encode the transient regions of received source audio data, and transfers the result to transient modeler 552. Transient modeler models the received data and then transfers the modeled data to transient quantizer 553. Transient quantizer 553 quantizes the audio data received from transient modeler 552 and transfers the result to compressed domain modifier 116 and summer 505.

Summer 505 subtracts, from the audio source, the quantized transient data and transfers the difference to high frequency noise modeler 561.

High frequency ("HF") noise modeler 562 preferably noise-models the components of this difference that are between 5 and 16 kHz, and transfers the result to HF-noise quantizer 563. HF-noise quantizer 563 quantizes this result and transfers the quantized HF-noise encoded audio data to compressed domain modifier 116. Tracing signal paths to and from summer 505 (as with summer 504) it can be seen that, high frequency noise is used as a complete encoding method for high frequency non-transient regions and transient region residual. Note that this is in sharp contrast with the use of low frequency noise for modeling only non-transient region residual audio.

Finally, compressed domain modifier 116 and formatter 117 operate respectively to perform compressed domain audio processing and data stream formatting as discussed above.

Figure 6:
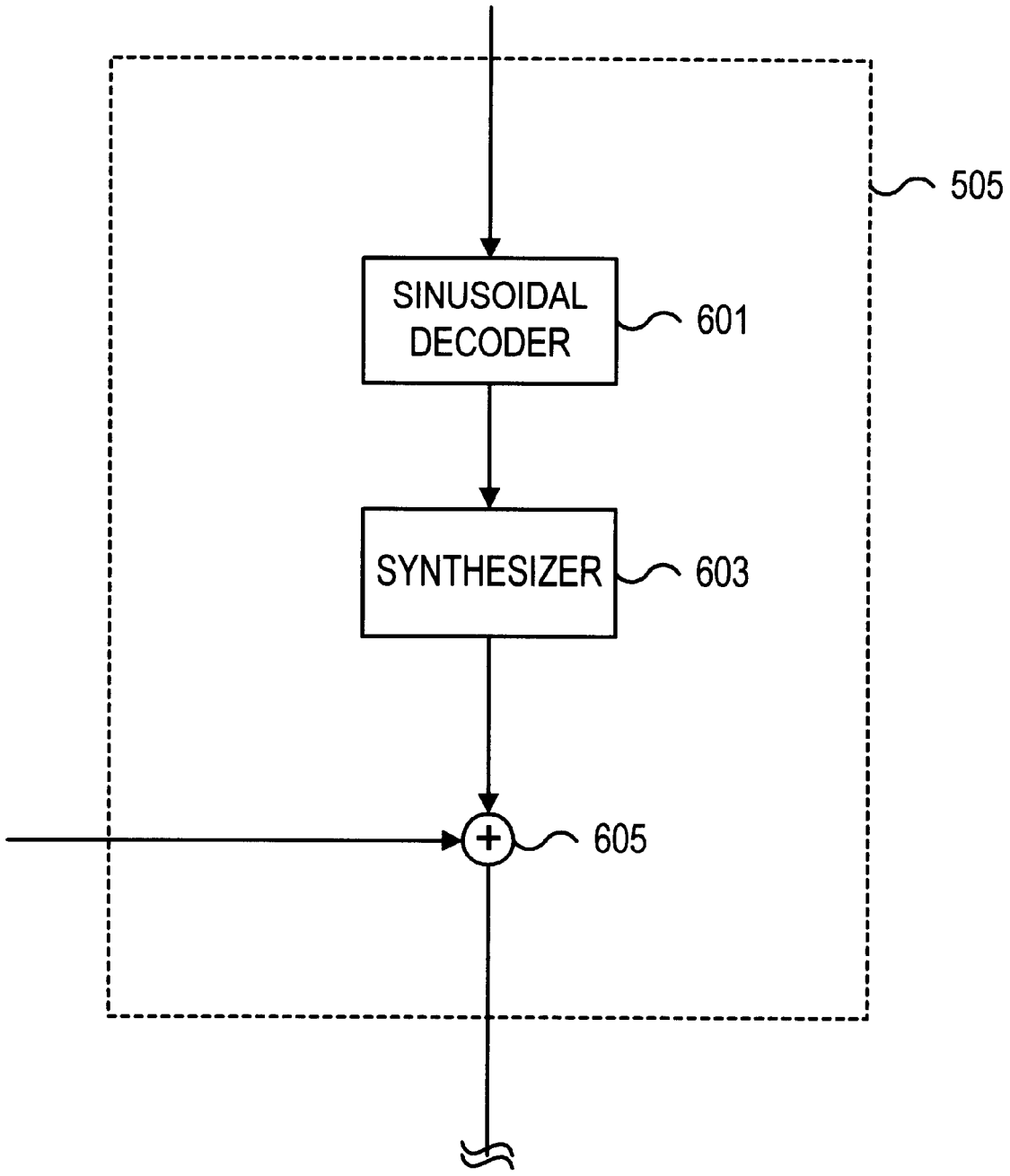
FIG. 6 is a flow diagram illustrating how encoded audio data is preferably summed with not-encoded audio data, according to the invention.

The FIG. 6 block diagram illustrates how, in order to arithmetically combine audio signals, the signals must be in a similar form. Those skilled in the art will appreciate that typically, such a common form will be that of synthesized audio data. Therefore, unless corresponding audio data has already been converted to synthesized audio data or unless indicated otherwise, a summer will include a corresponding decoder and synthesizer in addition to the summer. For example, summer 505 of FIG. 5 includes sinusoidal decoder 601, synthesizer 603 and summer 605.

Transient Detector

Figure 7:
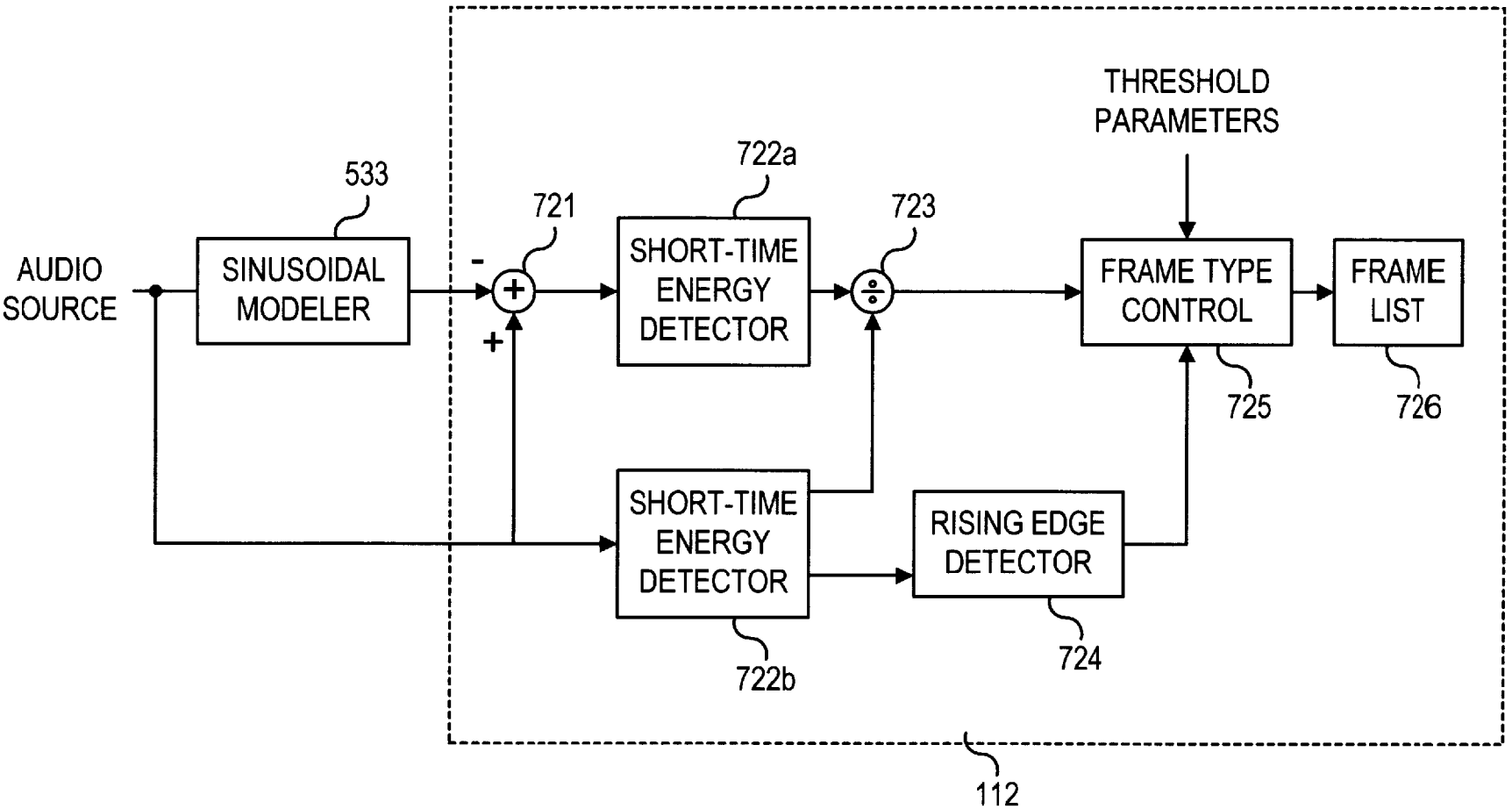
FIG. 7 is a flow diagram illustrating a preferred transient detector according to the invention.
Figure 8:
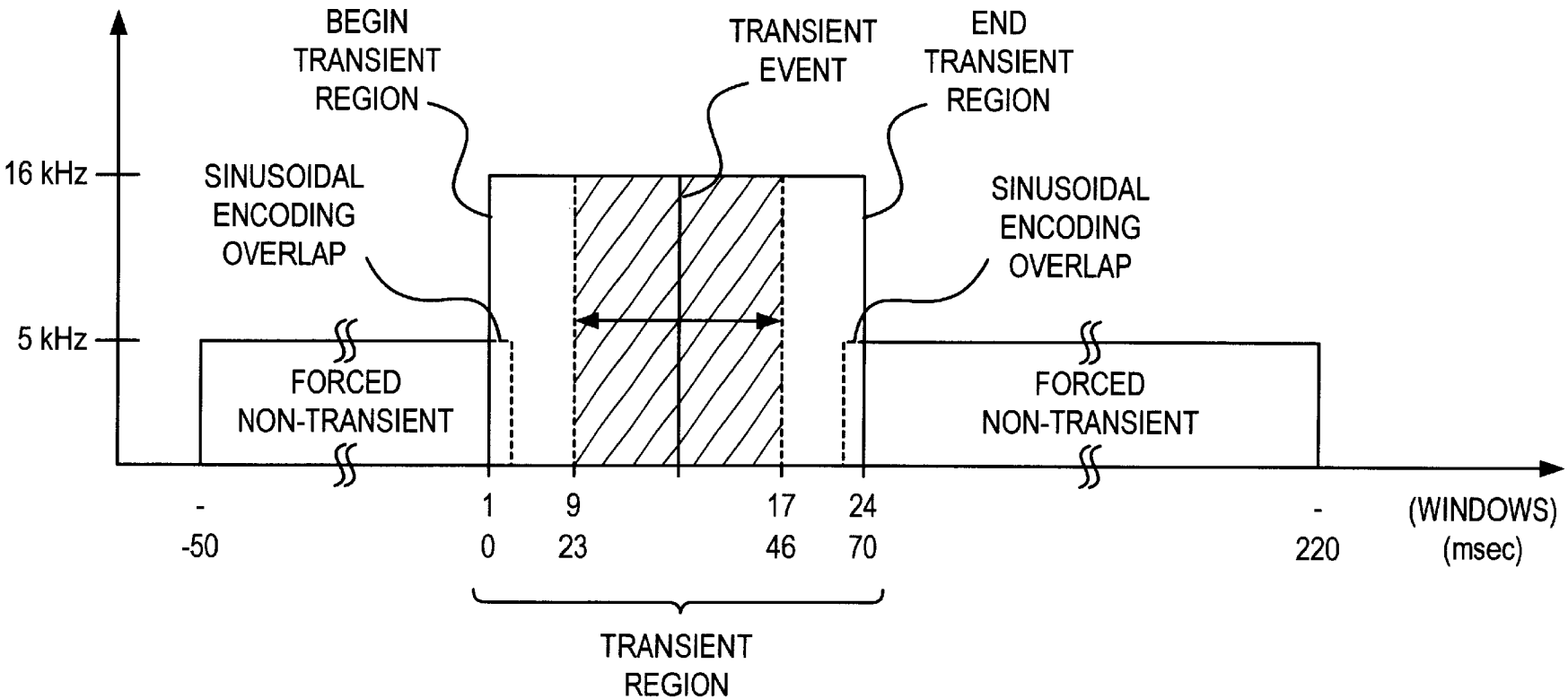
FIG. 8 illustrates a preferred transient region according to the invention.
Figure 9:
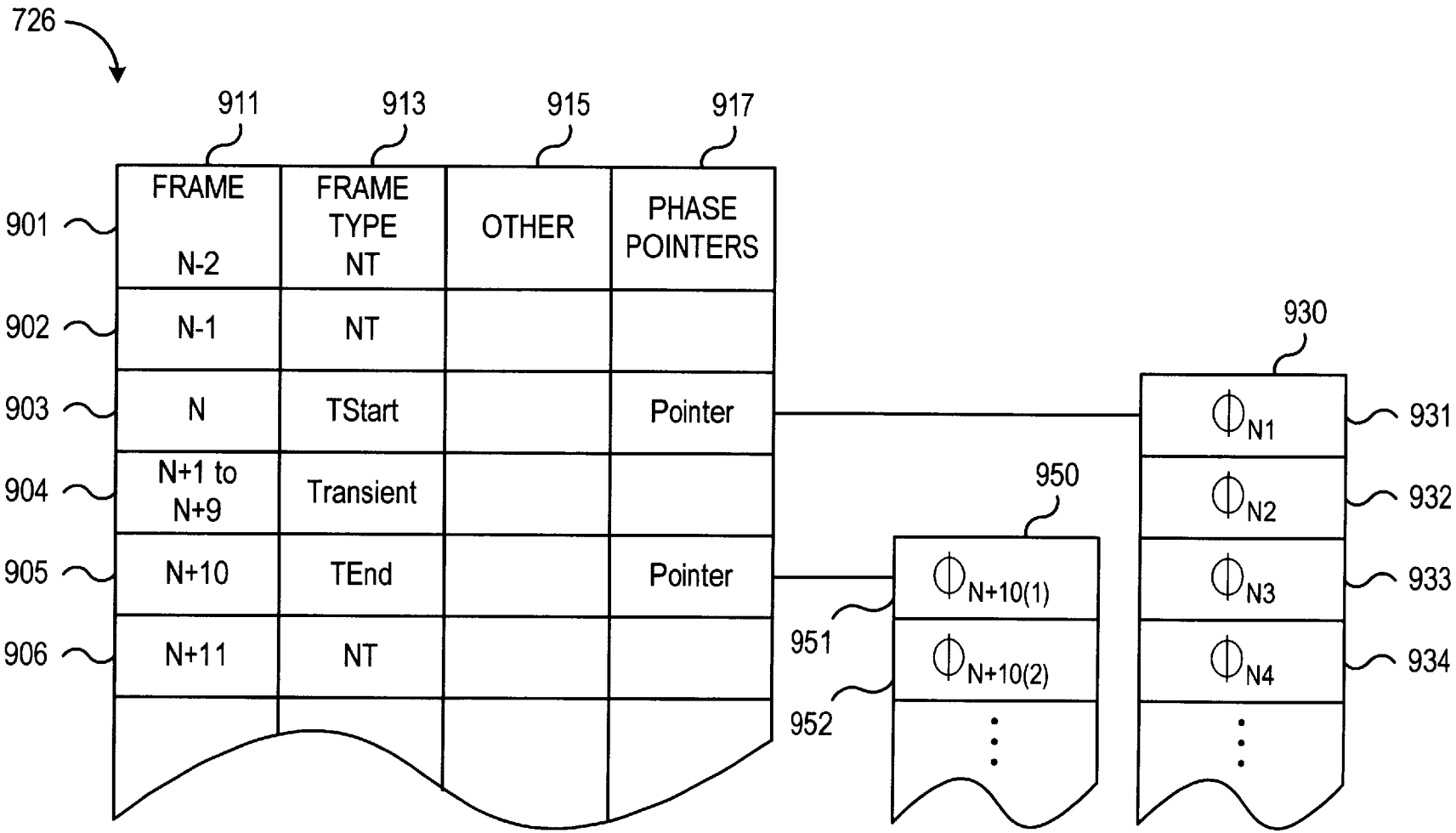
FIG. 9 illustrates the preferred elements of a frame type list according to the invention.

FIGS. 7 through 9 illustrate, in more detail, the preferred transient detector 112 of FIG. 5. The FIG. 7 flow diagram depicts the apparatus and operation of transient detector 112, while FIG. 8 shows a resulting transient-region and FIG. 9 shows a frame-type list for storing transient-parameters as determined by transient detector 112.

Experimentation and listening tests have shown that transients are not only particularly important to perceived fidelity generally, but also with respect to processed audio. Therefore, integration of a particularly high fidelity encoding method, such as transform coding, novel audio processing methods and other aspects are preferably used to assure the integrity of the transient portions of an audio source. However, a balance must be reached whereby the perceived fidelity of an audio source remains intact, but also whereby the ordinarily prohibitive bit rate of high fidelity encoding will remain manageable. If too many parts of an audio source are encoded as transients, then the bit rate will become in fact become prohibitive. If conversely, too few transients are tagged, then attacks will sound dull. Maintaining this balance is also especially important in polyphonic music, where the number of actual transient occurrences may be higher than the number of transients perceptively requiring high fidelity encoding. In such cases, an appropriate lower bit rate encoding method can be used for the less perceptively important transients.

Thus, preferably a four-part method is used for selecting transients. This method has been found to accurately separate transients requiring particularly high fidelity from those that can be well-represented by lower bit-rate encoding, such as sinusoid or sinusoid plus noise modeling. Broadly stated, the first part utilizes a conventional rising edge energy determination wherein brief high energy regions of the source audio are flagged. As noted however, it is discovered that not all "transient candidates" need to be encoded as transients in order to achieve high fidelity. Thus, the second part determines whether a high energy region or transient candidate can be sufficiently well represented by a lower bit rate encoding method. After a lower bit rate method (e.g. sinusoidal modeling) is used to model the audio source, the residual audio is searched for high energy regions. The existence of a sufficiently high energy region indicates that a transient has not been well represented and a higher fidelity encoding is required. While this second part has proven reliable and might be used alone, the most accurate results have been achieved by using both parts together. That is, in a third part of the test, a determination is made whether both tests have been satisfied and, if so, a transient is considered to have been detected and a transient regions is set. In a final part, bit rate is assured by defining a region around a selected transient region as a non-transient region.

Turning now to FIG. 7 with reference to FIGS. 5 and 6, transient detector 112 comprises communicatingly coupled elements including energy-summer 721, short time energy detectors 722*a* and 722*b*, divider 723, , rising edge detector 724, frame type control 725 and frame list 726. As discussed, a typically continuous audio source is received by both sinusoidal modeler 533 (FIG. 5) and transient detector 112.

According to the first part given above, within transient detector 112, the audio source is received by short-time energy detector 722*b*, which detects and isolates energy peaks. Preferably, short-time energy detector 722*b* conducts an energy estimate over 512 point (e.g. at 44,1 kHz) Hamming windows with an overlap of 50 percent. Rising edge detector 724 (i.e. a conventional predictor) then compares a present frame's energy estimate versus a weighted sum of previous frame energies. Finally, frame type control 724 determines whether the current frame energy is much larger than a past frame average. Preferably, a threshold energy level of 6 dB is utilized. In conventional systems, such a relative high frame energy is considered a transient. However, as discussed, relative high frame energy does not reliably indicate whether special encoding is required. Therefore, according to the present invention, relative high frame energy preferably merely indicates a "transient candidate" which may or may not be specially encoded according to further criteria.

According to the second part given above, summer 721 subtracts, from the received audio source, the sinusoidally modeled (and decoded and then synthesized—see FIG. 6) audio source. The difference (i.e. the residual after sinusoidal encoding) is then transferred to short-time energy detector 722*a*. Energy detector 722*a* then performs an energy estimate which is transferred to divider 723*b*, as with energy detector 722*b*. Divider 723 then calculates a ratio between the audio source energy and residual audio energy given by the following equation $$ratio(l) = \frac{residualEnergy}{sourceEnergy} = \frac{\sum_{n=lM}^{l(M+1)-1} \omega(n)[y(n) - x(n)]^2}{\sum_{n=lM}^{l(M+1)-1} \omega(n)x^2(n)}$$

wherein M is the frame-overlap or "hop" size, x(n) is the audio source energy and y(n) is the energy of the synthesized residual. When frame type control 724 determines that the above ratio is near zero, then sinusoidal modeling was a reasonable representation of the original signal in a current frame. Therefore, the current frame is not likely to contain an attack transient and high bit rate encoding is not necessary. Conversely, when the ratio is near one (or greater, where pre-echo exists), then the frame is a candidate for containing a transient. Preferably, a ratio threshold of 0.34 is utilized (i.e. ratios greater than or equal to this ratio are considered transient candidates). Finally, if, for a current frame, both a rising edge is detected in the audio source short-time energy and the ratio of source to encoded-source energies is high, then frame type control 724 flags the current frame as including a transient.

Continuing with FIG. 8, frame type control 725 also preferably determines transient regions and non-transient regions surrounding a flagged transient. First, transient regions are needed due to the well-known envelopes of transients. Transients are not instantaneous, but rather begin prior to and end after an energy peak. For example, while a snare drum has a relatively fast attack, a brass, string or woodwind instrument transient will often reach and resolve from a transient peak more slowly. In addition, the "characteristic sound" of pre and post transient-peak is often an important perceptual aid in identifying an instrument and/or group of instruments. A cymbal, gong and piano strike, for example, include important identifying initial noise and frequency variation following a transient peak. While still later "release" or "decay" characteristics are more tonal and less radically varying, and can therefore be well represented by lower bit-rate encoding, a high bit-rate encoding region (i.e. transient region) is often required.

Listening tests and experimentation have revealed that a transient region including 24 windows long (e.g. short MDCT windows for transform coding) sufficiently accommodate all sources tested (i.e. using the preferred composite encoding system). This translates to a transient region of approximately 70 msec. In addition, the 24 windows utilized are segmented into 3 sets of 8 windows or windows 1–8, 9–16 and 17–24. Such segmentation provides for quantization as will be discussed. The transient event is also placed within the middle segment (windows 9–16) to assure sufficient buffering for the audio effects discussed above. Note however, that other organizations can also be used depending upon the particular application. In such cases, automatic and/or user modification can also be provided in a conventional manner as discussed earlier.

As discussed, frame type control 725 (FIG. 7) also determines non-transient regions surrounding the transient region. More specifically, in order to better accommodate high bit rate encoding, the number of transients is preferably limited to five transients per second. This number can be assured using one or both of the following ways. First, it is observed through listening tests that very frequently a number of spurious transients will be detected before and after a transient requiring high bit rate encoding. This is particularly true for polyphonic music, in which instruments might begin playing at various points while a portion of the rest of the ensemble is also playing. It turns out that perceptual high fidelity does not require high bit rate encoding of (attack portions) of such instruments. Therefore, frame-type control preferably summarily forms a non-transient region before and after the transient region. Non-transient region sizes found to accommodate all audio sources tested include a pre-transient non-transient region of approximately 50 msec and a post-transient non-transient region of 150 msec, as illustrated in the FIG. 8 graph.

A second method for limiting the frequency of encoded transient occurrences is to modify threshold parameters (e.g. iteratively) such that fewer high energy occurrences are accepted as transient candidates and/or transients. Once again, specific application considerations will determine whether one or both transient-limiting methods are employed and whether such methods are employed automatically and/or with user input. Preferably, the less complex first (i.e. "automatic non-transient window") method is utilized and then, only if necessary to assure a target bit rate, the second (i.e. "transient threshold varying") method is automatically invoked.

Continuing now with FIG. 9, an exemplary frame list (i.e. 726 of FIG. 7) illustrates preferred transient parameters which will be used by encoder 110 to determine whether a frame is to be handled as a part of a non-transient or transient region. For clarity sake, a frame-by-frame simple list is depicted. However, any number of conventional data management structures and/or techniques might be utilized, so long as the necessary transient parameters are represented. For example, an alternative implementation might include only those frames during which a change of transient or non-transient frame-status might be included.

As shown, frame list 726 stores frame number 911, frame type 913, other transient parameters 915 and phase pointers 917. More specifically, frame number 911 and at least frame type 913 identify whether a given frame will be encoded as a non-transient or a transient, thereby determining a corresponding encoding method as discussed earlier. As shown, a transient region extends from frame-N 903 to frame N+10. As indicated by respective ones of frame type 913, frame-N 903 is a transient start frame type and frame N+10 is a transient end frame type. Therefore, frames N through N+10 (i.e. inclusive) will be modeled using high bit rate modeling (e.g. transform coding). Further, frames N−2 901, N−1 902 and N+11 906 are non-transients and will therefore be modeled using lower bit-rate modeling (e.g. sinusoid and noise modeling). The remaining "other" transient parameters 917 are included to indicate that other frame based information, such as time codes might also be required for video and/or film synchronization. Finally, phase pointers 917 point to respective phase lists, of which phase lists 930 and 950 are examples. As will be further discussed, a method preferably used to reduce bit rate is to remove sinusoidal parameters generated during sinusoidal encoding which, through the teachings of the invention, can be made non-essential. However, phase parameters for each sinusoid of each transient start frame (e.g. frame-N 903) and each transient end frame (e.g. frame-N+10 905) are preferably retained for use during sinusoidal quantization and splicing.

Sinusoidal Encoding

Having discussed transient detector 112, we now turn to a discussion of each of the encoders utilized in preferred composite encoder 110. FIGS. 10 through 20 with reference to FIG. 5 will focus on further details of sinusoidal encoder 113 elements. Thereafter, the focus will shift to LF noise encoder 314, transient encoder 115 and then HF noise encoder 316.

Figure 10:
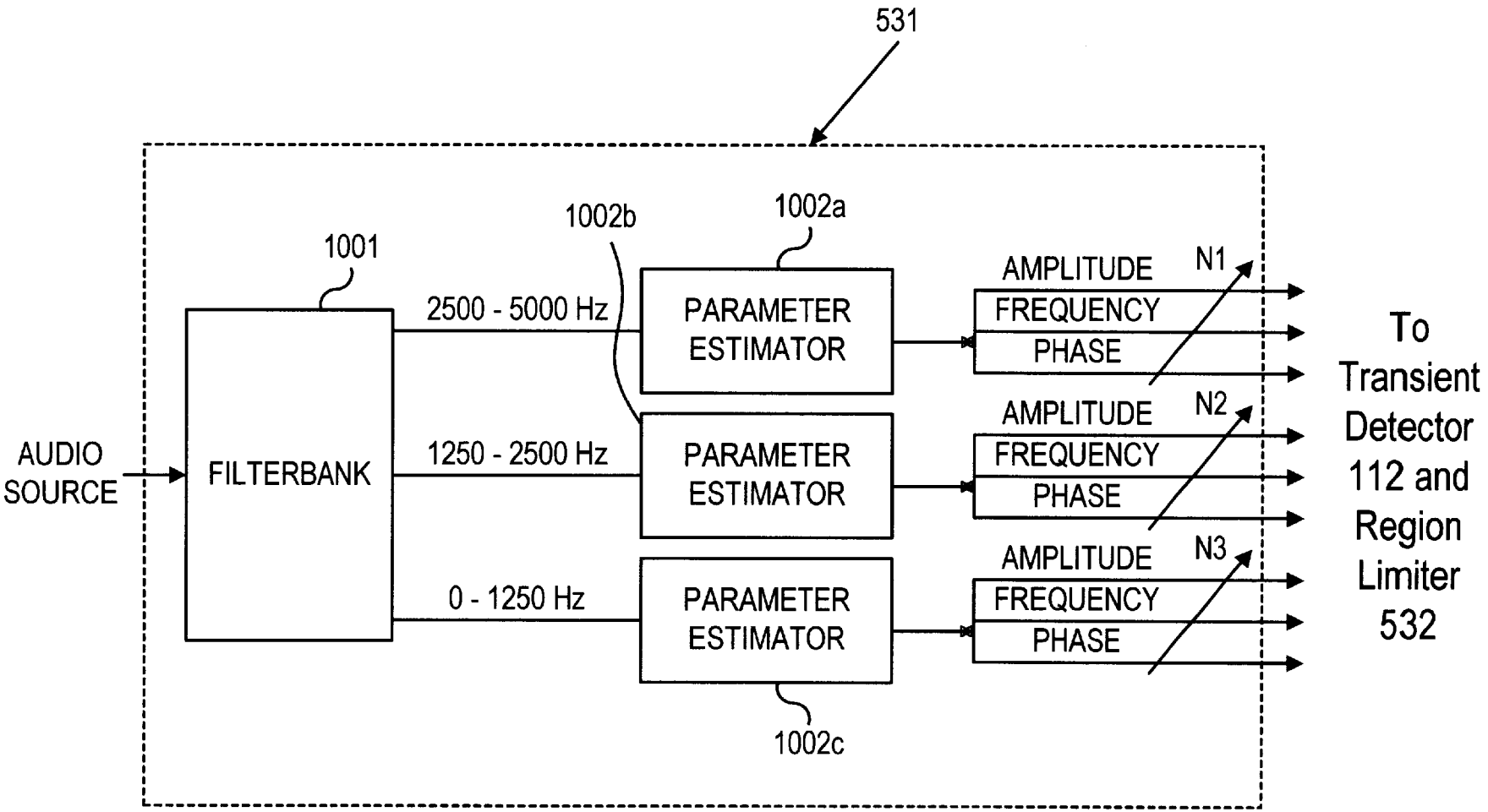
FIG. 10 is a functional block diagram illustrating the elements and connections of a preferred sinusoidal modeler according to the invention.

The FIG. 10 simplified flow diagram illustrates a generic example of a sinusoidal modeler 531 (FIG. 5) and the data generated by the modeler when an audio source is supplied. As shown, sinusoidal modeler 531 broadly comprises communicatingly coupled elements including filterbank 1001 and parameter estimaters 1002*a–c*. Operationally, an audio source received by filterbank 1001 separated into frequency bands which are then analyzed by parameter estimators 1002*a–c*. (Note that the complete frequency range of all parameter estimaters is preferably from 0 to 5 kHz, thereby correspondingly limiting sinusoidal encoding to that range. As noted earlier, non-transient frequencies above 5 kHz will be noise modeled.) The results of parameter estimation are then output as frame-based sinusoidal parameter triads. A separate triad is produced for each sinusoid used to represent the audio contained in each frame of the audio source, as given by N1, N2 and N3, and each sinusoid includes a triad of amplitude, frequency and phase parameters. These sinusoidal parameter triads are then transferred to transient detector 112 and region limiter 532 as depicted.

As discussed in the above prior art section, sinusoidal modeling is well-known and many of the various existing and/or other potential implementations can be utilized. Preferably, a low complexity, high efficiency and low bit rate sinusoidal modeler is used in order to offset the high bit rate of transient modeler 552 (FIG. 5). One example of such a sinusoidal modeler, among many, is that suggested by Hamdy (1996). However, where bit-rate considerations are subordinate to considerations of high fidelity, multiresolution sinusoidal encoding (also discussed in the prior art section) can also be used.

Figure 11:
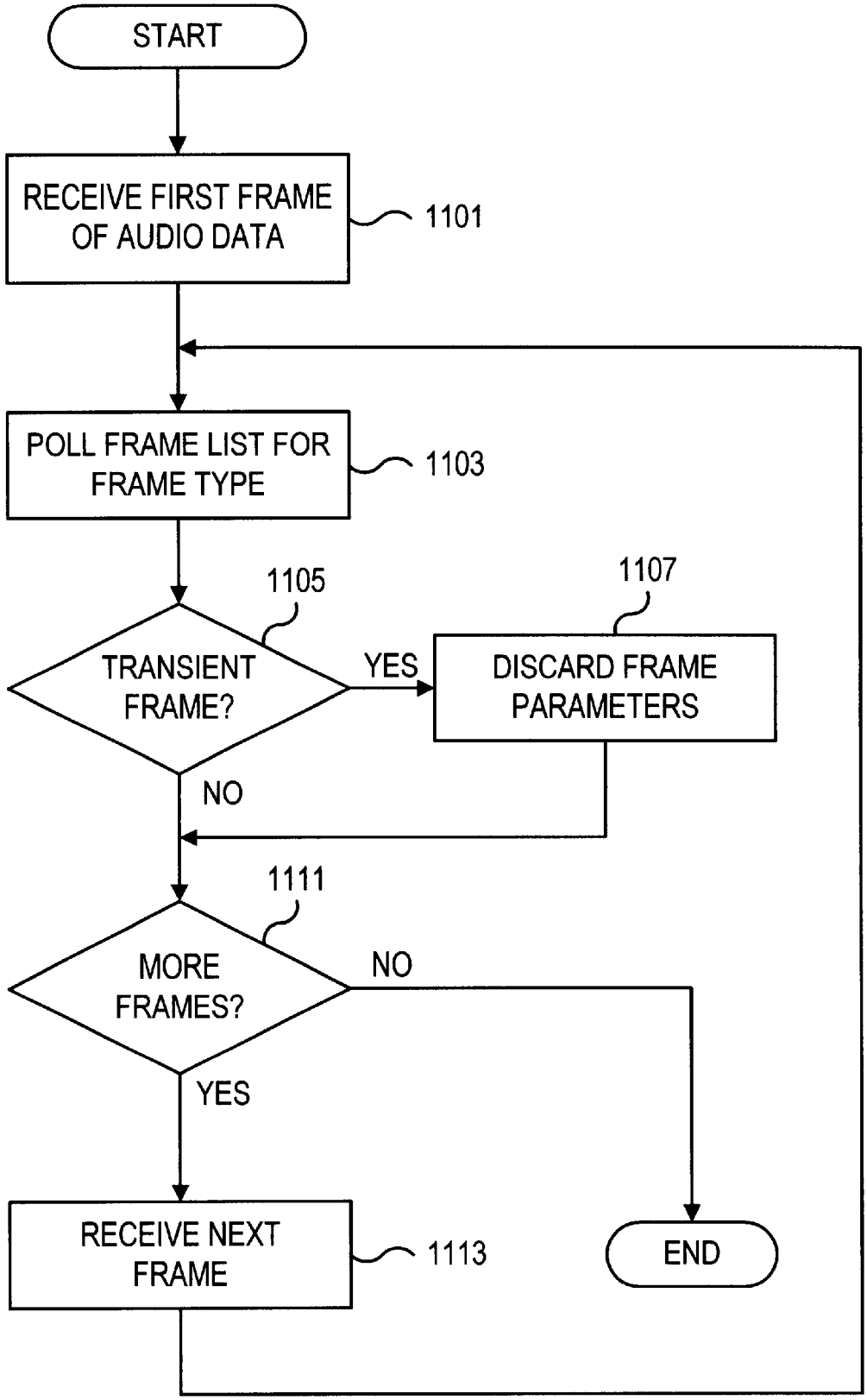
FIG. 11 is a flowchart illustrating how parameters stored in a frame list are preferably used by a sinusoidal modeling region limiter to limit sinusoidally encoded data to non-transients.

The FIG. 11 flowchart illustrates how, following sinusoidal modeling, region limiter 532 (FIG. 5) preferably uses transient parameters stored in frame list 726 to limit sinusoidally encoded data to only non-transient regions of the source audio. As shown, in step 1101, region limiter 532 receives a first frame of audio source data. Since the audio source has been sinusoidally modeled, the data will include frame-based sinusoidal parameter triads. Next, in step 1103, region limiter 532 polls frame list 726 for the frame type of the current frame (in this instance, the first frame). If, in step 1105, the frame type is a transient, then the sinusoidal parameters for the frame are discarded and operation proceeds to step 1111. Otherwise, operation proceeds directly to step 1111. If in step 1111, more frames remain, then region limiter 532 receives a next frame (i.e. now the current frame) in step 113 and operation proceeds to step 1103. Otherwise, limiting has been completed.

Figure 12:
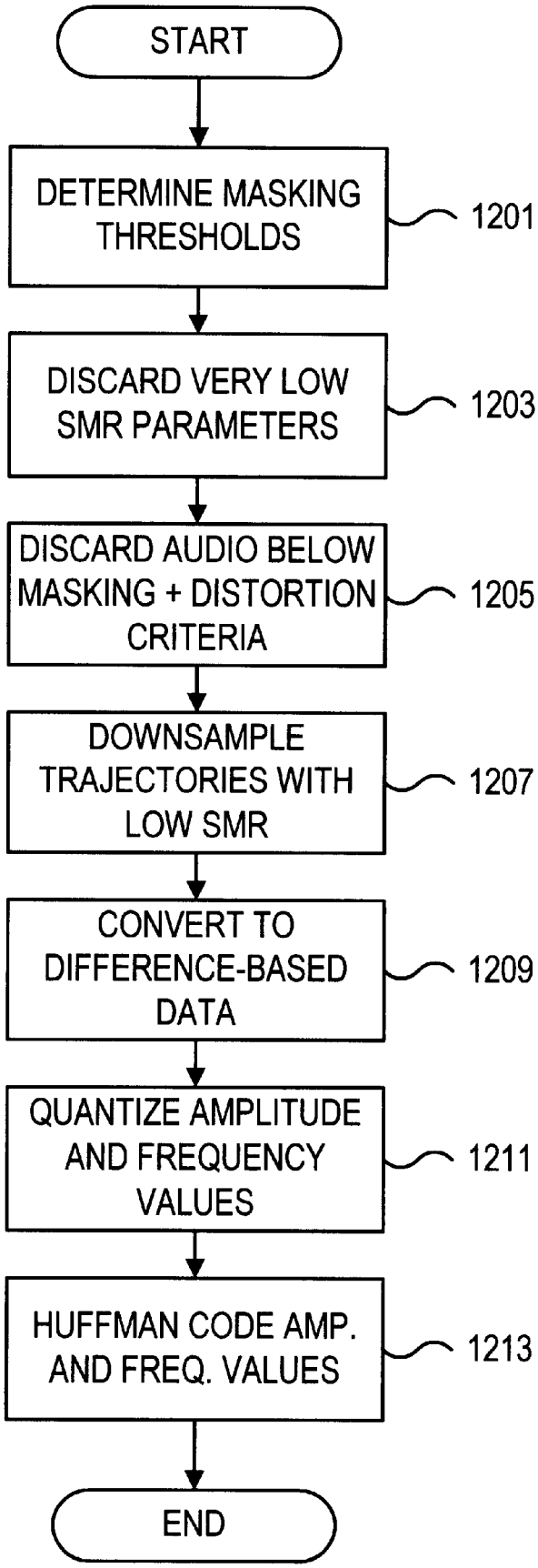
FIG. 12 is a flowchart illustrating a preferred sinusoidal quantization method according to the invention.

Having sinusoidally modeled the low frequency non-transient regions of the audio source, we now turn to sinusoidal quantization. First, FIG. 12 is provided as a brief overview of the steps preferably included in a sinusoidal quantization process. A preferred implementation is then presented in accordance with the composite encoder of FIG. 5.

As shown in the FIG. 12 flowchart, in step 1201, the masking thresholds for the sinusoidally modeled audio are determined. In step 1203, very low signal-to-mask ratio ("SMR") parameters are discarded. In step 1205, audio below masking plus duration criteria are discarded. In step 1207, trajectories with low SMR are discarded. In step 1209, the audio data is converted to a corresponding difference-based representation, in step 1211, the audio data amplitude and frequency are conventionally quantized, and in step 1213, the amplitude and frequency values are Huffman coded.

Figure 13A:
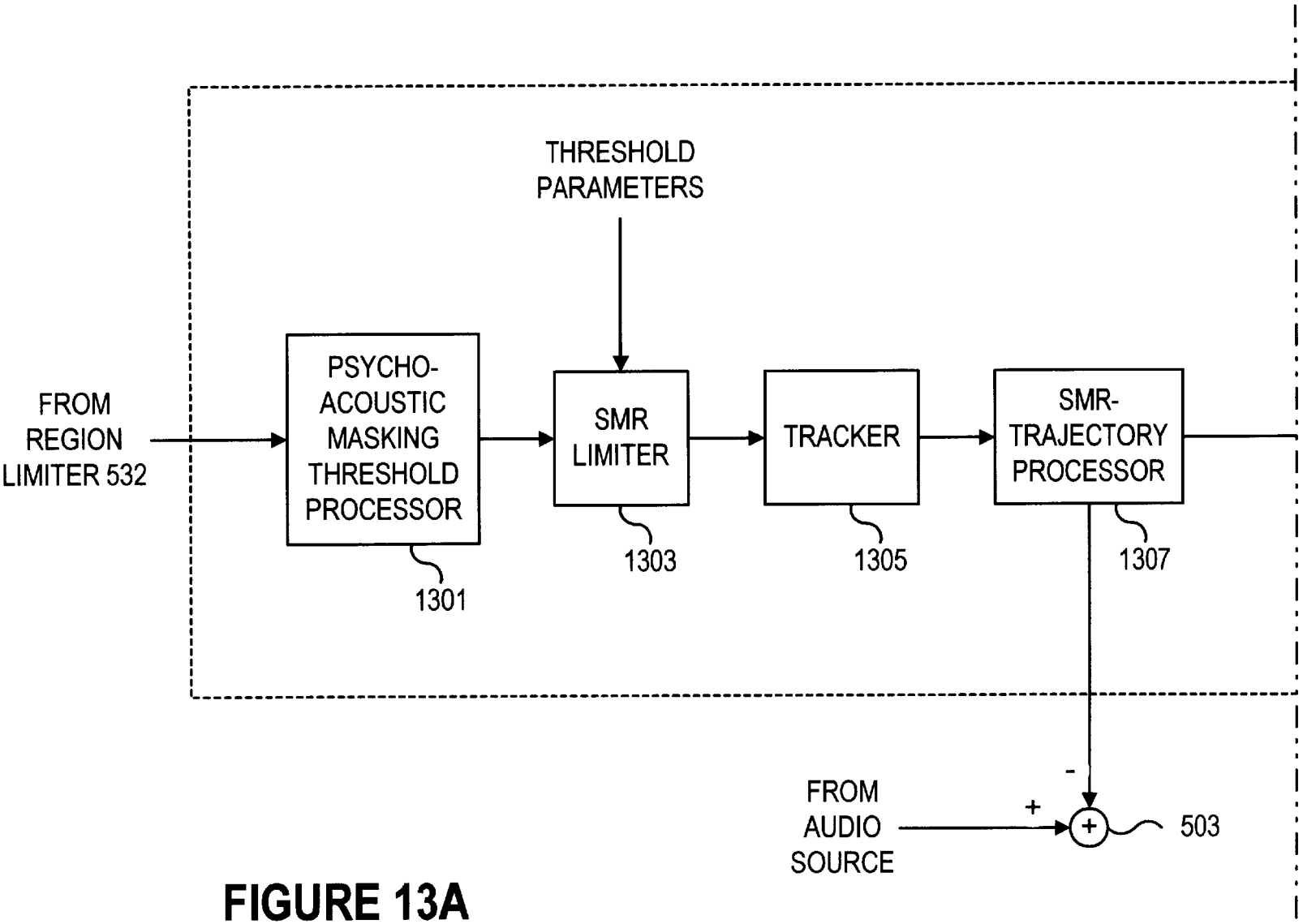
FIG. 13 is a functional diagram illustrating a preferred sinusoidal quantizer according to the invention.
Figures 13, 13B:
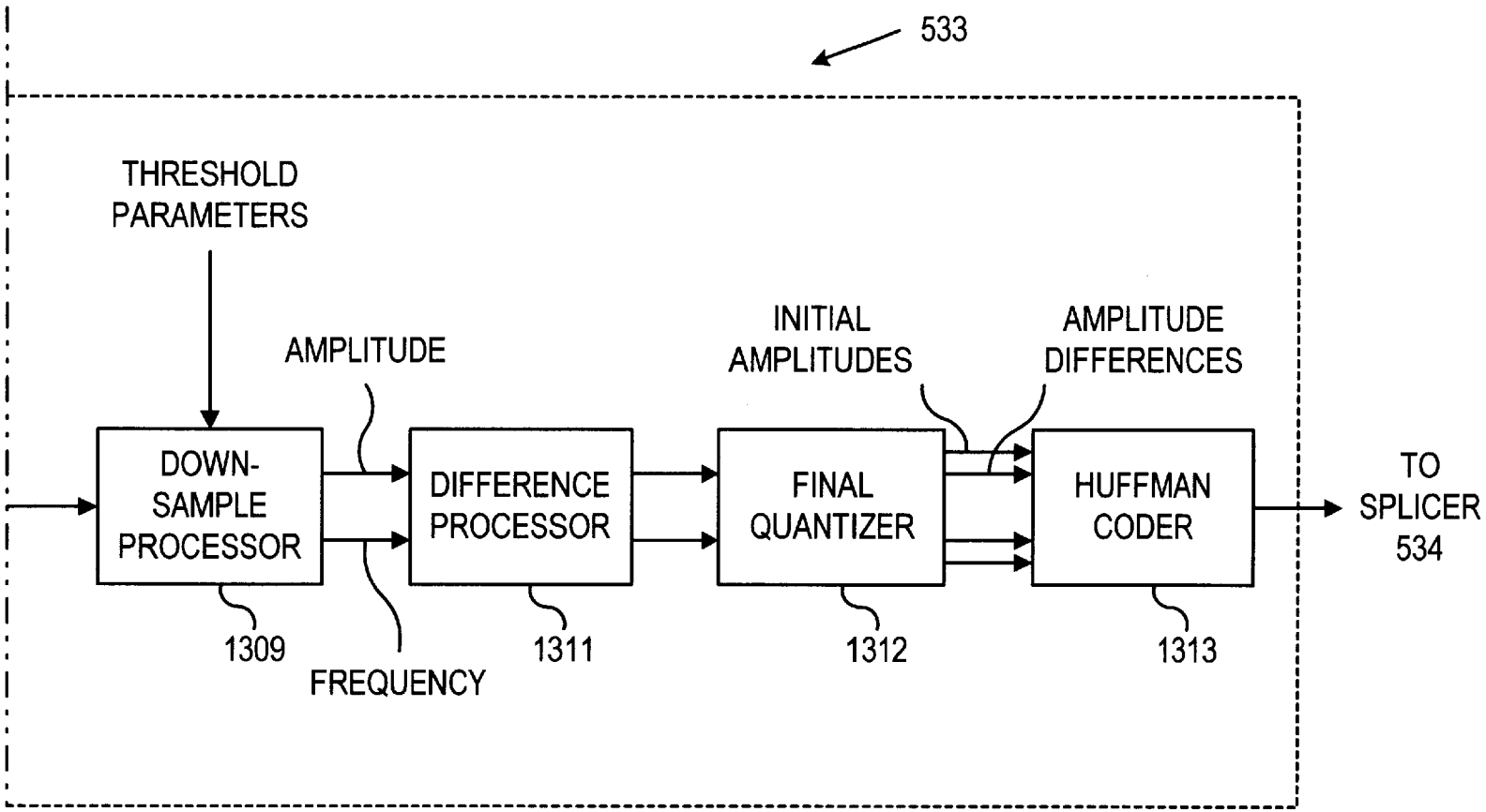

Turning now to the FIG. 13 flow diagram, sinusoidal quantizer 533 preferably comprises communicatingly coupled elements including psychoacoustic masking threshold processor 1201, SMR limiter 1203, trajectory-former ("tracker") 1205, SMR-trajectory processor 1207, downsample processor 1209, difference processor 1211, final quantizer 1212 and Huffman coder 1213. Operationally, upon receipt of audio data from limiter 532, a conventional psychoacoustic masking threshold processor 1201, SMR limiter and tracker are each utilized in a conventional manner. Masking threshold processor 1201 computes masking thresholds for the audio data, SMR limiter removes audio data that is significantly below computed masking thresholds (e.g. −3 dB), and tracker forms trajectories from the SMR-limited audio data.

Figure 14:
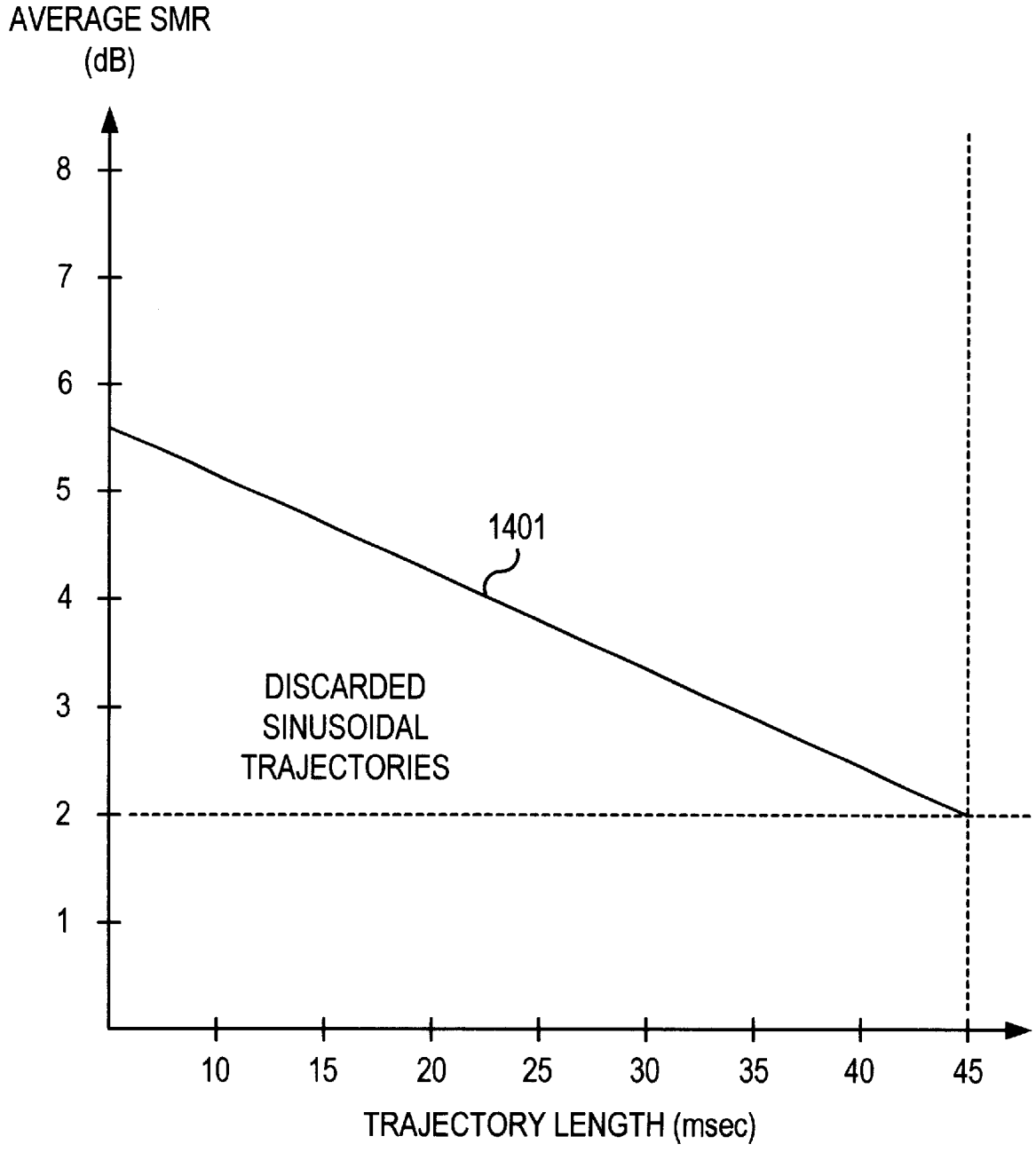
FIG. 14 is a graph illustrating exemplary average SMR to trajectory length relationships according to the invention.
Figure 15:
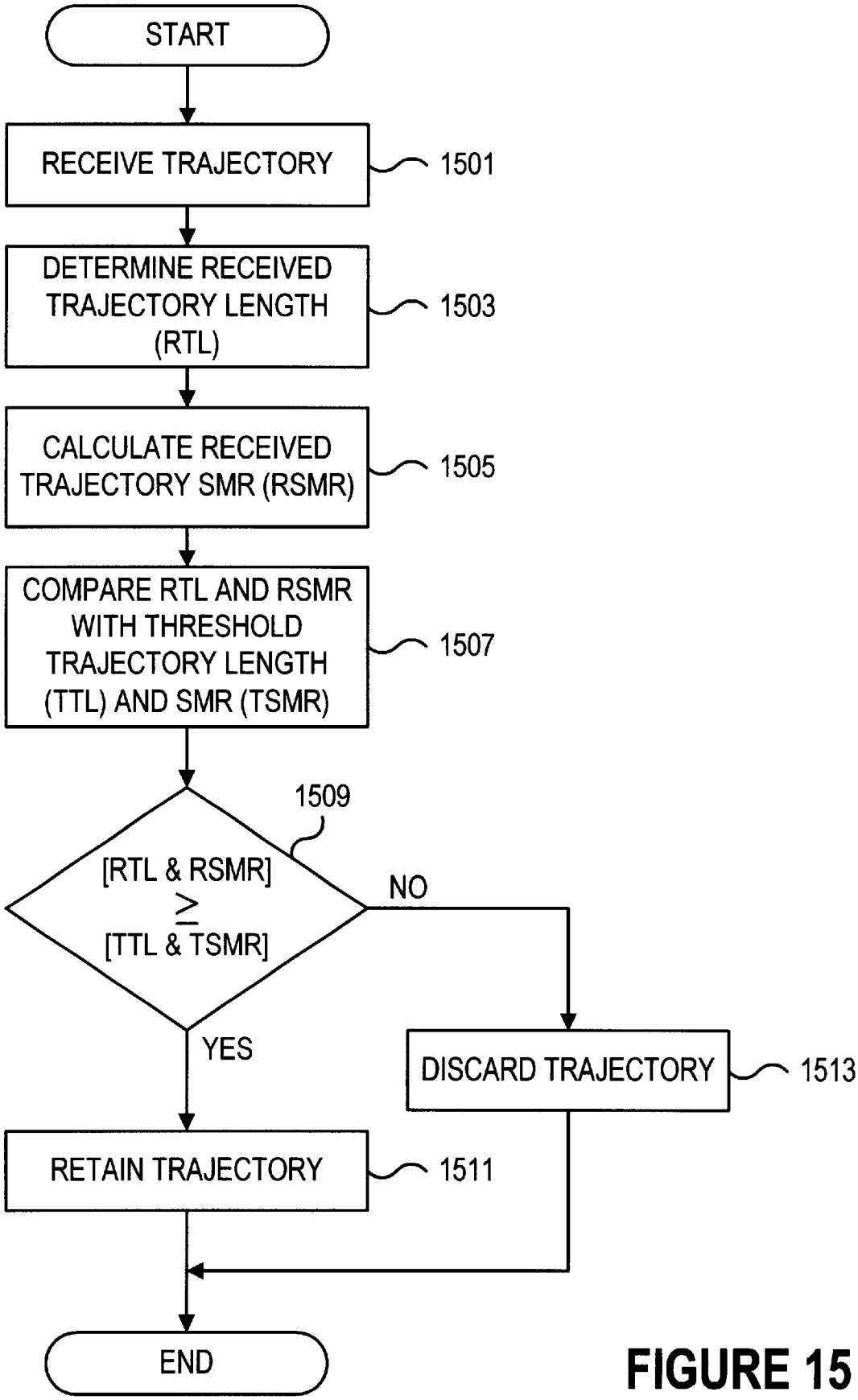
FIG. 15 is a flowchart illustrating a preferred SMR-trajectory quantization method according to the invention.

Continuing with FIG. 13, with reference to FIGS. 14 and 15, the trajectories formed by tracker 1205 are then transferred to SMR-trajectory processor 1207. SMR-trajectory processor 1207 operates in accordance with a discovery concerning the perceptual relationship between SMR and trajectory length. Listening tests have revealed that audio signals represented by increasing trajectory lengths require decreasing SMR thresholds in order to be perceptually important and visa versa. Stated alternatively, whether audio data can be discarded without adversely impacting audio fidelity can be determined according to an inversely proportional relationship between trajectory length and time-averaged SMR.

The FIG. 14 graph illustrates an example of this relationship according to audio sources tested. As shown, increasing average SMR is given along the y-axis and increasing trajectory length is depicted along the x-axis. Line 1401 indicates an exemplary SMR-trajectory length threshold such that audio data falling below line 1401 can be discarded, while all audio data at or above line 1401 should be preserved.

The FIG. 15 flowchart illustrates the preferred operation of SMR-trajectory processor 1207 with respect to a given trajectory. In step 1501, a trajectory is received. In step 1503, the length of the received trajectory is determined. In step 1505, a time-averaged SMR is calculated for the received trajectory. Next, in step 1507 the determined trajectory length and calculated SMR for the received trajectory are compared with a threshold length and SMR pair. If, in step 1509 the received trajectory length and SMR are greater than or equal to the threshold length and SMR, then, in step 1511, the received trajectory is retained. Otherwise, the received trajectory is discarded in step 1513. Retained trajectories are then transferred to downsample processor 1209 as indicated in FIG. 13.

The following table lists the preferred SMR-trajectory thresholds utilized with SMR-trajectory processor 1207. As discussed, the use of a traditional sinusoidal modeler is preferred as providing a low bit-rate, however, in applications where higher fidelity is considered more important than bit-rate, multiresolution sinusoidal modeling might be employed. Therefore, preferred thresholds for both are included in the chart. In the case of a traditional sinusoidal modeler, the threshold parameters reflect an audio source sampled at 44.1 kHz and modeled using a window size of approximately 20 msec and a hop size of approximately 10 msec. In the case of a multiresolution sinusoidal modeler, the threshold parameters reflect an audio source again sampled at 44.1 kHz, but with modeling using window sizes of approximately 13 msec (at 2500–5000 Hz), 26 msec (at 1250–2500 Hz) and 43 msec (at 0–1250 Hz), each with a hop size of 50 percent. Those skilled in the art will, however, appreciate that the use of other window numbers/sizes, frequency band and threshold parameter variations, among other permutations, might be required according to the application and/or specific audio sources, among other factors. Once again, as with other potential variables throughout the invention, providing automatic operation is preferred over requiring direct user modification.

| Frequency Bands | 5.9 msec | 11.5 msec | 17.25 msec | 23.0 msec | 28.75 msec | 34.5 msec | 40.25 msec | 46.0 msec |
|---|---|---|---|---|---|---|---|---|
| SMR-Trajectory Thresholds Using Traditional Sinusoidal Modeling | | | | | | | | |
| 0–5000 Hz | 6.75 dB | 6.0 dB | 5.25 dB | 4.5 dB | 3.75 dB | 3.0 dB | 2.25 dB | 1.5 dB |
| SMR-Trajectory Thresholds Using Multiresolution Sinusoidal Encoding | | | | | | | | |
| 2500–5000 Hz | 6.75 dB | 6.0 dB | 5.25 dB | 4.5 dB | 3.75 dB | 3.0 dB | 2.25 dB | 1.5 dB |
| 1250–2500 Hz | | 6.0 dB | | 4.5 dB | | 3.0 dB | | 1.5 dB |
| 0–1250 Hz | | | | 4.5 dB | | | | 1.5 dB |

Figure 16:
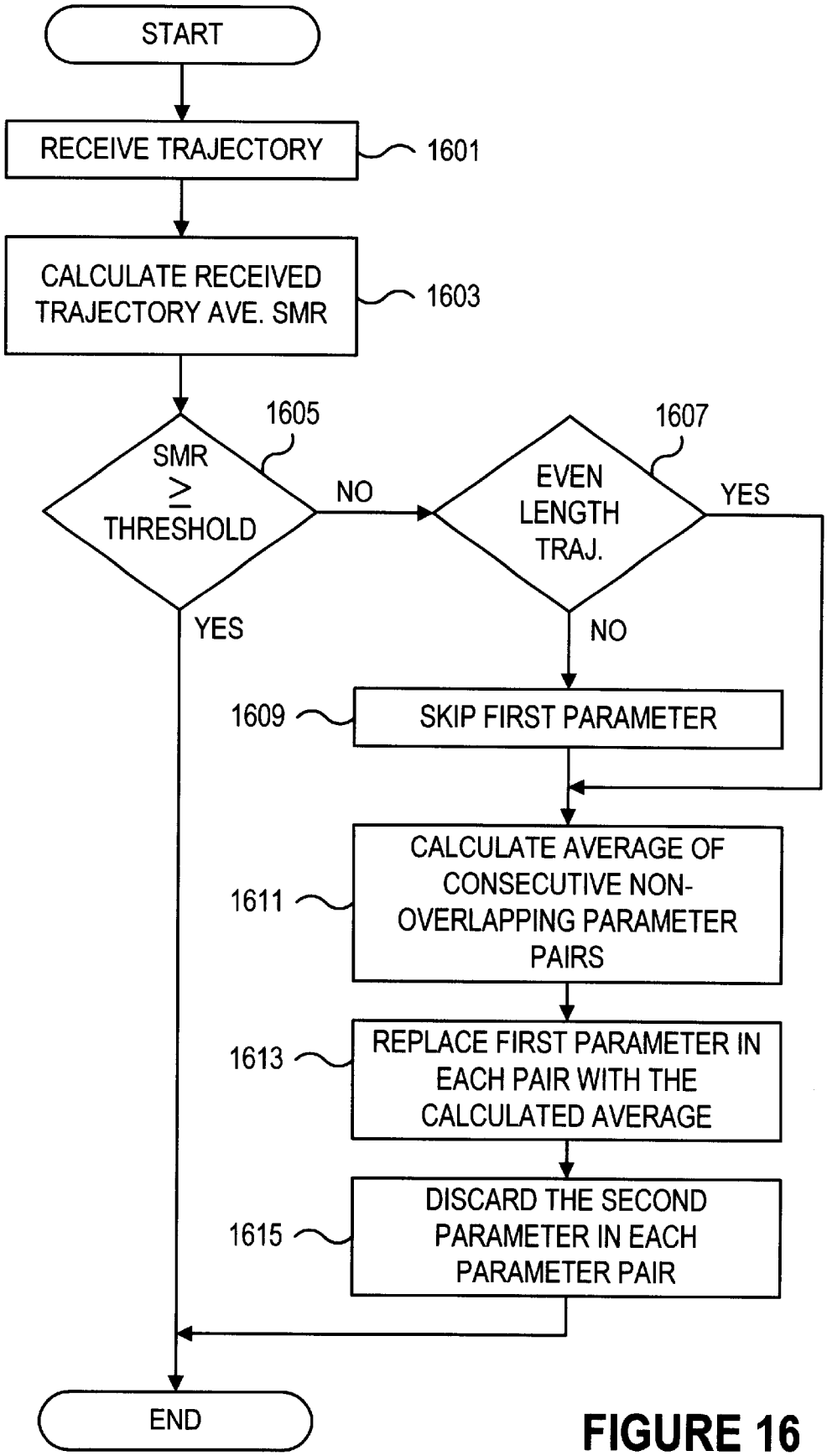
FIG. 16 is a flowchart illustrating a preferred downsampling method according to the invention.
Figure 17A:
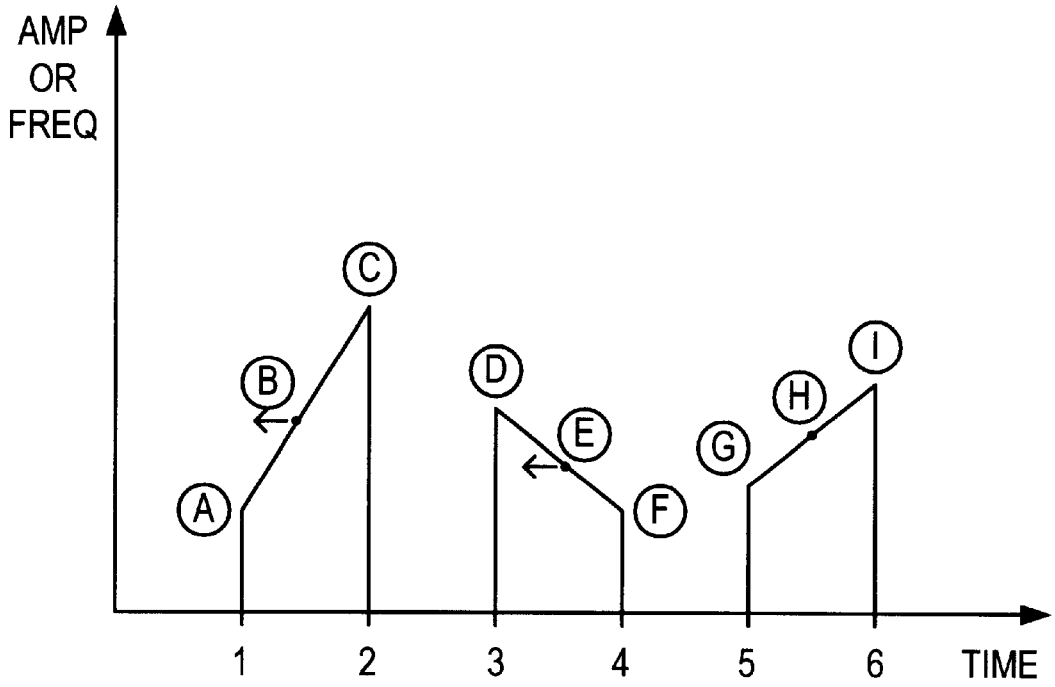
FIG. 17*a* illustrates an example of the use of the downsampling method of FIG. 16.
Figure 17B:
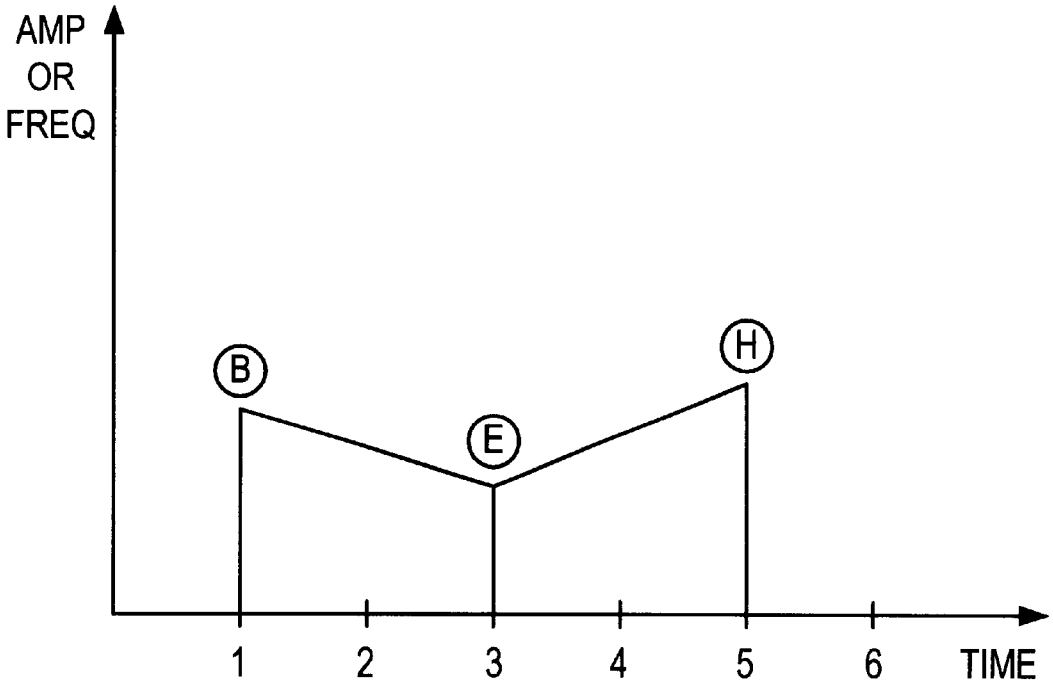
FIG. 17*b* illustrates a continuation of the example of FIG. 17*a;*

Returning to FIG. 13, with reference to FIGS. 16 and 17, after SMR trajectory processing and upon receipt by downsample processor 1209, the SMR processed data is then downsampled. Despite other quantization utilized, the use of a high bit rate encoder necessitates further data reduction. Conventional data reduction methods, such as reducing the number of bits used to quantize each parameter and wholly eliminating selected sinusoidal triads, were found to have a substantial detrimental impact on audio fidelity. Thus, after much experimentation, it is determined that significant data reduction can be achieved with minimized impact on audio fidelity by smoothing only the least perceptually important trajectories. The preferred downsampling process is illustrated in FIG. 16 and then exemplified in FIGS. 17*a* and 17*b*. Using downsampling, a data reduction of approximately 50 percent per trajectory is achieved with little if any noticeable impact on audio fidelity.

As shown in FIG. 16, in step 1601, a trajectory is received. Next, in step 1603, the time-average SMR of the received trajectory is calculated. If, in step 1605, the calculated SMR is greater than or equal to an SMR-threshold, then the trajectory is left unchanged. If instead, in step 1605, the calculated SMR is less than the SMR-threshold, then the trajectory is downsampled in accordance with steps 1607 through 1615. Downsampling is preferably performed (separately) on each amplitude and frequency trajectory.

Steps 1607 through 1609 address the problem that while downsampling is preferably performed on trajectory parameter pairs, trajectories can have either even or odd lengths (i.e. an even or odd number of trajectory parameters). Thus, if, in step 1607, an even length trajectory has been received, then downsampling is performed on trajectory parameter pairs beginning with the first trajectory parameter in steps 1611 through 1615. If instead, in step 1607, an odd length trajectory is received, then the first trajectory parameter is skipped in 1609 and downsampling of steps 1611 through 1615 are performed beginning with the second trajectory parameter (i.e. the first parameter is retained unaltered.) Note that a "skipped" is transferred along with the other resultant data.

In step 1611, downsample processor 1309 calculates the average of each consecutive non-overlapping parameter pair. Next, in step 1613, each first parameter in each pair is replaced with the corresponding calculated average. Finally, in step 1615, the second parameter in each parameter pair is discarded.

For example, the trajectory shown in FIG. 17*a* includes 6 trajectory parameters (i.e. 1 through 6) having respective parameter values indicated as A, C, D, F, G and I. Parameter pair averages indicated as B, E and H are then calculated. In FIG. 7*b*, the prior parameter value for parameter 1 has been replaced with the calculated average, B, for parameters 1 and 2, and parameter 2 has been discarded. Similarly, the value for parameter 3 has been replaced with the calculated average E, and parameter 4 has been discarded. Finally, parameter 5 has been replaced with the average value H and parameter 6 has been discarded. As will be discussed, the trajectory parameters are reconstructed during the decoding process in accordance with the "averages" remaining after downsampling. More specifically, the trajectory length will be restored through an complimentary interpolation process.

Returning again to FIG. 13, following downsampling, the downsampled trajectories are preferably transferred from downsample processor 1309 to difference processor, 1311, then final quantizer 1312 and finally, Huffman coder 1313. Each of these remaining quantizer 533 elements preferably operates in a conventional manner. More specifically, difference processor 1311 performs a temporal difference along each amplitude and frequency trajectory. Next, final quantizer 1312 quantizes all amplitudes to a 1.5 dB magnitude scale, frequencies above 500 Hz to the nearest ten cents and frequencies below 500 Hz to the nearest 3 Hz. Finally, Huffman coder 1313 performs well-known Huffman coding. This completes sinusoidal quantization.

Following quantization, the quantized sinusoidally modeled data is transferred from sinusoidal quantizer to splicer 534. As discussed splicing is necessitated primarily by the novel integration of two unrelated audio data representations (e.g. sinusoidal modeling and transform coding) and is performed at each interface between the two. Preferably, an interface is created by allowing the sinusoidally modeled data to overlap from non-transient regions into transient regions.

Broadly stated, experimentation has revealed that a low bit-rate and high fidelity producing interface can be formed at each transient region boundary. Preferably, sinusoidally encoded data is made to overlap each transient region boundary by a single frame. In addition, decreasing envelopes and increasing envelopes are preferably utilized for both amplitude and frequency at the respective non-transient to transient and transient to non transient regions to provide sonically graceful transitions for almost all audio sources. This leaves only a problem of phase. Unless the phases of the sinusoidally encoded and transform coded data match, artifacts will be produced at the each interface. However, the use of high bit encoding, such as transform coding, requires that the amount of data be reduced as much as possible with as little impact on fidelity as possible. Therefore, the option of retaining all phase information generated during sinusoidal encoding (i.e. as part of the sinusoidal parameter triads) is disregarded. Rather, it is preferred to discard all of the phase parameters except those during splicing for use during decoding to force a perceptually graceful phase transition at the above interface. More specifically, during decoding, a random phase will be preferably be generated at the start of an audio portion being decoded; where a sinusoid-to-transient interface is encountered, the phase will be corrected using the retained phase parameters.

Figure 18:
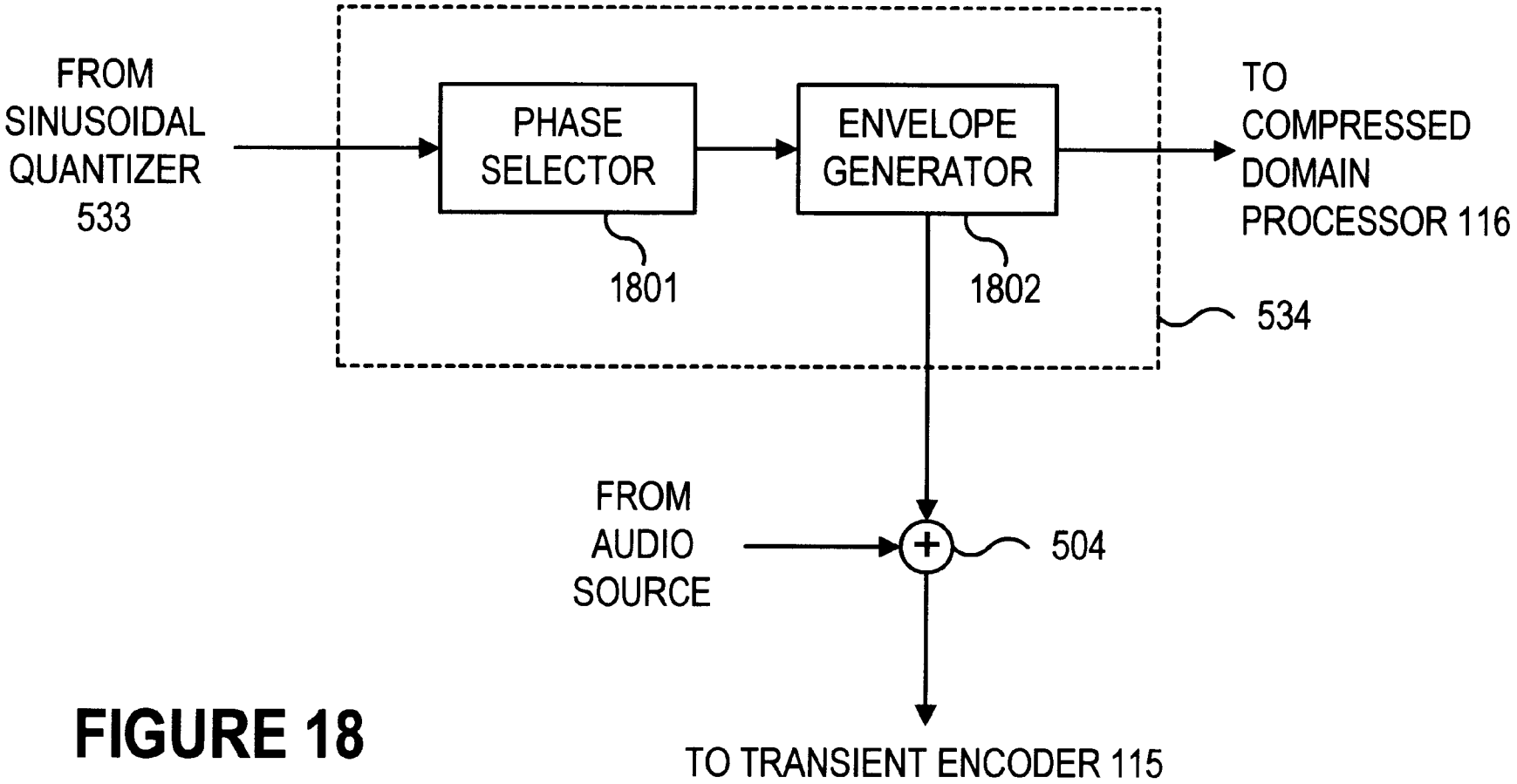
FIG. 18 is a flow diagram illustrating a preferred sinusoidal splicer according to the invention.

The FIG. 18 flow diagram illustrates a preferred sinusoidal splicer according to the invention. As shown, splicer 534 comprises communicatingly coupled elements including phase selector 1801 and envelope generator 1802. Operationally, phase selector 1801 receives sinusoidal parameters from sinusoidal quantizer 533, selects from among the available phases those phases needed for phase matching during decoding and discards the remaining phase parameters. Envelope generator 1802 modifies the sinusoidal amplitude and frequency parameters to provide decreasing and increasing envelopes respectively at non-transient to transient region boundaries and at transient to non-transient region boundaries.

Note that, while not depicted as a part of splicer 534, summer 504 also preferably serves a splicing function. More specifically, if the overlapping portion of the sinusoidally encoded audio ("sinusoidal overlap") is also represented as transform coded audio, then the duplicated portion will be perceived as an unnatural emphasis. However, through the use of summer 504, the sinusoidal overlap is subtracted from the audio source, only the difference (minus the sinusoidal overlap) is transferred to transient encoder 115 for encoding. (See FIG. 19*a*)

Figures 19A, 19B:
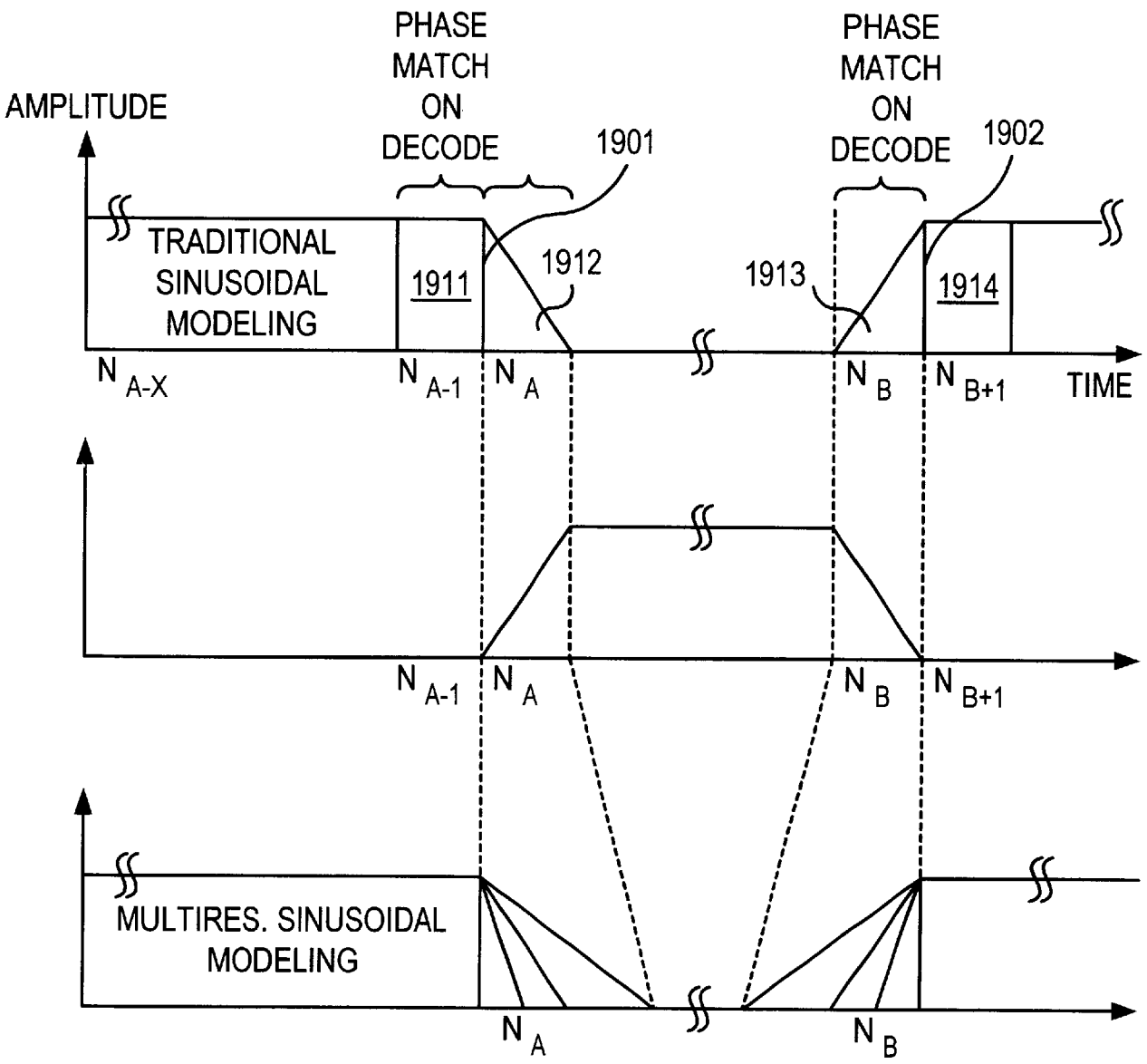
FIG. 19*a* illustrates the preferred operation of the preferred splicer of FIG. 18 for sinusoidal splicing.
FIG. 19*b* illustrates the preferred operation of the preferred splicer of FIG. 18 for multiresolution sinusoidal splicing.

The preferred operation of phase selector 1801 and envelope generator 1802 are more easily understood with reference to FIGS. 19*a* and 19*b*. In FIG. 19*a*, a sinusoidally encoded region is shown in an upper graph while a transient region is shown in the lower graph, time being depicted along the x-axis and amplitude along the y-axis. Time is indicated in frames and amplitude are respectively depicted roughly in terms of dB. FIG. 19*b* is arranged the same as in FIG. 19*a* except that a transition frame, NA, has been enlarged to more clearly show preferred octave-dependent transitions where multiresolution sinusoidal modeling replaces traditional modeling.

As shown in FIG. 19*a*, an interface is formed in frames $N_A$ and $N_{A-1}$ joining a non-transient region extending from frame $N_{A-X}$ to frame boundary 1901 and a transient region extending from frame boundary 1901 to frame boundary 1902. A further interface is formed in frame $N_B$ ("end-of-transient frame") joining the same transient region to a further non-transient region beginning at frame boundary 1902. Since frame $N_A$ 1912 includes the sinusoidal overlap, the sinusoidally encoded phase parameters must be matched to the transform coded phase in that frame. However, since an instantaneous phase transition would produce audible artifacts, the phase is preferably corrected in frame $N_{A-1}$ 1911, which immediately precedes the transient region ("pre-transient frame"). Therefore, the phase parameters at frame boundary 1901 are preserved in the final sinusoidally encoded data. In contrast, at the end of a transient region, phase is preferably corrected during the sinusoidal overlap, since phase matching is immediately required. Therefore, the phase parameters at frame boundary 1902 are preserved in the final sinusoidally encoded data.

Also shown are decreasing and increasing envelopes respectively at frames $N_A$ 1911 and $N_B$ 1914, which are produced by envelope generator 1802 (FIG. 18) and through the operation of summer 504. (Note that an increasing envelope preferably extends from a zero level to a maximum level according to a corresponding stored amplitude or frequency.) A simple ramping function is easily created (e.g. using a progressive multiply or add), has been shown to provide sufficiently high fidelity results and is therefore preferred. The ramping function has been found to sufficiently mask not only phase-matched transitions to a transient region, but also time-varying phase transitions preferably applied by a decoder at transitions from a transient region. However, numerous other envelopes, such as an exponential function, can also be used according to fidelity or other considerations. As shown in FIG. 19, where multiresolution sinusoidal modeling is used, a separate ramping function is preferably applied for each frequency range. Such multiple functions are applied due to the frequency-varying window sizes utilized.

Figure 20:
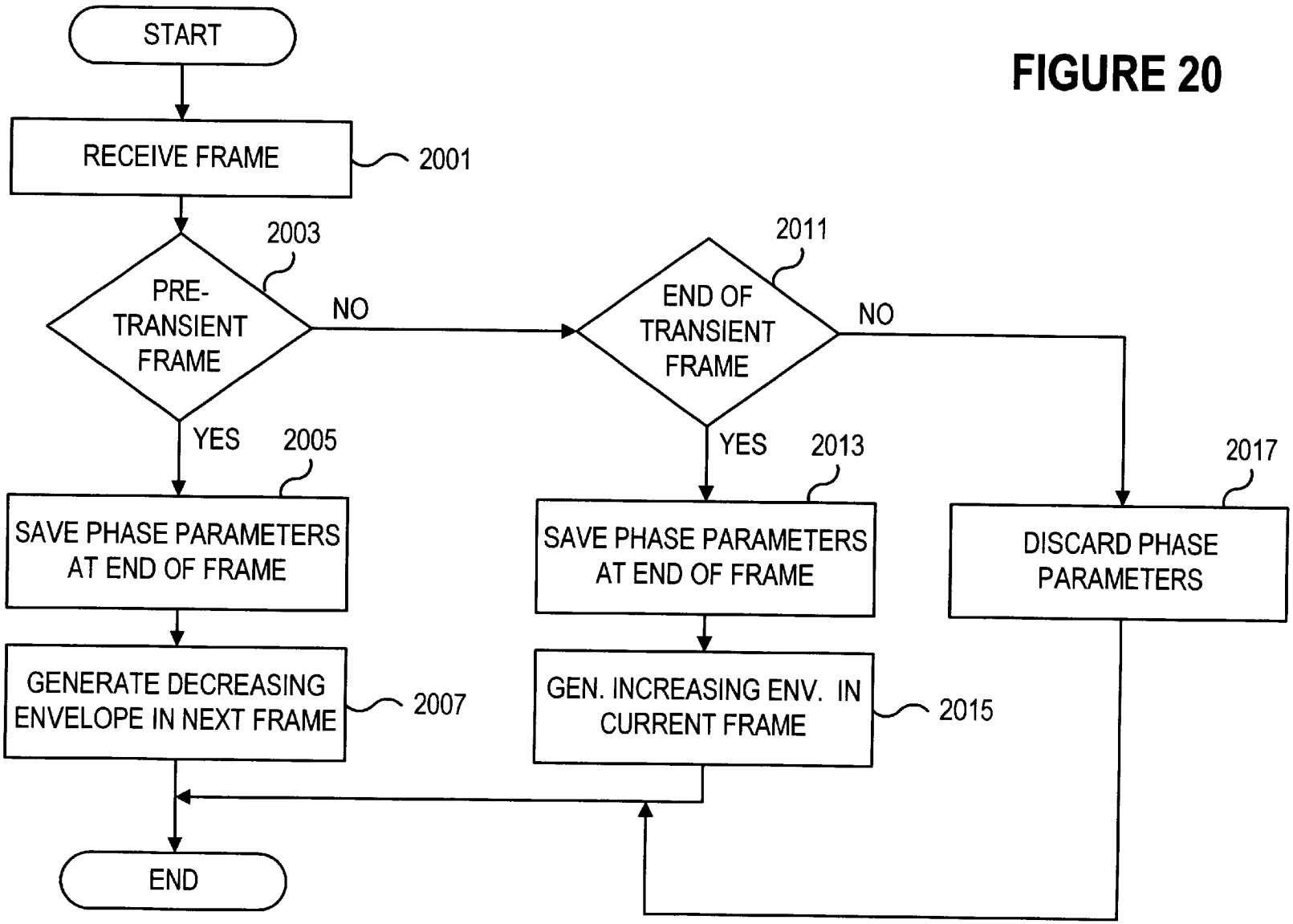
FIG. 20 is a flowchart illustrating preferred methods used by the preferred splicer or FIG. 18 splicer for phase selection and envelope generation.

The FIG. 20 flowchart illustrates the preferred methods used by splicer 534 for phase selection and envelope generation. As shown, in step 2001, splicer 534 receives a frame of audio data. If, in step 2003, the received frame is a pre-transient frame, then the phase parameters at the end of the frame are saved in step 2005, and a decreasing envelope is generated in the next frame. If instead, the received frame is not a pre-transient frame, the operation proceeds to step 2011. If, in step 2011, the received frame is an end of transient frame, then the phase parameters at the end of the frame are saved in step 2005, and an increasing envelope is generated in the current frame. If, in step 2011, the received frame is not an end of transient frame, then the phase parameters for the frame are discarded.

Low Frequency Noise Encoder

Returning to FIG. 5, LF noise encoder 314 preferably receives audio data comprising the difference between the audio source and audio source data which has been sinusoidally modeled, then limited and then sinusoidally quantized, as discussed. More specifically, such difference data is received by region limiter 541. Region limiter 541 is similarly configured and operates in a similar manner as region limiter 532. The method of FIG. 11 is also a preferred method with regard to region limiter 541.

LF noise modeler 542, which preferably receives limited data from region limiter 541, is preferably a conventional bark band noise modeler or a portion of a bark band encoder or other device that can function as a bark band modeler. Noise modeling by such a device is preferably either frequency limited or is capable of providing noise that is frequency limited from zero to 5 kHz as discussed above. Such a modeler further preferably performs the methods conventionally performed by such a modeler. Other noise modelers can also be utilized.

LF noise quantizer 543, which preferably receives noise modeled data from LF noise modeler 542, can also be any number of conventional noise quantization devices performing conventional noise quantization methods. It should be noted, however, that novel quantization apparatus and methods which will be discussed with reference to HF noise encoder 316 can also be utilized with LF noise quantizer 543 where addition bit-rate reduction is paramount and complexity is a lesser consideration. No effect on fidelity was observed using such quantization for the low frequency sinusoidal encoding residual preferably encoded by LF noise modeler 314.

Transient Encoder

Transient encoder 115 preferably receives audio data comprising the difference between the audio source and audio source data which has been sinusoidally modeled, limited quantized and spliced, as discussed. More specifically, such difference data is received by region limiter 541. As noted with regard to splicer 534, receipt of this difference provides for avoiding duplication of sinusoidal overlap during transient encoding using the preferably higher bit rate transient encoder. It should be noted that, but for this splicing characteristic, transient encoder could also receive from other sources, due to the operation of region limiter 551. For example, since each summer also preferably performs decoding and synthesis, complexity and encoding time could be reduced by transferring an audio source directly to transient encoder 115.

Figure 21:
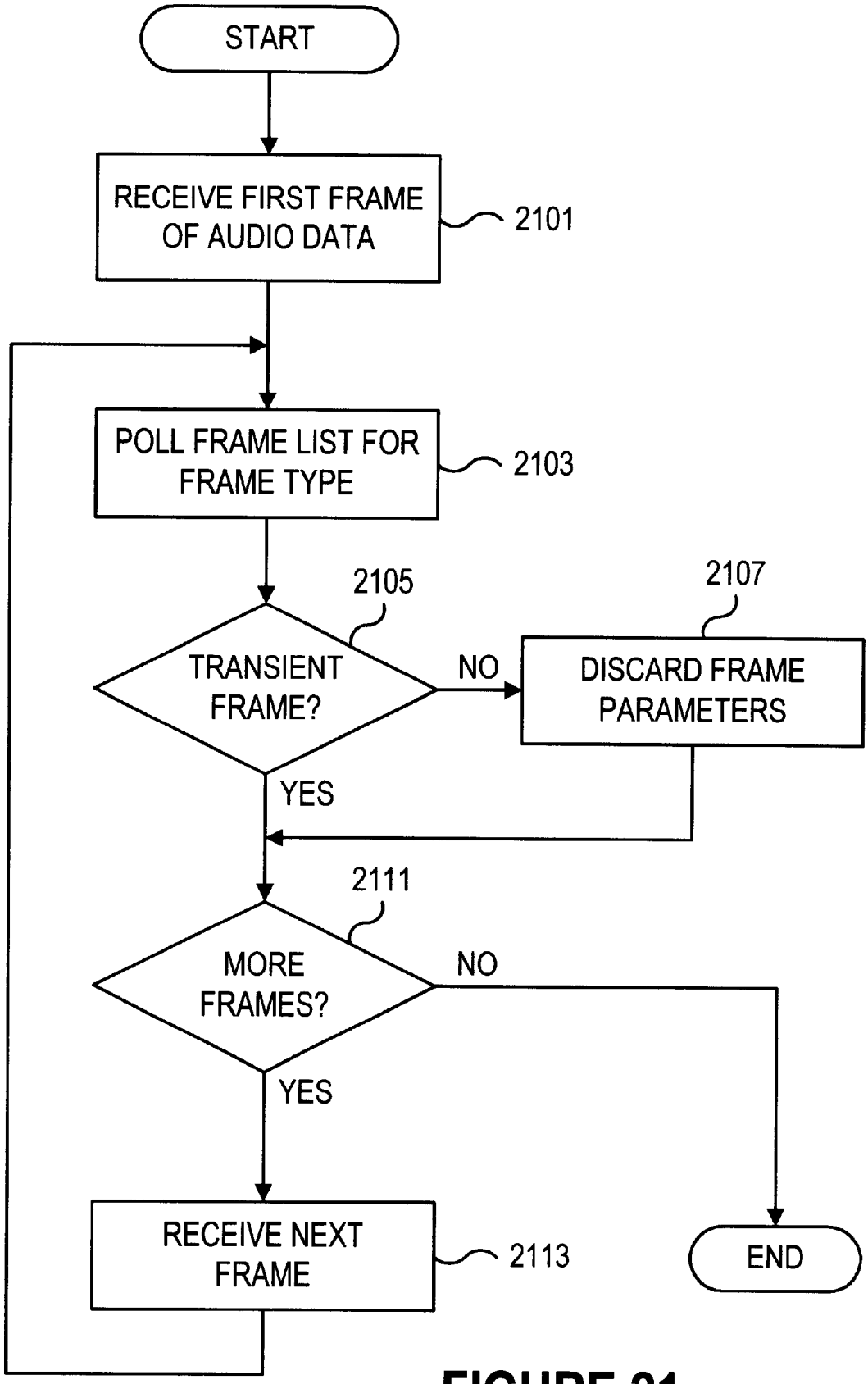
FIG. 21 is a flowchart illustrating a preferred method by which a region limiter uses transient parameters to limit transform coded data to only transient regions of the source audio, according to the invention.

The FIG. 21 flowchart, with reference to FIG. 7, illustrates how region limiter 551 preferably uses transient parameters stored in frame list 726 to limit transform coded data to only transient regions of the source audio. As shown, in step 2101, region limiter 551 receives a first frame of audio source data. Next, in step 2103, region limiter 551 polls frame list 726 (FIG. 7) for the frame type of the current frame (in this instance, the first frame). If, in step 2105, the frame type is not a transient, then the audio source data for the frame are discarded and operation proceeds to step 2111. Otherwise, operation proceeds directly to step 2111. If in step 2111, more frames remain, then region limiter 551 receives a next frame (i.e. now the current frame) in step 2113 and operation proceeds to step 2103. Otherwise, limiting has been completed.

Returning to FIG. 5, transient modeler 552, which preferably receives limited data from region limiter 551, is preferably a conventional transform coder or a portion of a transform encoder or other device that can function as a transform coder. Such a modeler further preferably performs the methods conventionally performed by such a modeler. Other high bit-rate modelers can also be utilized, as discussed above. Also discussed was that the frequency range of transient modeler 552 is preferably 0 to 16 kHz.

Figure 22A:
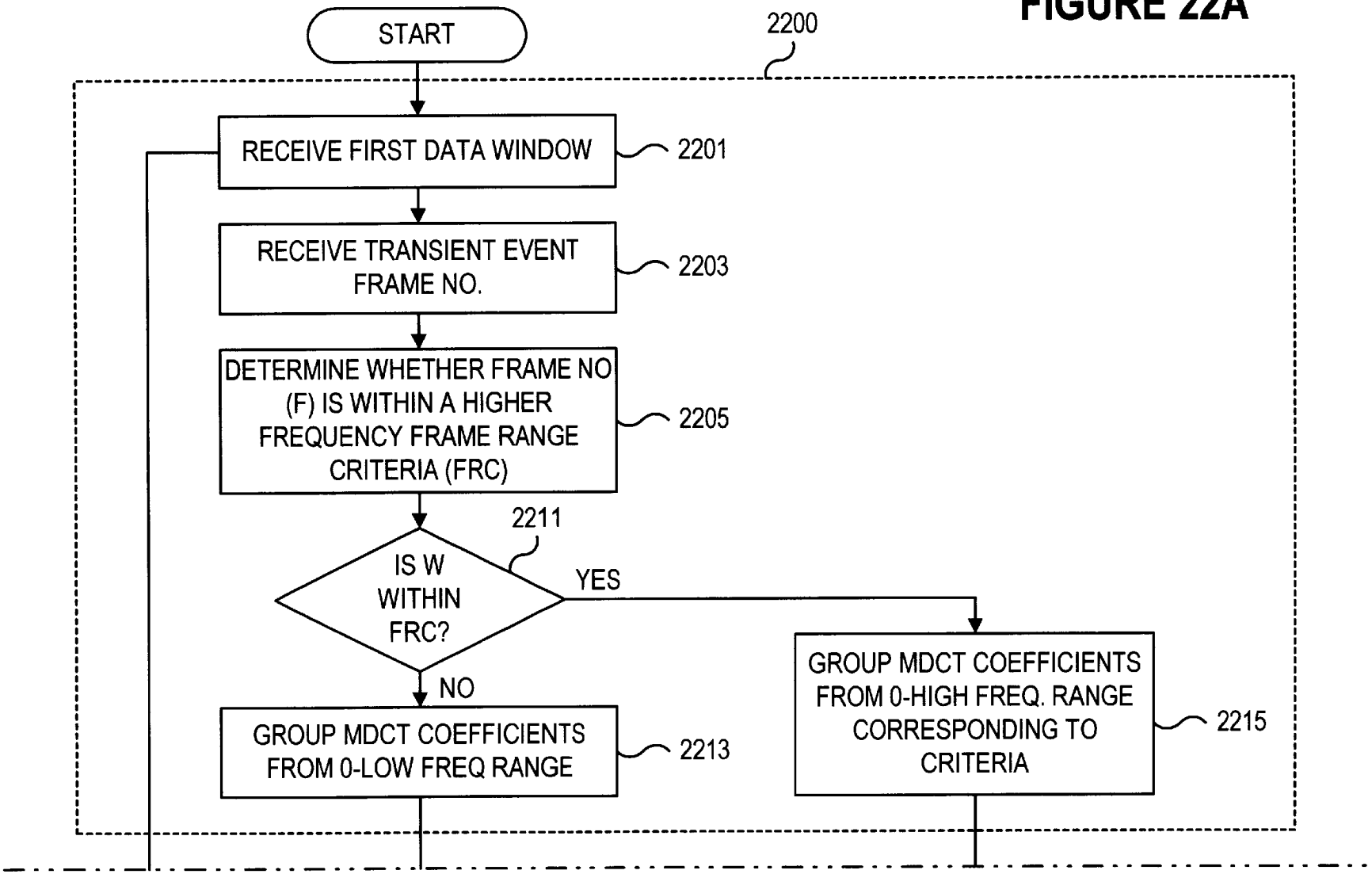
FIG. 22 is a flowchart illustrating a preferred pruning type transient quantization method according to the invention.
Figures 22, 22B:
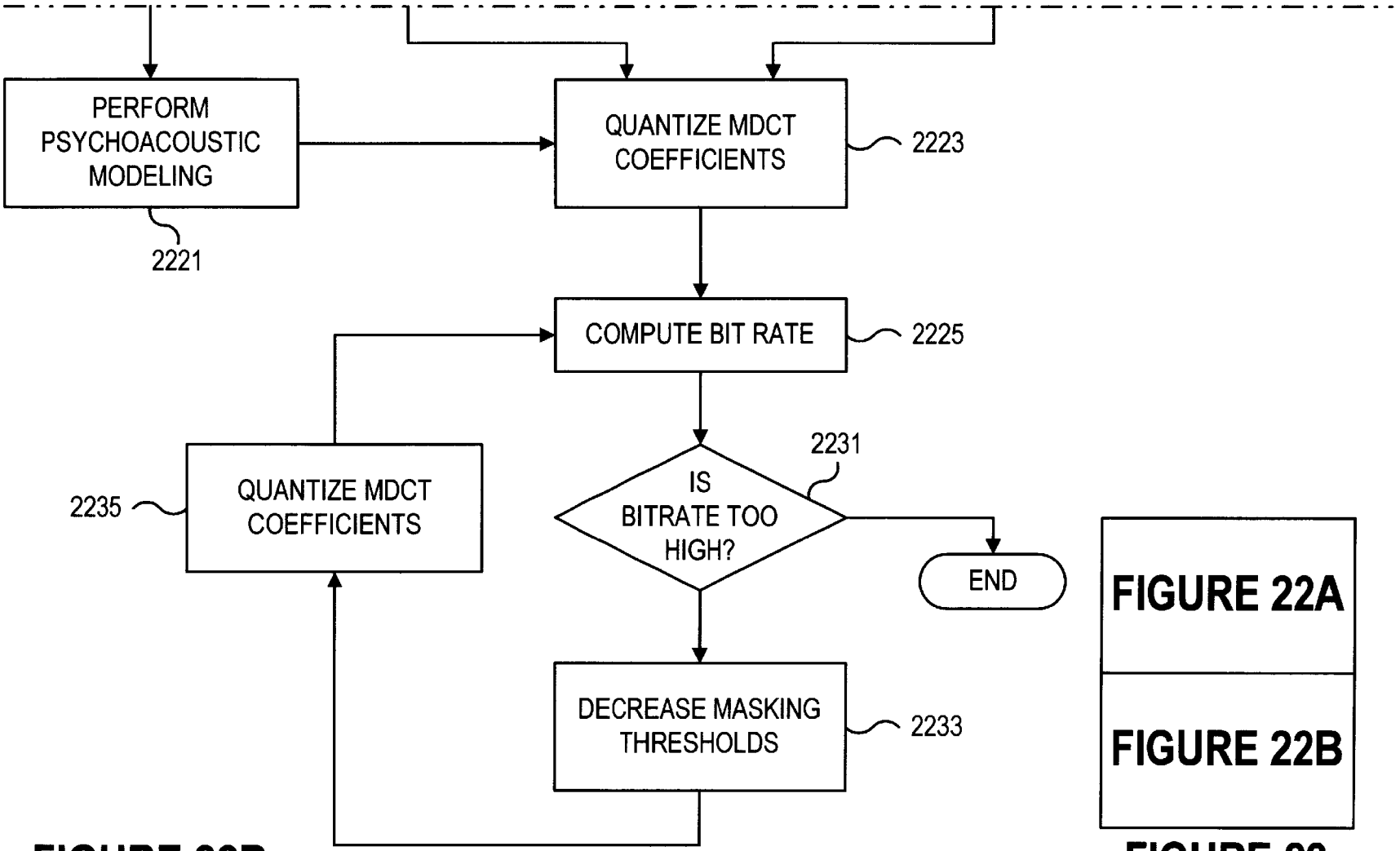
Figure 23:
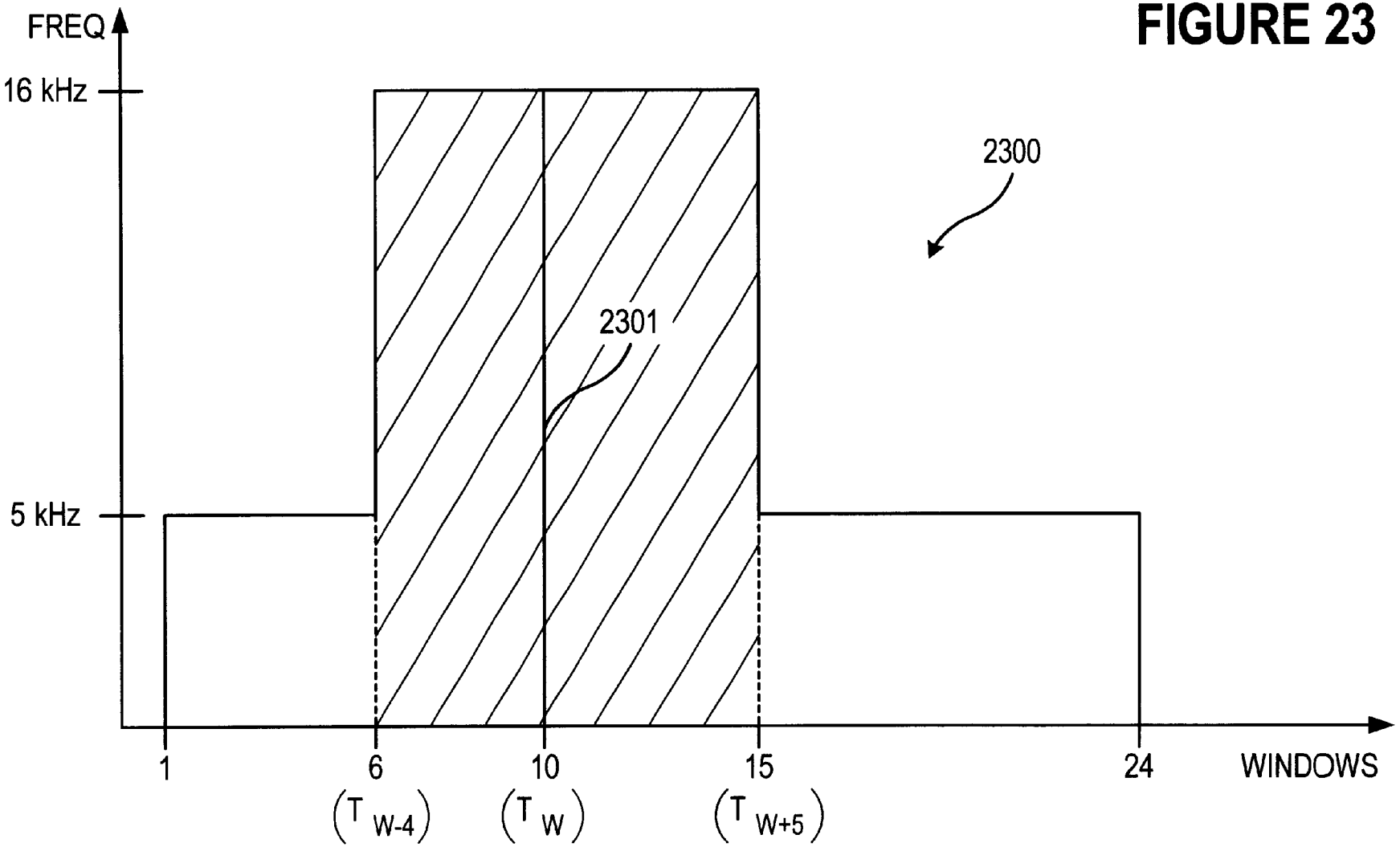
FIG. 23 illustrates an example of the method of FIG. 22 according to the invention.

Turning now to FIGS. 22 and 23, with reference to FIG. 5, the transform coded data produced by transient modeler 552 is transferred to transient quantizer 553. While quantization of transform coded data is conventionally accomplished using only psychoacoustic modeling, as discussed, an unacceptable tradeoff was encountered relying on this method. That is, in order to achieve an acceptable bit rate, fidelity had to be sacrificed to unacceptable levels. However, it is found that both high fidelity and low bit rates can be achieved by the preferred pruning type process 2200 illustrated in FIG. 22. This process is then followed by a conventional psychoacoustic modeling method, such as that illustrated. As shown, a data window (e.g. 256 points) is received in step 2201 and the frame number of the transient event is received in step 2203. Next, in step 2205, it is determined whether the window number of the received frame is within a higher frequency range criteria. If, in step 2211, the window number is within the criteria, then, in step 2215, the MDCT coefficients are grouped from 0 to a high frequency range. Otherwise, the coefficients are grouped from 0 to a low frequency range in step 2215. Following this method, conventional psychoacoustic modeling is performed. Alternatively, data might be pruned prior to encoding, for example, using region limiter 551. In addition, any number of frequency and time ranges can be used. For example, each of the 24 MDCT windows could have a separate frequency range.

A more preferred embodiment of the FIG. 22 method is illustrated in FIG. 23. As shown, a high frequency region is selected encompassing from four windows before transient event 2301 to five frames after transient event 2301. The high frequency in this case is set at 16 kHz. Thus, if a window is received within the high frequency region (e.g. from window 6 to window 15), then the MDCT coefficients are grouped from 0 to 16 kHz. On the other hand, if a window is received whose window number is outside the high frequency range (e.g. from 1 to 5 or 16 to 24), then the DCT coefficients are grouped from 0 to 5 kHz.

High Frequency Noise Encoding

As discussed with reference to FIG. 5, HF noise encoder 316 preferably encodes high frequency noise (i.e. from 5 to 16 kHz) in both the non-transient and transient regions. More specifically, high frequency non-transient regions are encoded using high frequency noise alone and, within transient regions, the residual from quantization of transform-coded audio is also encoded using high frequency noise. Thus no region limiter is required and a difference between the audio source and the output of transient quantizer 553 is received by HF noise modeler 562.

As with LF noise encoder 314, any number of conventional noise modelers can be used, with a preference for a bark band noise modeler and methods or an equivalent which can deliver encoded data representing 5 to 15 kHz.

Figure 24:
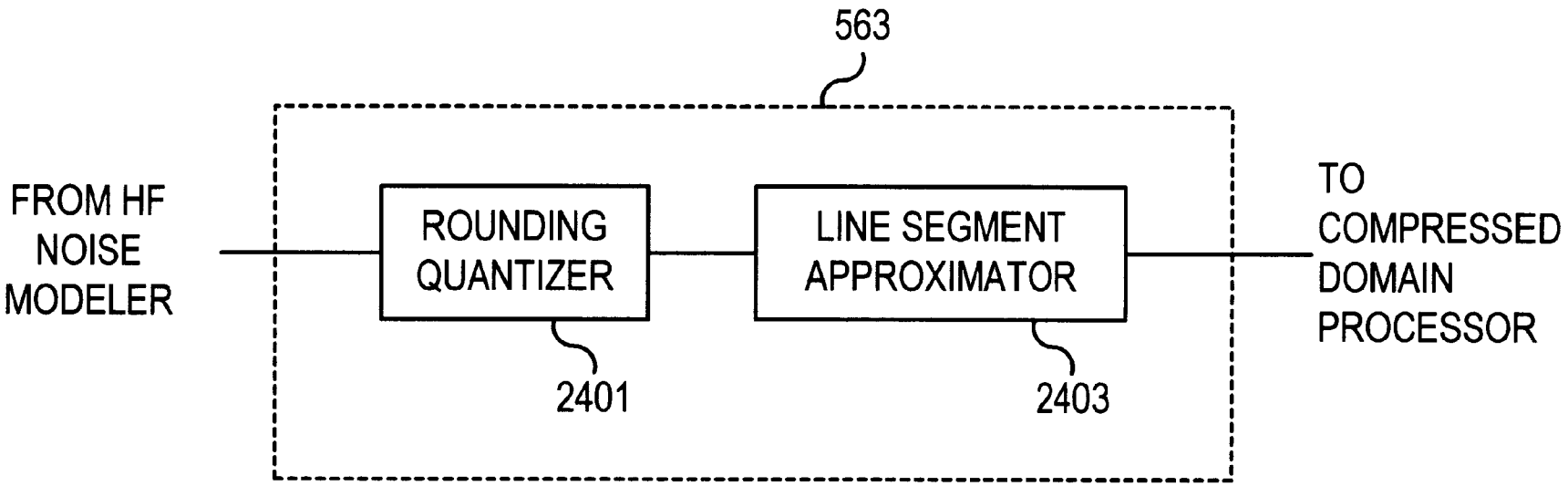
FIG. 24 is a functional diagram illustrating the preferred elements of a high frequency noise quantizer according to the invention.

As shown in FIG. 24, HF noise quantizer 563 preferably comprises rounding quantizer 2401 and line segment approximator 2403. Conventionally, noise is each parameter is individually quantized in time, resulting in a very high bit rate in even the quantized data. Rounding quantizer 2401 preferably performs such a quantization prior to line segment approximation. Line segment approximation, however, smoothes less perceptually important data, thereby producing quantized data having only twenty percent of the original sampled noise gains with little if any perceptual alteration of the data.

Figure 25A:
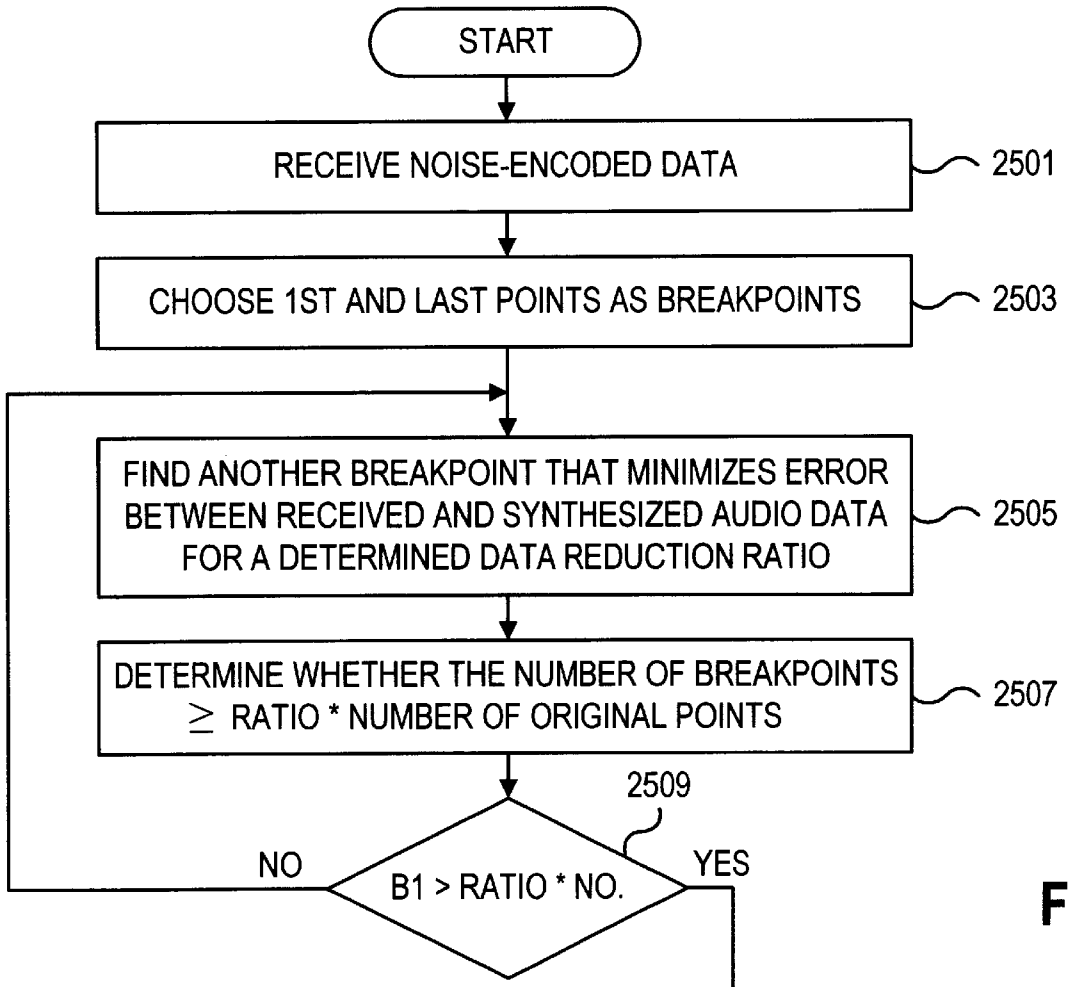
FIG. 25 is a flowchart illustrating a preferred method for line segment approximation, noise quantization according to the invention.
Figure 25B:
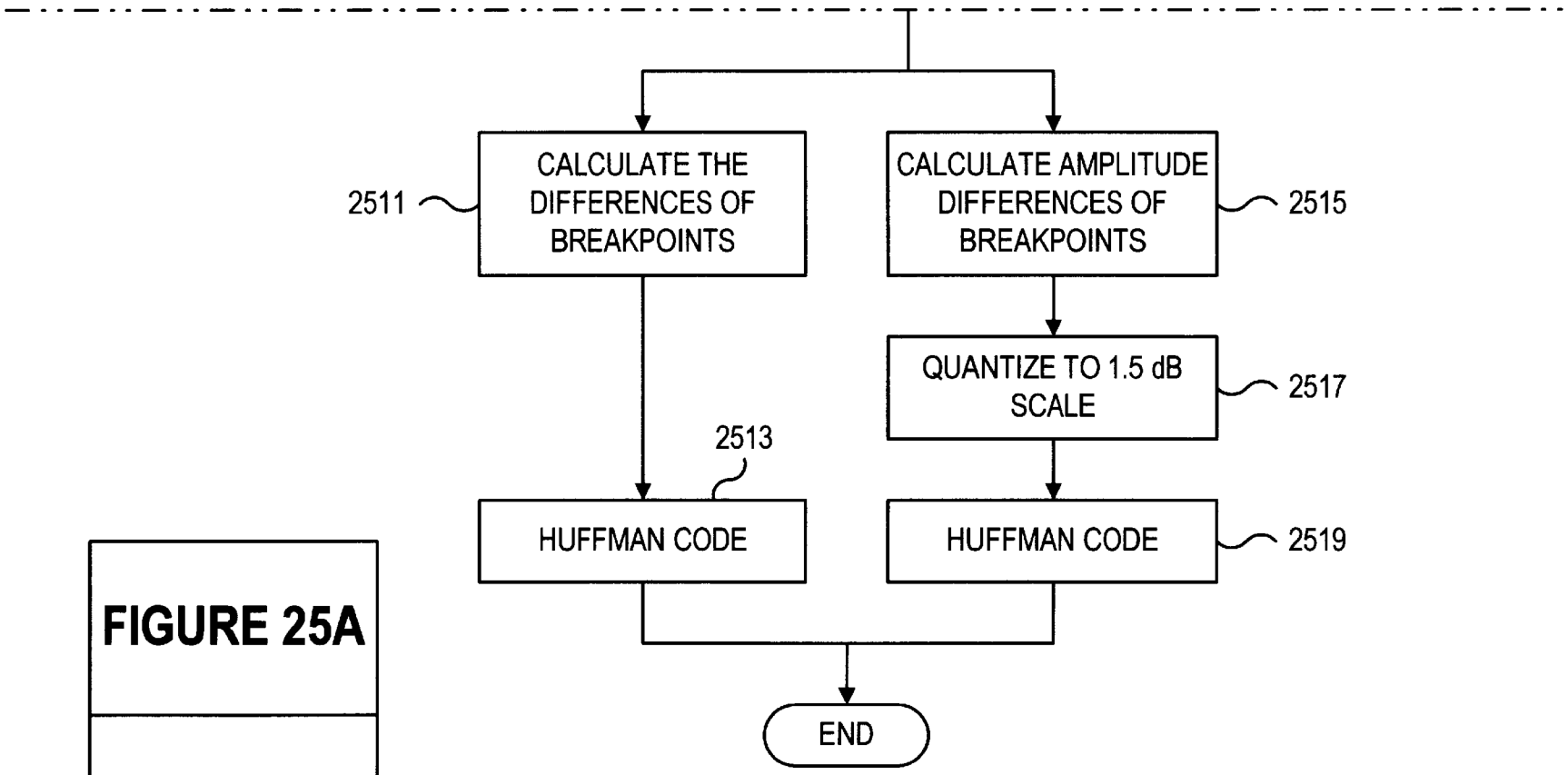
Figure 25:
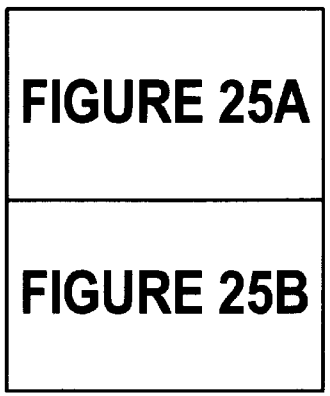
Figure 26:
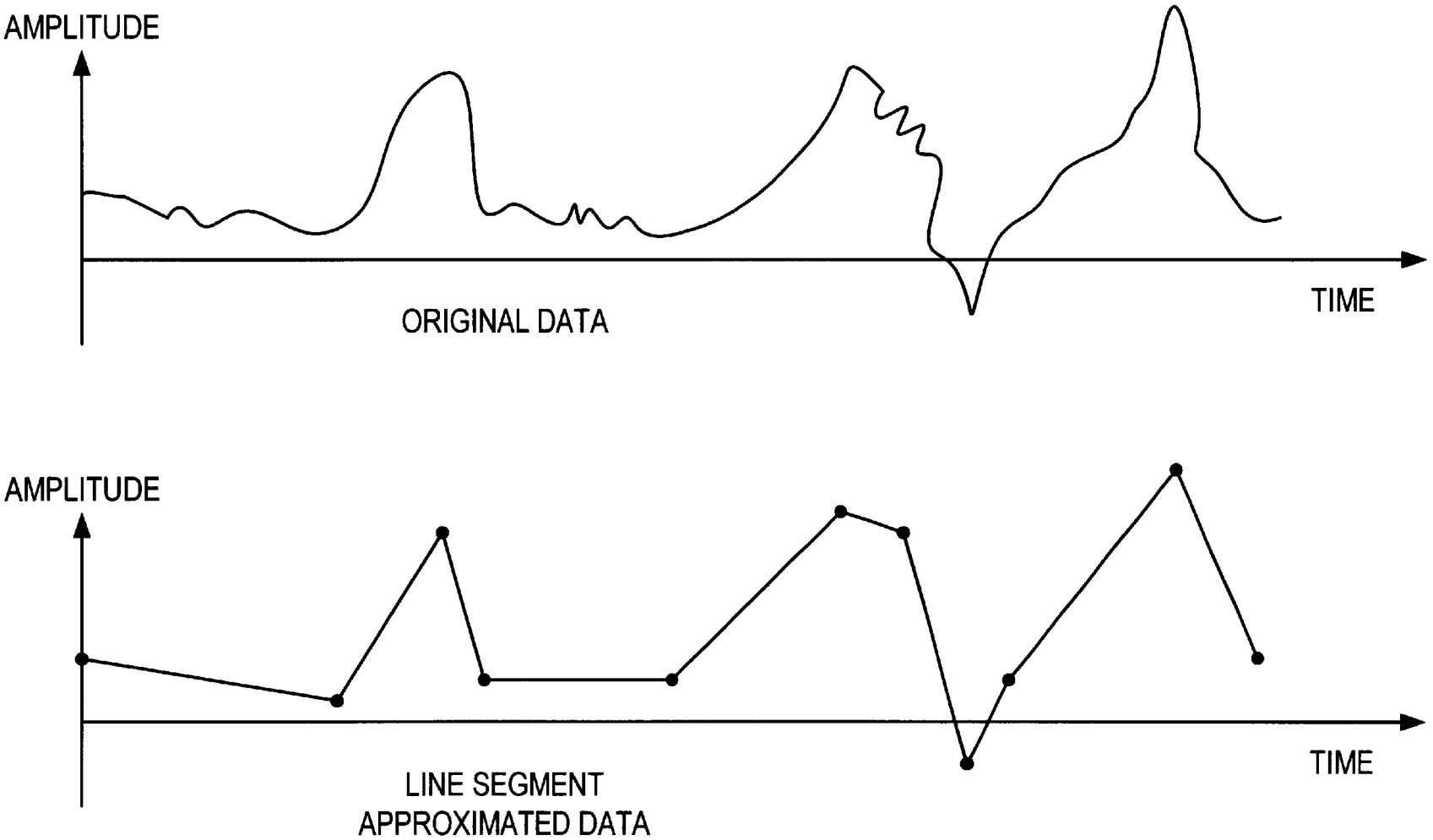
FIG. 26 illustrates an example using the preferred line segment approximation method of FIG. 25.

The FIG. 25 flowchart illustrates a method for line segment approximation. As shown, in step 2501, noise encoded data is received. Preferably the data has been bark band modeled. Next, in step 2503, the first and last points are chosen as breakpoints (i.e. they will be transferred in the final encoded data). In step 2505, the data is polled for another breakpoint that minimizes error (e.g. mean square error) between received and synthesized audio data for a determined data reduction ratio. Then, in step 2507, a determination is made as to whether the number of breakpoints is greater than or equal to the reduction ratio times the number of points in the received data. If, in step 2509, the condition of step 2507 is not met, then operation proceeds to step 2505 for another iteration. If instead, in step 2509, the condition of step 2507 is met, then the time differences of the found breakpoints are calculated in step 2511 and then Huffman coded in step 2513. Further, having met this condition, the amplitude differences of the break points are calculated in step 2515, then quantized to a 1.5 dB scale in step 2517, and then Huffman coded in step 2519. An example of the line segment approximation method of FIG. 25 is illustrated in FIG. 26. The upper graph depicts an original noise source which is then shown in quantized form in the lower graph. While the appearance has changed significantly due to the substantial reduction of data, high fidelity is yet achieved.

Compressed Domain Modifier

As discussed, compressed domain processor 116 (FIG. 5) preferably receives encoded and quantized data from each of sinusoidal encoder 113, LF noise encoder 314, transient encoder 115 and HF noise encoder 316, as already discussed. Once received, compressed domain processor 116 performs data manipulations in the compressed domain and without requiring prior decoding or re-encoding once the manipulation is completed.

Among important compression domain processing capabilities are time and frequency manipulation. One of the difficulties in performing these manipulations is that the perceptual quality of the resultant audio should not be affected. In particular, while some loss of fidelity in steady state portions of audio might go unnoticed, changes in the quality of transients are readily perceived. Since changes in a perceived quality of sound often relate to alteration of the audio data in transient regions, the preferred compressed domain processor 116 performs no such alterations on transients.

Figure 27:
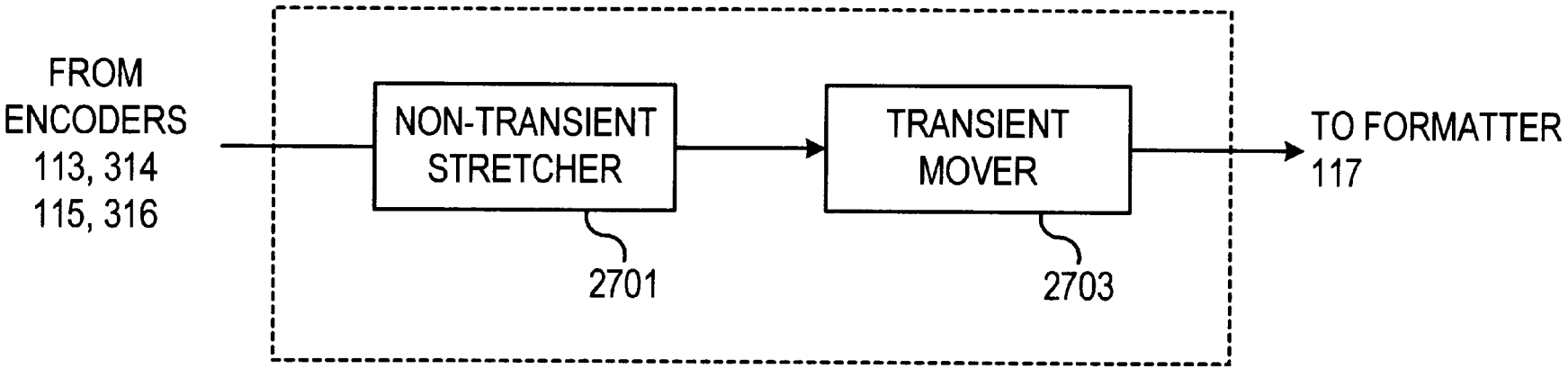
Figure 28:
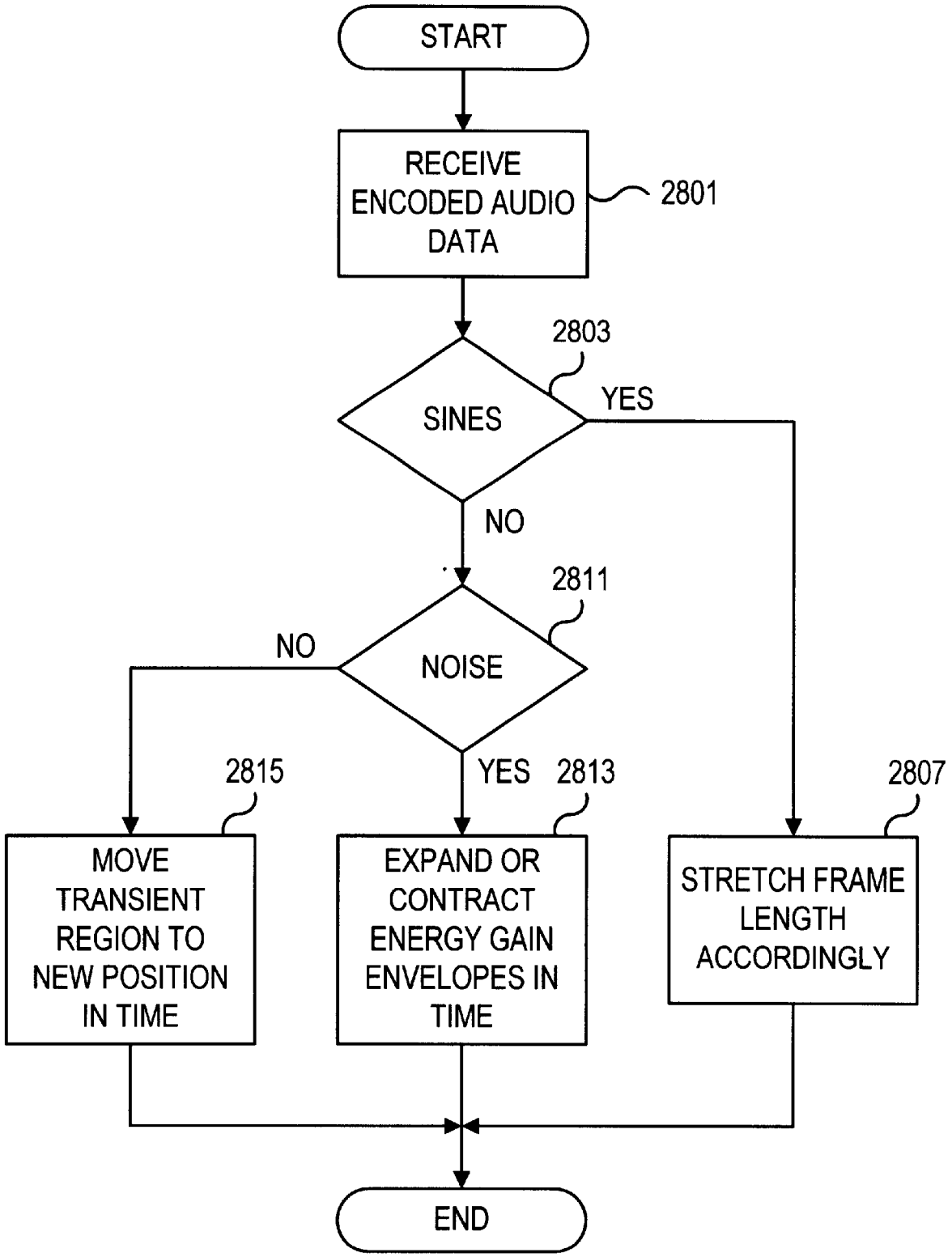
FIG. 28 is a flowchart illustrating a preferred method for compressed domain time compression and expansion.

Turning now to FIG. 27, compressed domain processor preferably comprises communicatingly coupled elements including non-transient stretcher 2701 and transient mover 2703. During time scale modification, non-transient stretcher 2701 preferably operates in a conventional fashion to stretch and compress sinusoidal and noise encoded data, but only for non-transients. In contrast, transient-mover 2703 neither alters nor affects the relationship between data points in a transient region. This relationship is illustrated in greater detail in the FIG. 28 flowchart, which depicts a preferred method for compressed domain time compression and expansion. As shown, encoded audio data is received in step 2801. If, in step 2803, sinusoidal data is received, then the frame lengths are contracted or expanded in step 2807 according to the desired amount of time scale modification. If, in step 2811, the received data includes noise, then, the energy gain envelopes are expanded or contracted in time. If instead, in step 2811, the received data contains transients, then, in step 2815, the received transient region (or region portion) is moved to another position in time.

Figure 29:
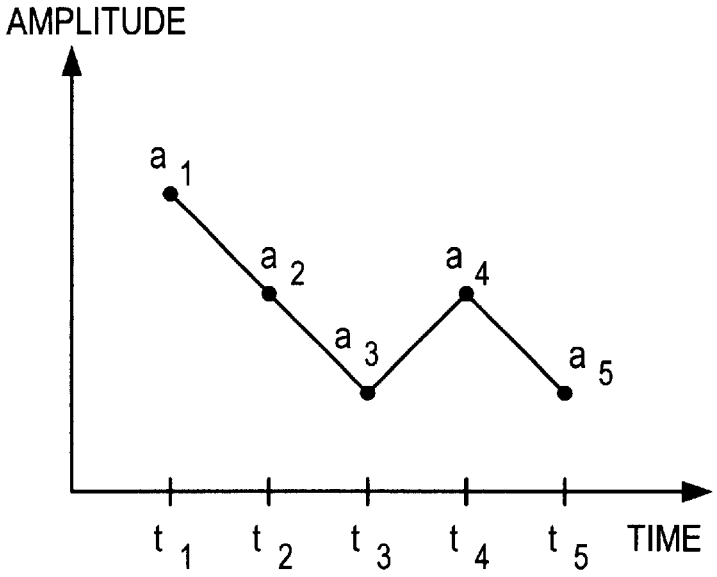
FIG. 29 illustrates an example using the preferred method of FIG. 28.
Figure 29:
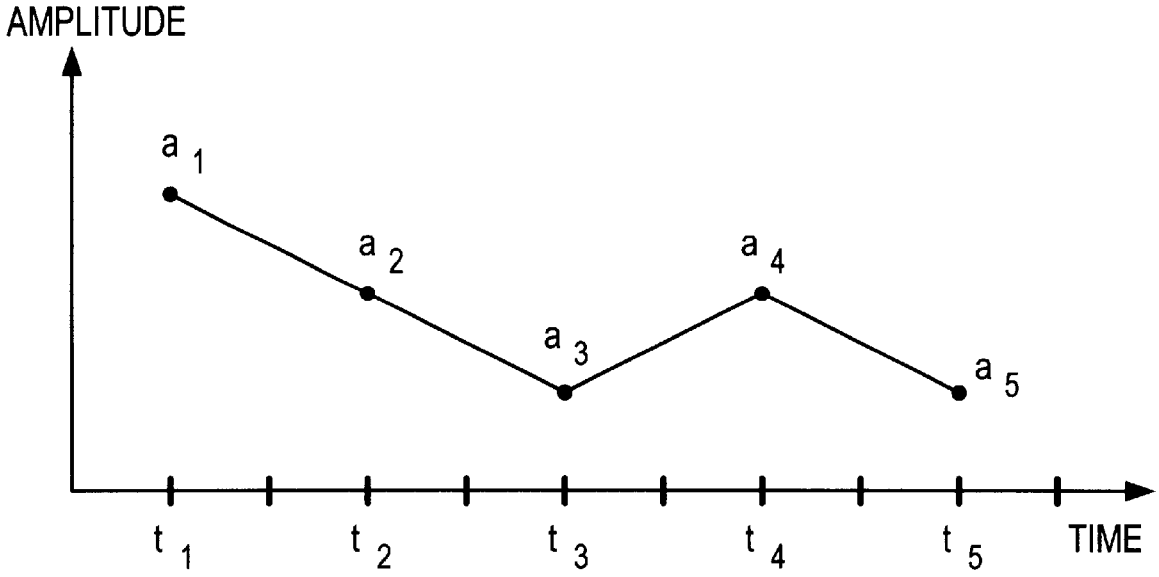
Figure 30:
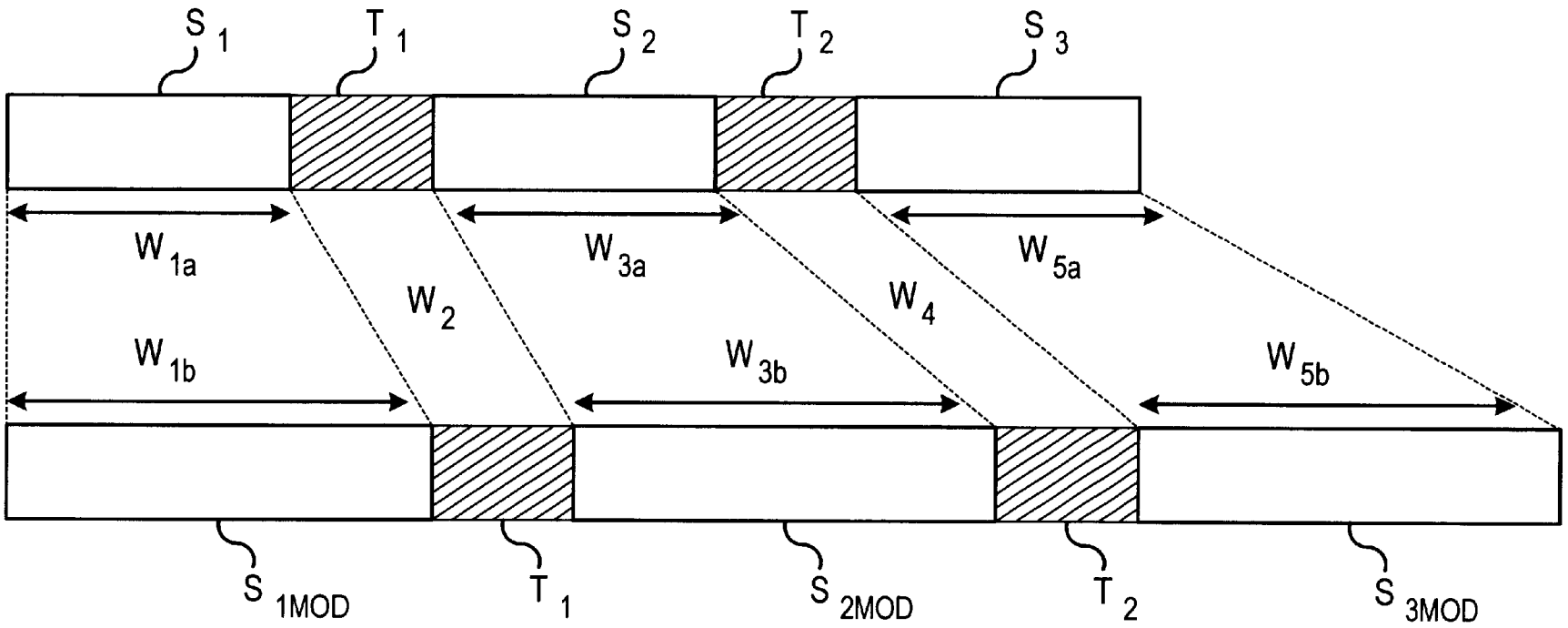
FIG. 30 illustrates a further example using the preferred method of FIG. 28.

FIGS. 29 and 30 further provide exemplary depictions respectively of the preferred sinusoidal time expansion and transient time expansion described above. In FIG. 29, the upper graph depicts a received sinusoidal trajectory. The lower graph illustrates how the trajectory parameters a1–a5 are literally expanded in time. FIG. 30 adds transients to the FIG. 29 example in order to better show the relationship between the two. More specifically, sinusoidally modeled S1, S2 and S3 are expanded in time, while each of transient regions T1 and T2 are moved unaltered to their new positions.

Compression domain frequency modification can be similarly implemented without altering the transient region. During frequency modification, only the sinusoidally modeled frequency data need be modified. The transients and noise are left unaltered.

Decoder

Figure 31A:
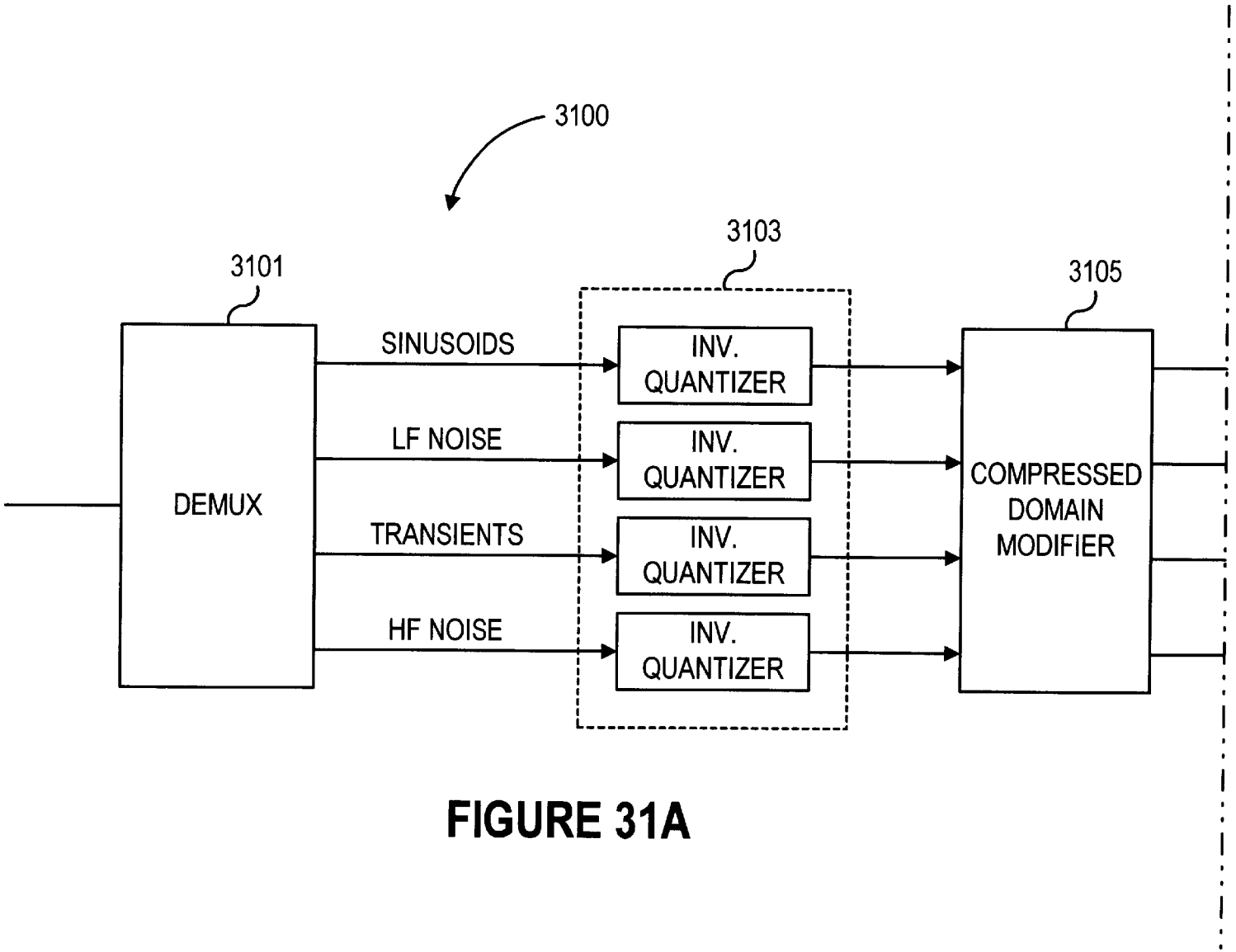
FIG. 31 is a flow diagram illustrating a preferred IFFT type decoder according to the invention.
Figures 31, 31B:
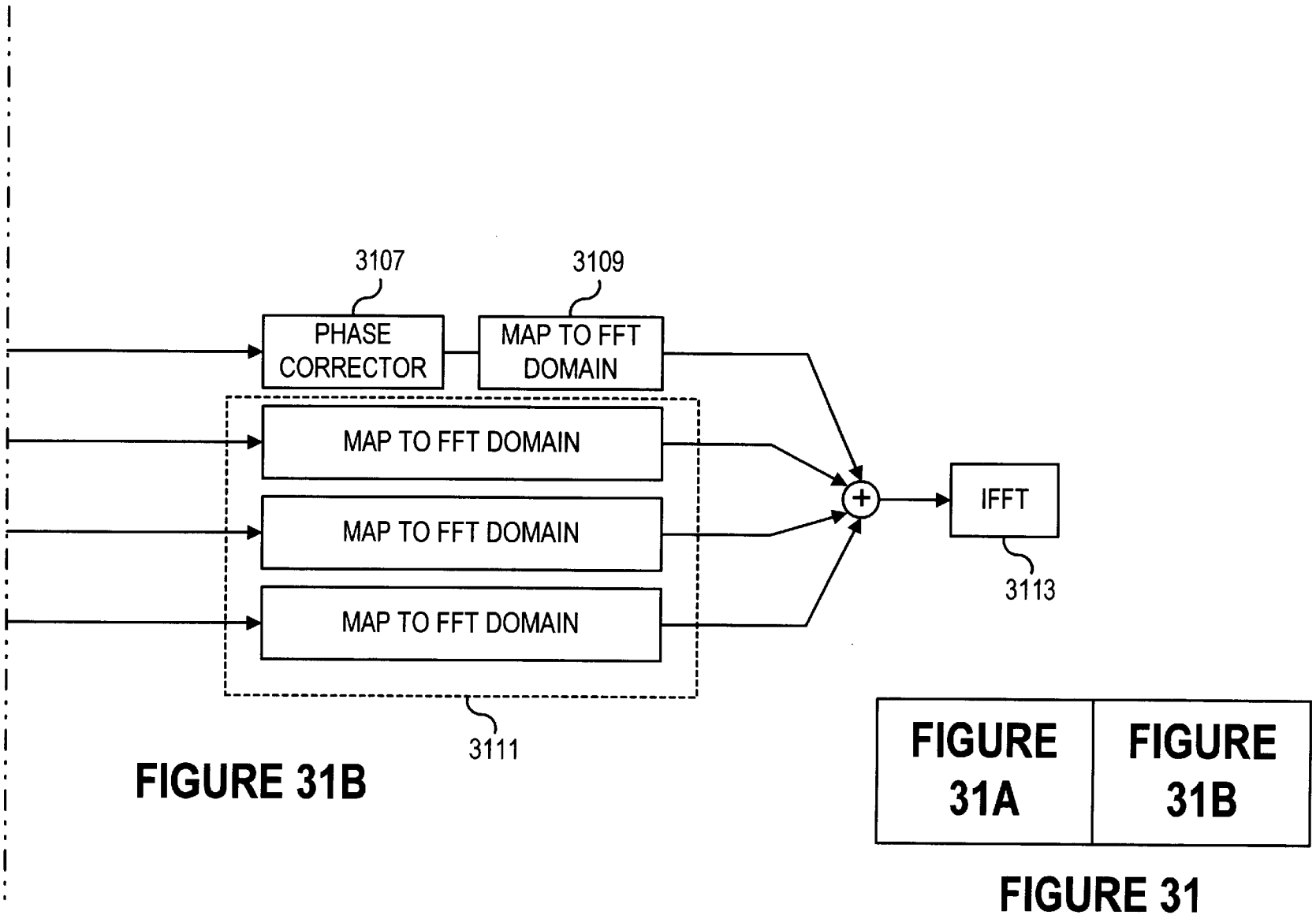
Figure 32:
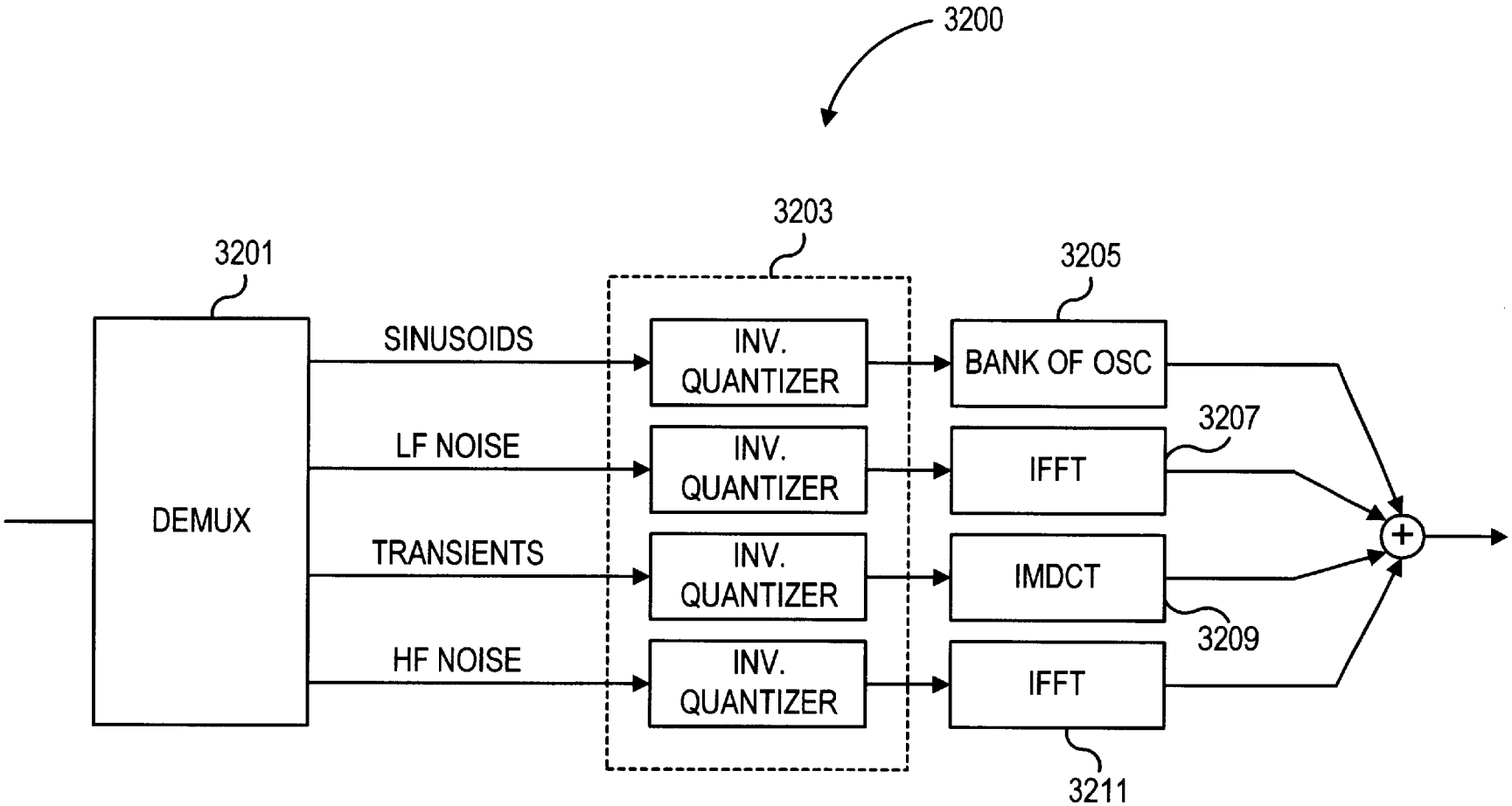
FIG. 32 is a flow diagram illustrating a preferred filter-bank type decoder according to the invention.

FIGS. 31 and 32 illustrate two alternatively preferred decoders for decoding composite sinusoidally, LF noise, transient and HF noise encoded audio as discussed above. The FIG. 31 ("IFFT") decoder is more preferred as providing substantially greater computational efficiency while the FIG. 32 ("filter-bank") decoder is preferred as providing an algorithmically simple solution. In both cases, certain basic considerations exist. For example, each unique invertible quantization method used and each encoding method will require a degree of unique processing. In addition, phase matching is needed at each sinusoid-to-transient interface.

More specifically, the IFFT decoder of FIG. 31 comprises communicatingly coupled elements including demultiplexer 3101, an inverse quantizer or quantizers 3103, compression domain modifier 3105, phase corrector 3107, sinusoidal map to FFT domain 3109, maps to FFT domain for the other encoding methods utilized, and inverse FFT 3113. Operationally, encoded audio is received by demux 3101. Following demultiplexing, each uniquely quantized encoded audio is inverse-quantized. After inverse quantization, compressed domain processor is provided for performing further compressed domain processing. Following such processing, sinusoidally encoded data is phase corrected and then mapped to the FFT domain. Alternatively encoded audio data is also mapped to the FFT domain. Finally, the mapped data is summed (without synthesis) and an IFFT is performed on the sum.

The filter bank decoder 3200 of FIG. 32 comprises communicatingly coupled elements including, as with IFFT decoder, demultiplexer 3201 and a bank of inverse quantizers. Filter bank decoder 3200 also comprises bank of oscillators 3205, inverse FFTs 3207 and 3211, and inverse MDCT 3209. Operationally, encoded data is received by demultiplexor 3201, and is inverse quantized. If sinusoidally encoded data has been received, then the data is reconstructed using a bank of oscillators. If the noise data has been received, the it is processed by an inverse FFT. If MDCT coded data has been received then it is processed by an inverse MDCT. Finally, having all been converted to a compatible form, the received data is summed.

Figure 33:
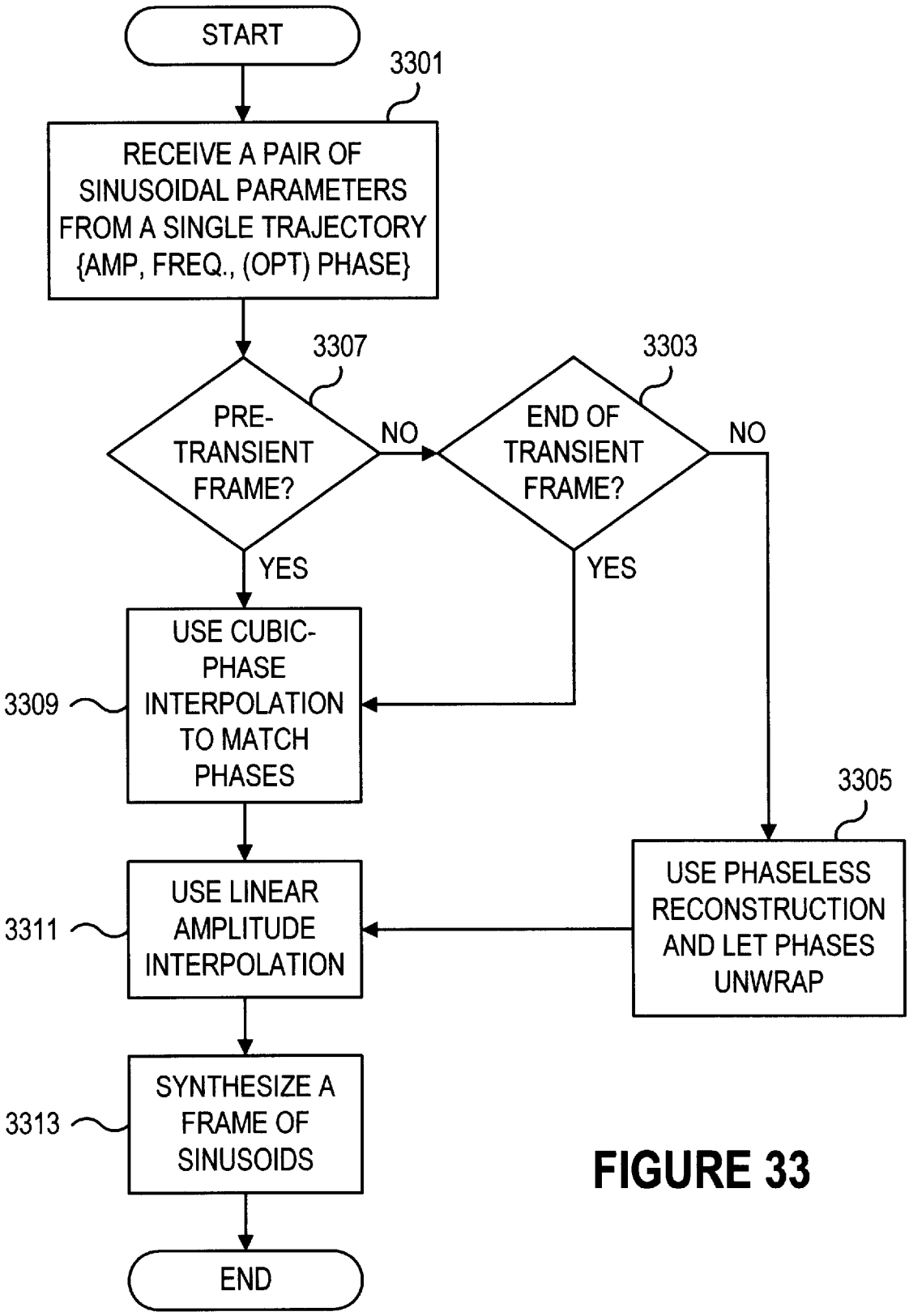
FIG. 33 is a flowchart illustrating a preferred method for phase locking according to the invention.

The FIG. 33 flowchart further illustrates a preferred method for phase locking. In step 3301, a pair of sinusoidal parameters from a single trajectory is received. If, in step 3307, the received pair is from a pre-transient frame, or if, in step 3303, the received pair is from an end of transient frame, then operation proceeds to steps 3309 through 3313. In step 3309 cubic phase interpolation is used to phase lock sinusoids with transients in that frame. In step 3311, linear amplitude interpolation is applied. In step 3313, a frame of sinusoids is synthesized. Otherwise, if neither a pre-transient frame nor an end of transient frame is received, then phaseless reconstruction is used to let phases unwrap.

Figure 34A:
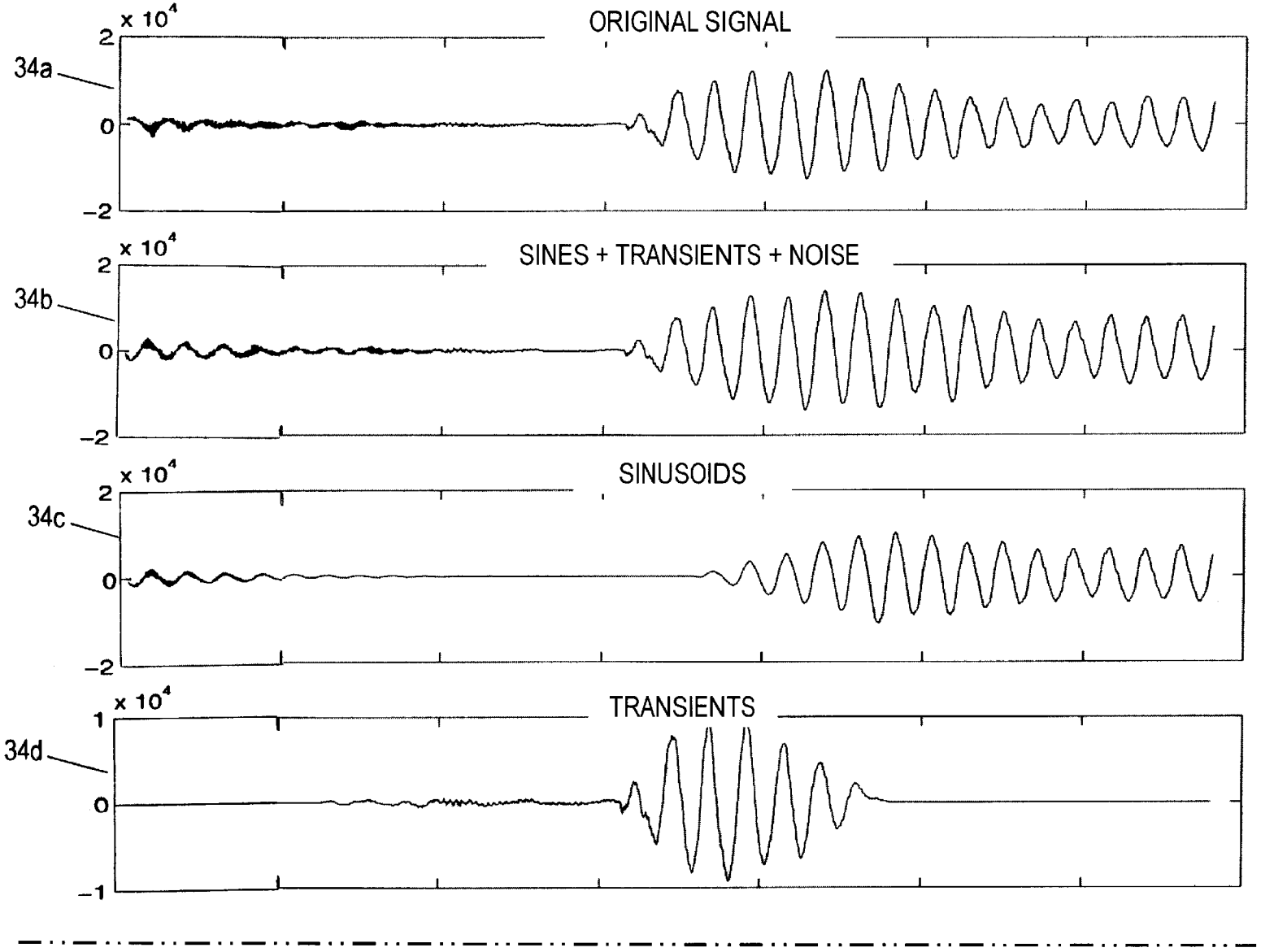
FIG. 34 is a composite graph illustrating an example of audio data generated using a preferred encoding system according to the invention.
Figures 34, 34B:
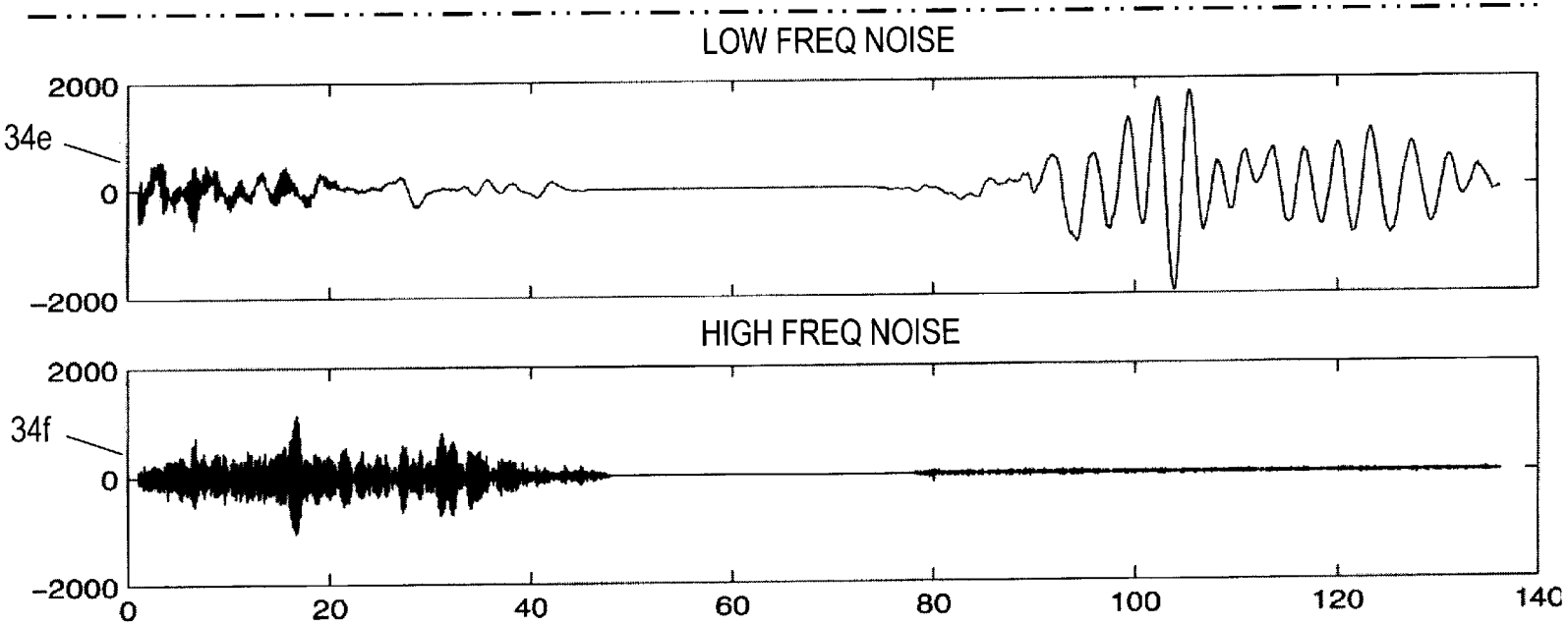

FIG. 34 illustrates exemplary composite encoded audio according to the invention. More specifically, graph 34*a* depicts an audio source and graph 34*b* depicts a composite waveform formed by combining sinusoidal, transient and noise encoding as discussed herein. The remain graphs 34*c* through 34*f* respectively represent each of the encoded data components of graph 34*b*. That is graph 34*c* shows sinusoidally encoded data, 34*d* shows transform coded transients, 34*e* shows LF noise encoded data and 34*f* depicts HF noise encoded data according to the teachings herein.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope and spirit of the invention as set forth. Therefore, many modifications may be made to adapt a particular situation or material to the teachings of the invention without departing from the essential scope and spirit of the present invention. It is intended that the invention not be limited to the particular embodiment disclosed as the best mode contemplated for carrying out this invention, but that the invention will include all embodiments and equivalents falling within the scope of the appended claims.

I claim:

1. An audio encoder comprising:

at least one parametric modeler;

at least one non-parametric modeler coupled to said parametric modeler; and at least one encoder which is coupled to the at least one parametric modeler and to the at least one non-parametric modeler and which produces encoded audio data from an audio source.

2. An audio encoder according to claim 1, wherein said at least one non-parametric modeler comprises a transform coder.

3. An audio encoder according to claim 1, wherein said at least one parametric modeler is selected from a group comprising sinusoidal modelers and noise modelers.

4. An audio encoder according to claim 3, wherein said at least one parametric modeler comprises a sinusoidal modeler, a low frequency noise modeler and a high frequency noise modeler.

5. An audio encoder according to claim 1, wherein said at least one parametric modeler comprises a sinusoidal modeler, a low frequency noise modeler and a high frequency noise modeler, and said non-parametric modeler comprises a transform coder.

6. An audio encoder according to claim 1, wherein operational parameters of said audio encoder are predetermined.

7. An audio encoder according to claim 1, wherein operational parameters of said audio encoder are modifiable.

8. An audio encoder according to claim 7, wherein operational parameters of said audio encoder are modifiable in accordance with automatically sensed characteristics of said audio source.

9. An audio encoder according to claim 7, wherein operational parameters of said audio encoder are modifiable in accordance with user input to said audio encoder.

10. An audio encoding method comprising:

(a) receiving an audio source;

(b) modeling non-transient portions of said audio source using at least one parametric modeler;

(c) modeling transient portions of said audio source using at least one nonparametric modeler; and (d) producing encoded audio data from the audio source in accordance with the modeling of (b) and (c).

11. A method according to claim 10, wherein said modeling step (b) comprises:

sinusoidally modeling a low frequency band of said non-transient portions of said audio source, thereby producing sinusoidally modeled audio;

quantizing said sinusoidally modeled audio, thereby producing a sinusoidal residual;

low frequency noise modeling said sinusoidal residual; and high frequency noise modeling a high frequency band of said non-transient portions of said audio source.

12. A method according to claim 10, wherein said modeling step (c) comprises:

substantially transform coding said transient portions of said audio source, thereby producing transform coded audio;

quantizing said transform coded audio, thereby producting a transient residual; and high frequency noise modeling said transient residual.

13. Audio data encoded according to the method of claim 10.

* * * * *